US011059662B2

(12) United States Patent
Marchitto et al.

(10) Patent No.: US 11,059,662 B2
(45) Date of Patent: Jul. 13, 2021

(54) RIGID PACKAGE WITH A HINGED LID AND WITH AN INNER CONTAINER CONNECTED TO THE FRONT WALL OF THE LID

(71) Applicant: G.D SOCIETA' PER AZIONI, Bologna (IT)

(72) Inventors: Giuseppe Marchitto, Lugo (IT); Luca Federici, Bologna (IT)

(73) Assignee: G.D SOCIETA' PER AZIONI, Bologna (IT)

( * ) Notice: Subject to any disclaimer, the term of this patent is extended or adjusted under 35 U.S.C. 154(b) by 526 days.

(21) Appl. No.: 15/746,816

(22) PCT Filed: Jul. 28, 2016

(86) PCT No.: PCT/IB2016/054534

§ 371 (c)(1),
(2) Date: Jan. 23, 2018

(87) PCT Pub. No.: WO2017/017645

PCT Pub. Date: Feb. 2, 2017

(65) Prior Publication Data

US 2020/0079579 A1 Mar. 12, 2020

(30) Foreign Application Priority Data

Jul. 29, 2015 (IT) ..... 102015000038860

(51) Int. Cl.
*B65D 85/10* (2006.01)

(52) U.S. Cl.
CPC ..... *B65D 85/1009* (2013.01); *B65D 85/1056* (2020.05)

(58) Field of Classification Search
CPC ..... B65D 85/1045; B65D 85/1009; B65D 85/10568; B65D 85/1056; B65D 85/1036
(Continued)

(56) References Cited

U.S. PATENT DOCUMENTS 850,182 A * 4/1907 Poor ..... B65D 85/1009 206/250
4,850,482 A * 7/1989 Campbell ..... B65D 85/1045 206/273

(Continued)

FOREIGN PATENT DOCUMENTS

EP 0928751 A1 7/1999
EP 2754622 A1 7/2014

(Continued)

OTHER PUBLICATIONS

International Application No. PCT/IB2016/054534, International Search Report and Written Opinion, dated Nov. 22, 2016.

(Continued)

*Primary Examiner* — J. Gregory Pickett
*Assistant Examiner* — Jenine Pagan
(74) *Attorney, Agent, or Firm* — Marshall, Gerstein & Borun LLP

(57) ABSTRACT

A rigid package for tobacco articles with a hinged lid having: a group of tobacco articles; an inner container which houses the group of tobacco articles; an outer container which houses the inner container in a movable manner, so as to allow the inner container to move relative to the outer container; a hinged lid; and a moving mechanism, which moves the inner container relative to the outer container using the rotation movement of the lid and has a rigid connection tab, which connects a wall of the inner container to a wall of the lid.

13 Claims, 37 Drawing Sheets

(58) Field of Classification Search
USPC ..... 206/249, 250, 251, 254, 255, 265, 271, 206/273, 754, 755, 756
See application file for complete search history.

(56) References Cited

U.S. PATENT DOCUMENTS

| | | | | |
|---|---|---|---|---|
| 2005/0167299 | A1* | 8/2005 | Retelski | B65D 85/1009 206/249 |
| 2014/0124395 | A1* | 5/2014 | Nadeau | B65D 5/724 206/250 |
| 2015/0274351 | A1* | 10/2015 | Johansson | B65D 85/1045 229/116.5 |
| 2018/0215531 | A1* | 8/2018 | Polloni | B65D 85/1081 |

FOREIGN PATENT DOCUMENTS

| | | | |
|---|---|---|---|
| WO | WO-03/053796 | A1 | 7/2003 |
| WO | WO-2006/049665 | A2 | 5/2006 |
| WO | WO-2011/051076 | A1 | 5/2011 |
| WO | WO-2011/060795 | A1 | 5/2011 |
| WO | WO-2013/076863 | A1 | 5/2013 |
| WO | WO-2013/080372 | A1 | 6/2013 |

OTHER PUBLICATIONS

International Application No. PCT/IB2016/054534, International Preliminary Report on Patentability, dated Jan. 30, 2018.

* cited by examiner

RIGID PACKAGE WITH A HINGED LID AND WITH AN INNER CONTAINER CONNECTED TO THE FRONT WALL OF THE LID

CROSS-REFERENCE TO RELATED APPLICATIONS

This is the U.S. national phase of International Application No. PCT/IB2016/054534, filed Jul. 28, 2016, which claims the benefit of Italian Patent Application No. 102015000038860, filed Jul. 29, 2015.

TECHNICAL FIELD

The present invention relates to a rigid package with a hinged lid.

The present invention finds advantageous application to a cigarette package, to which the following description will make explicit reference without implying any loss of generality.

PRIOR ART

The rigid cigarette packages with a hinged lid are the most widespread cigarette packages on the market as they represent a good compromise between the costs of production (both relative to the wrapping material, and relative to the complexity of manufacturing) and the ergonomic ease of use. However the extraction of the cigarettes from a rigid cigarette package with a hinged lid can be relatively complex, especially when the group of cigarettes are relatively small in size; said situation can occur both when the group of cigarettes is made up by a limited number of standard size cigarettes (for example ten cigarettes instead of the traditional twenty cigarettes), and when the group of cigarettes is made with a small-diameter cigarette (the so-called "slim" cigarettes).

To solve said drawback it has been proposed that, rigid cigarette packages with a hinged lid are provided with devices for automatically lifting the group of cigarettes upwards (i.e. outwards) when the lid is opened. Normally, a lifting device of this type, on one side, is integral to the lid so as to be actuated by the opening/closing movement of the lid and on the other side is connected to the group of cigarettes to vertically move the group of cigarettes itself. Some examples of rigid cigarette packages with a hinged lid provided with lifting devices are described in the patent applications EP0928751A1, WO2006049665A2, WO2013076863A1 and WO2013080372A1.

However, known rigid cigarette packages with a hinged lid, provided with lifting devices have presented some drawbacks, mainly arising from the fact that during the rotation of the lid (in particular during the closing movement of the lid but also during the opening movement of the lid) a portion of the lifting device must be elastically deformed to allow the rotation of the lid itself. The elastic deformation of a portion of the lifting device is negative as it requires the application of a relatively high force on the lid to rotate the lid itself, consequently making the handling of the lid difficult. In addition, the elastic deformation of a portion of the lifting device is negative as the portion of the lifting device, by deforming, pushes onto the adjacent cigarettes, causing them to be a crushed which can easily ruin the cigarettes themselves (especially when the cigarette package is still full). To reduce the drawbacks described above a flexible lifting device (i.e. not rigid and therefore not having its own easily deformable shape) has been proposed; however, the use of a flexible lifting device does not allow a bi-directional movement of the group of cigarettes: in other words, when using a flexible lifting device, the group of cigarettes is automatically lifted when the lid is opened, but it is not automatically lowered when the lid is closed, and therefore it is necessary for the user to push the group of cigarettes downwards when closing the lid (therefore performing quite complex and completely unnatural actions).

The patent application WO2011051076A1 describes a rigid cigarette package with a hinged lid comprising: a group of cigarettes; an inner container housing the group of container in a sliding manner to allow the inner container to translate longitudinally relative to the outer container; a cup-shaped lid, which has a rear wall that is hinged to a rear wall of the outer container so as to allow the lid to rotate relative to the outer container; and a lifting mechanism which lifts the inner container relative to the outer container by using the rotation movement of the lid towards an open position. The lifting mechanism comprises a connection tab provided with a single rigid panel which is integral (glued) to the rear wall of the lid and is directly hinged to a rear wall of the inner container.

However, in the patent application WO2011051076A1, the lifting of the inner container relative to the outer container, is rather slight due to the opening of the lid (in the order of a few millimeters).

The patent application WO03053796A1 describes a rigid package for valuable items (perfumes or the like) with a hinged lid comprising: an article; an inner container A (illustrated in FIG. 3) which houses the article; an outer container O (illustrated in FIG. 4), which comprises an open upper end, a lower wall 30, a front wall 14, a rear wall 18, and two side walls 12 and 16, and houses the inner container A in a movable manner to allow the inner container A to move relative to the outer container O; a lid (devoid both of rear wall, and of side walls), which has a front wall 48,52 and an upper wall 46 that is hinged to the rear wall 18 of the outer container O to allow the lid to rotate relative to the outer container O; and a moving mechanism, which moves the inner container A relative to the outer container O (as illustrated in FIGS. 5, 6 and 7) by using the rotation movement of the lid and comprises a connection tab 72,76 that connects the back wall 62 of the inner container A to the front wall 52 of the lid by using the glue G.

The patent application EP2754622A1 represents the closest prior art and describes a cigarette package with a hinged lid, wherein the soft inner wrapper is glued to the upper wall of the lid to lift the cigarettes by using the opening movement of the lid. In essence, the patent application EP2754622A1 describes a rigid cigarette package with a hinged lid comprising: a group CR of cigarettes; an inner container PC (soft) housing the group CR of cigarettes; an outer container CB, which comprises an open upper end, a lower wall, a front wall, a rear wall, and two side walls, and houses the inner container PC in a movable manner, so as to allow the movement of the inner container PC relative to the outer container CB; a lid 20, which has an upper wall, a front wall, two side walls, and a rear wall, which is hinged to the rear wall of the outer container CB so as to allow the lid 20 to rotate relative to the outer container CB; and a moving mechanism, which moves the inner container PC relative to the outer container CB using the rotation movement of the lid 20 and comprising a connection tab 16*b* which connects a wall 16-2 of the inner container PC to an upper wall of the lid 20.

DESCRIPTION OF THE INVENTION

The object of the present invention is to provide a rigid package with a hinged lid, with said rigid package being free of the drawbacks described above and, at the same time being easy and inexpensive to manufacture.

According to the present invention, a rigid package with a hinged lid, as claimed in the attached claims is provided.

BRIEF DESCRIPTION OF THE DRAWINGS

The present invention will now be described with reference to the accompanying drawings, which illustrate some examples of non-limiting embodiments, wherein.

PREFERRED EMBODIMENTS OF THE INVENTION

Figure 2:
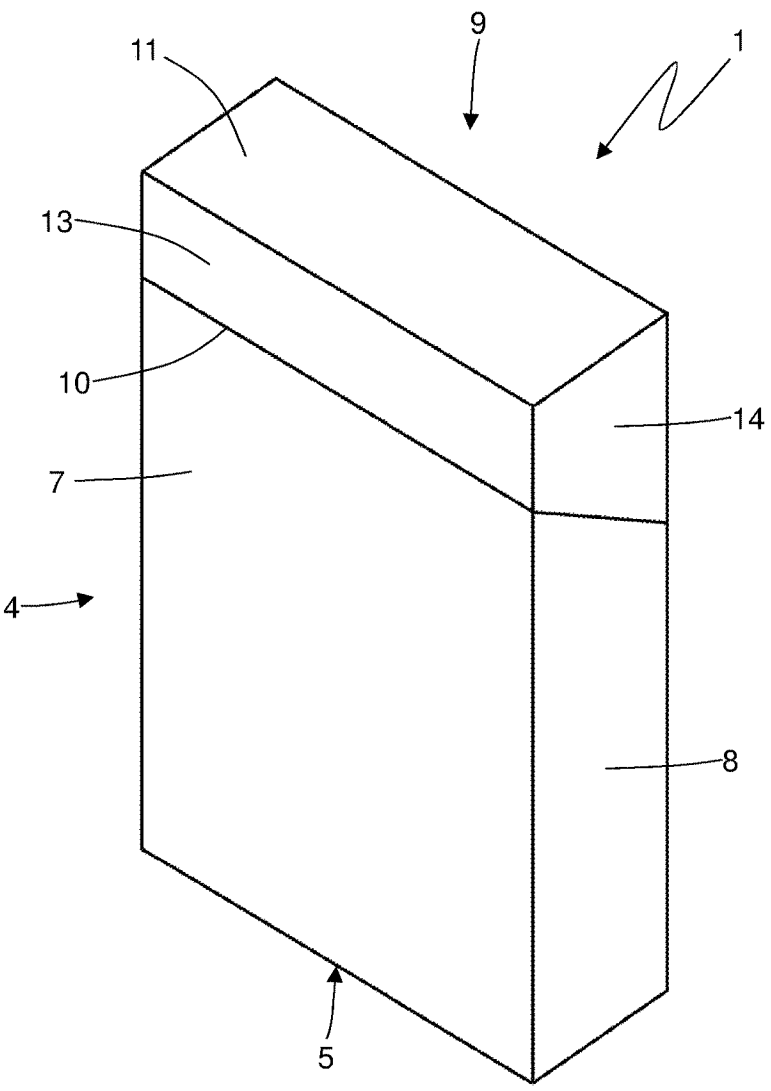
FIG. 2 is a rear perspective view of the cigarette package of FIG. 1 with a closed configuration.
Figure 1:
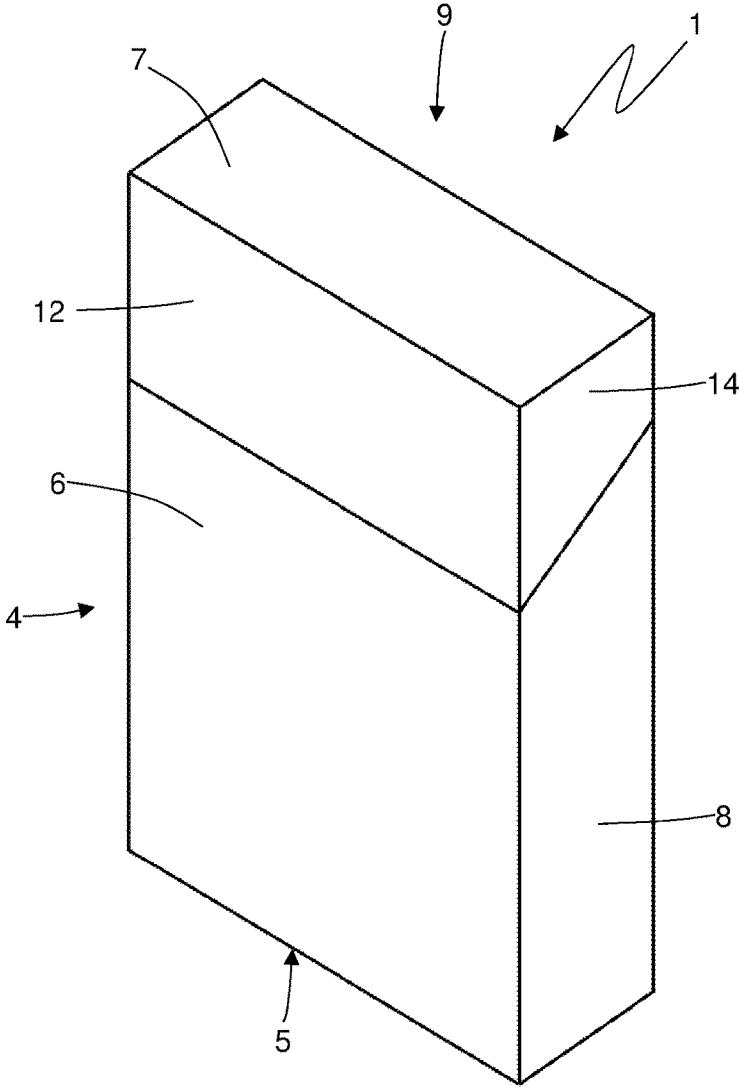
FIG. 1 is a front perspective view of a rigid cigarette package in a closed configuration made according to the present invention.
Figure 3:
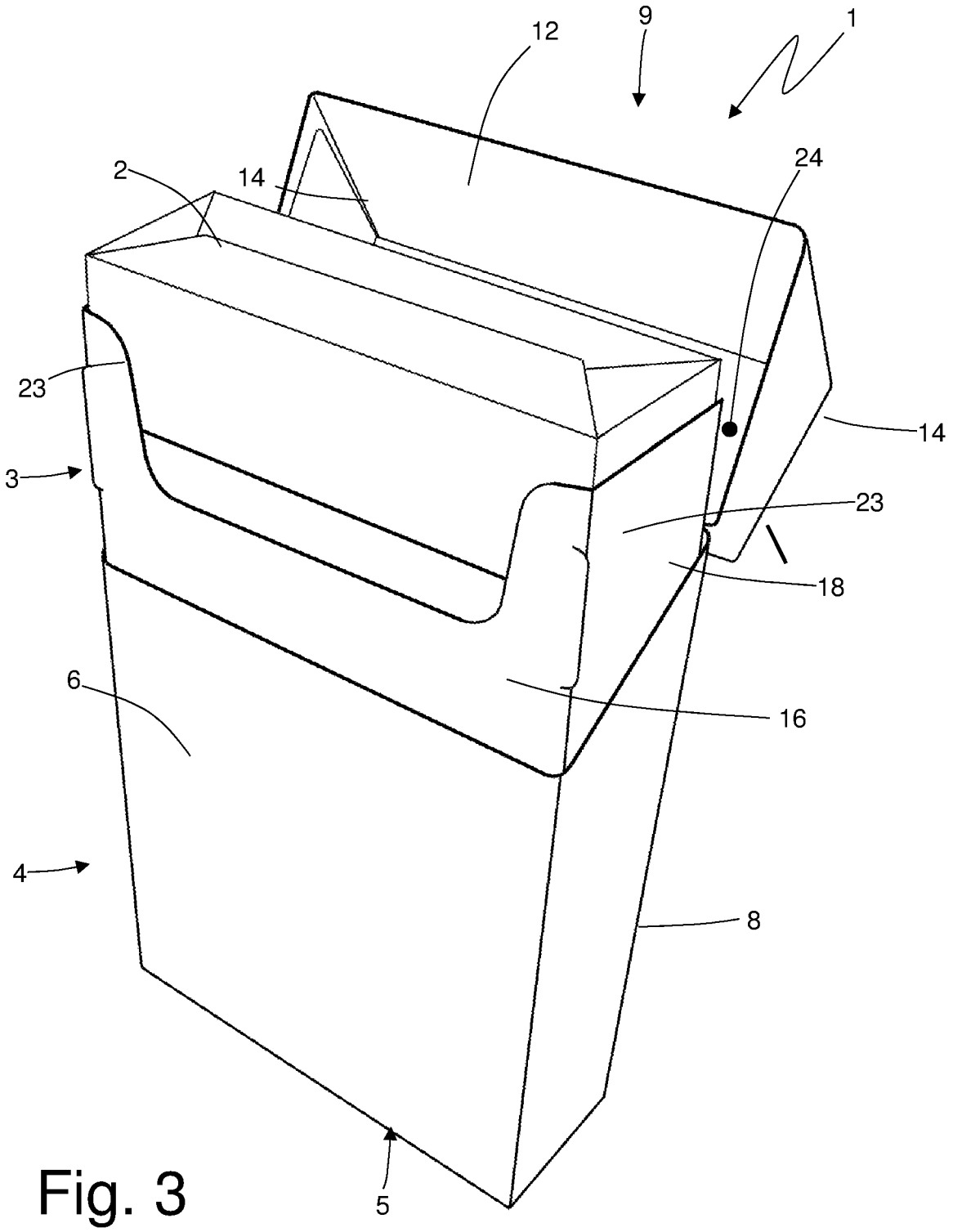
FIG. 3 is a front perspective view of the cigarette package of FIG. 1 with an open configuration.

In FIGS. 1, 2 and 3, number 1 denotes as a whole a rigid cigarette package with a hinged lid.

The cigarette package 1 illustrated in FIG. 1 comprises a wrapped group 2 of cigarettes (schematically visible in FIG. 3), i.e. a group of cigarettes wrapped in a wrapping sheet of metallized paper. In addition, the cigarette package 1 comprises a rigid type inner container 3 (visible in FIGS. 3, 4 and 5), inside which the wrapped group 2 of cigarettes is directly placed, and a rigid type outer container 4, which houses the inner container 3 in a sliding manner to allow the inner container 3 to slide relative to the outer container 4 and move with a linear translation movement between a lowered position, wherein the inner container 3 is fully inserted inside the outer container 4, and an extracted position (illustrated in FIGS. 3, 4 and 5), wherein the inner container 3 is partially extracted from the outer container 4 so as to facilitate the access to the wrapped group 2 of cigarettes.

The outer container 4 has a parallelepiped shape with a rectangular cross section, it is cup-shaped and has an open upper end, a lower wall 5 opposite to the open upper end, a front wall 6 and a rear wall 7 parallel and opposite to each other, and two side walls 8 parallel to each other. Between the walls 6 and 7 and the side walls 8 four longitudinal edges are defined whereas between the walls 6, 7 and 8 and the lower wall 5 four transverse edges are defined.

The cigarette package 1 comprises a lid 9, which is also cup-shaped and is hinged to the outer container 4 along a hinge 10 to rotate, relative to the outer container 4, between a closed position (illustrated in FIGS. 1 and 2) and an open position (illustrated in FIGS. 3, 4 and 5) of the open upper end of the outer container 4. The lid 9 has an upper wall 11 (which, when the lid 9 is in the closed position, is parallel and opposite to the lower wall 5 of the outer container 4), a front wall 12 (which, when the lid 9 is in the closed position, is coplanar to the front wall 6 of the outer container 4), a rear wall 13 (which is connected to the rear wall 7 of the outer container 4 by means of the hinge 10 and, when the lid 9 is in the closed position, is coplanar to the rear wall 7 of the outer container 4), and two side walls 14 parallel and opposite to each other (which, when the lid 9 is in the closed position, are coplanar to the corresponding side walls 8 of outer container 4). Between the walls 12 and 13 and the side walls 14 four longitudinal edges are defined whereas between the walls 12, 13 and 14 and the upper wall 11 four transverse edges are defined.

Figure 4:
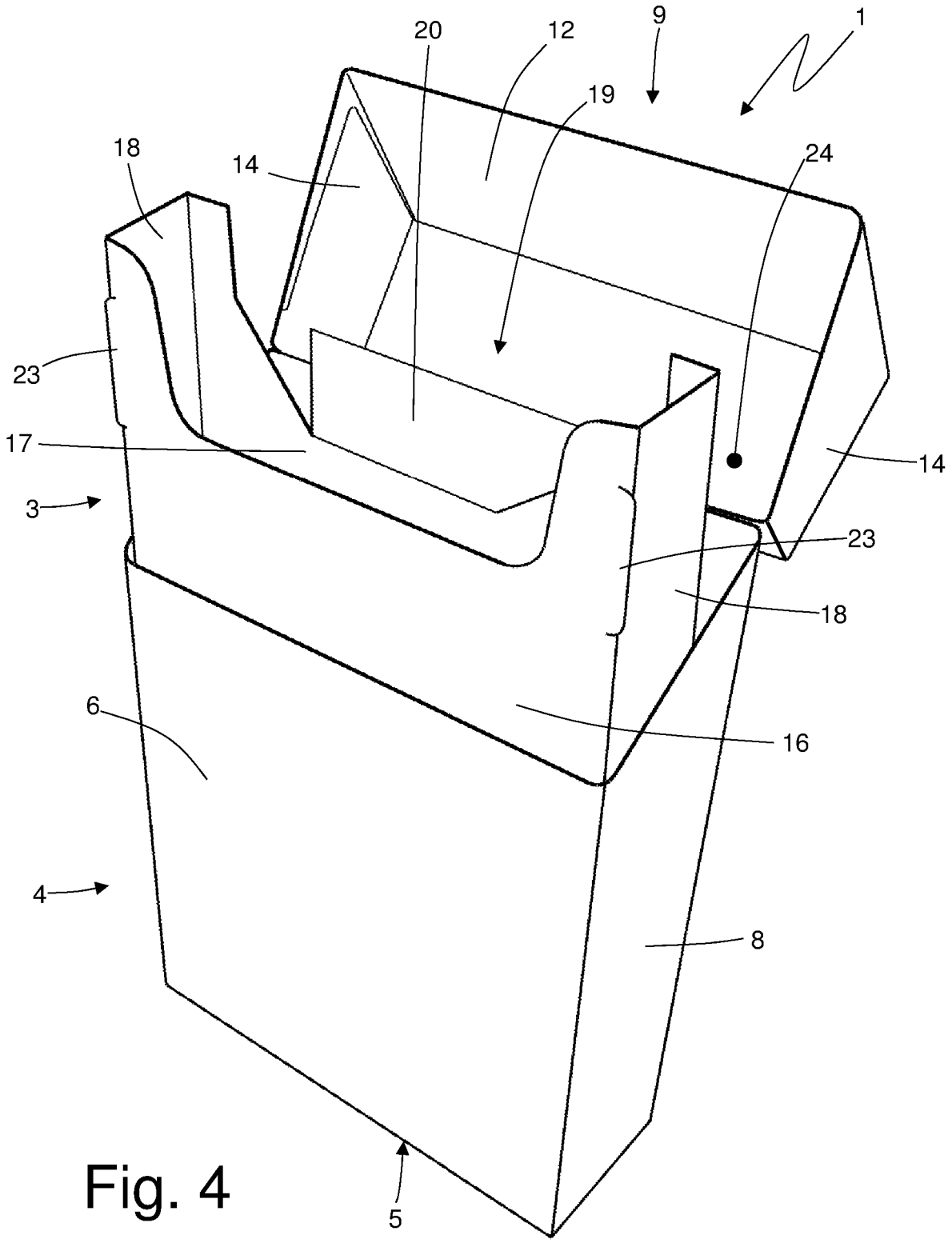
FIGS. 4 and 5 are two different perspective views, front and side, respectively, of the cigarette package of FIG. 1 with an open configuration and with the removal of the group of cigarettes.
Figure 5:
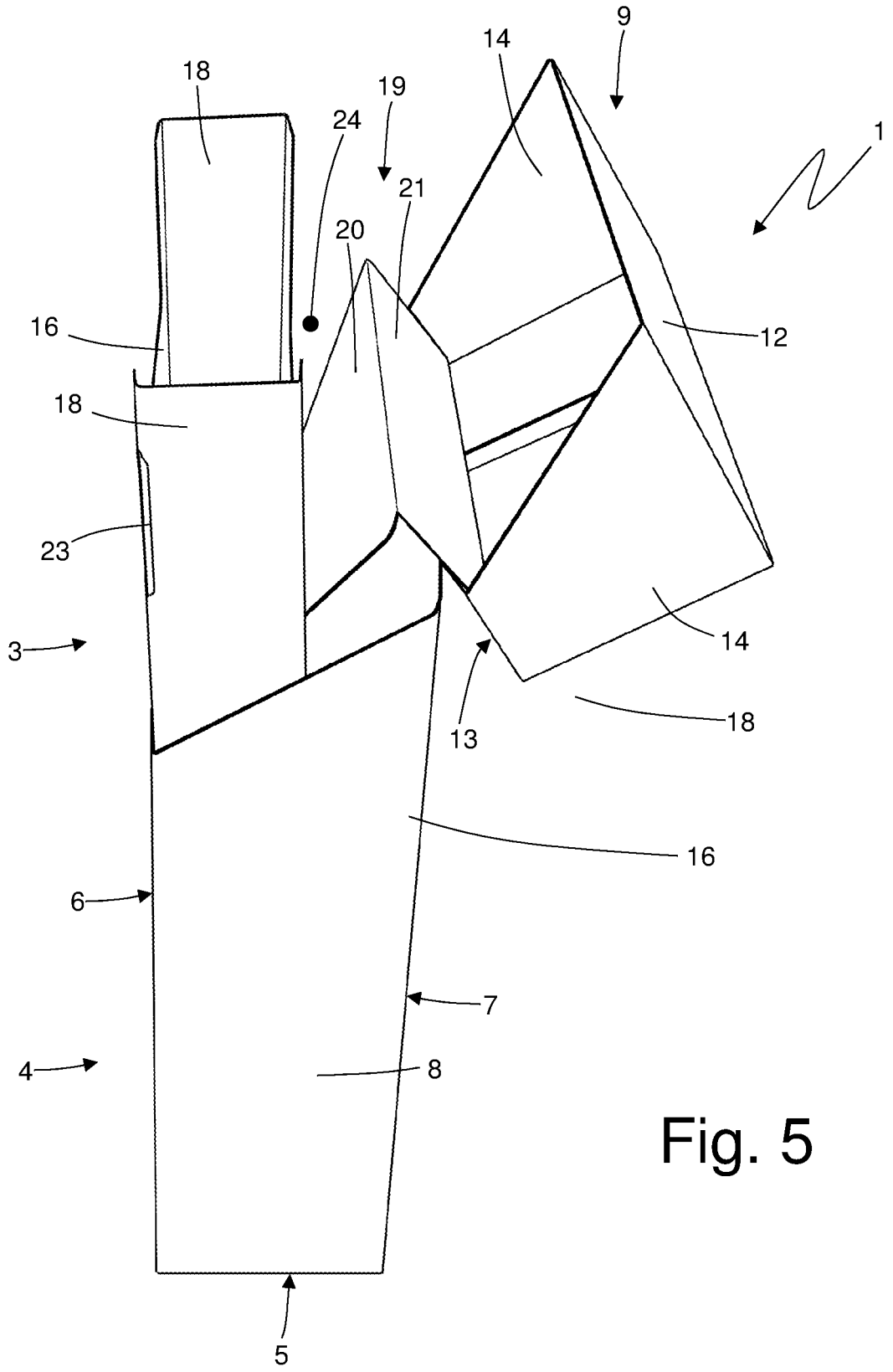
Figure 6:
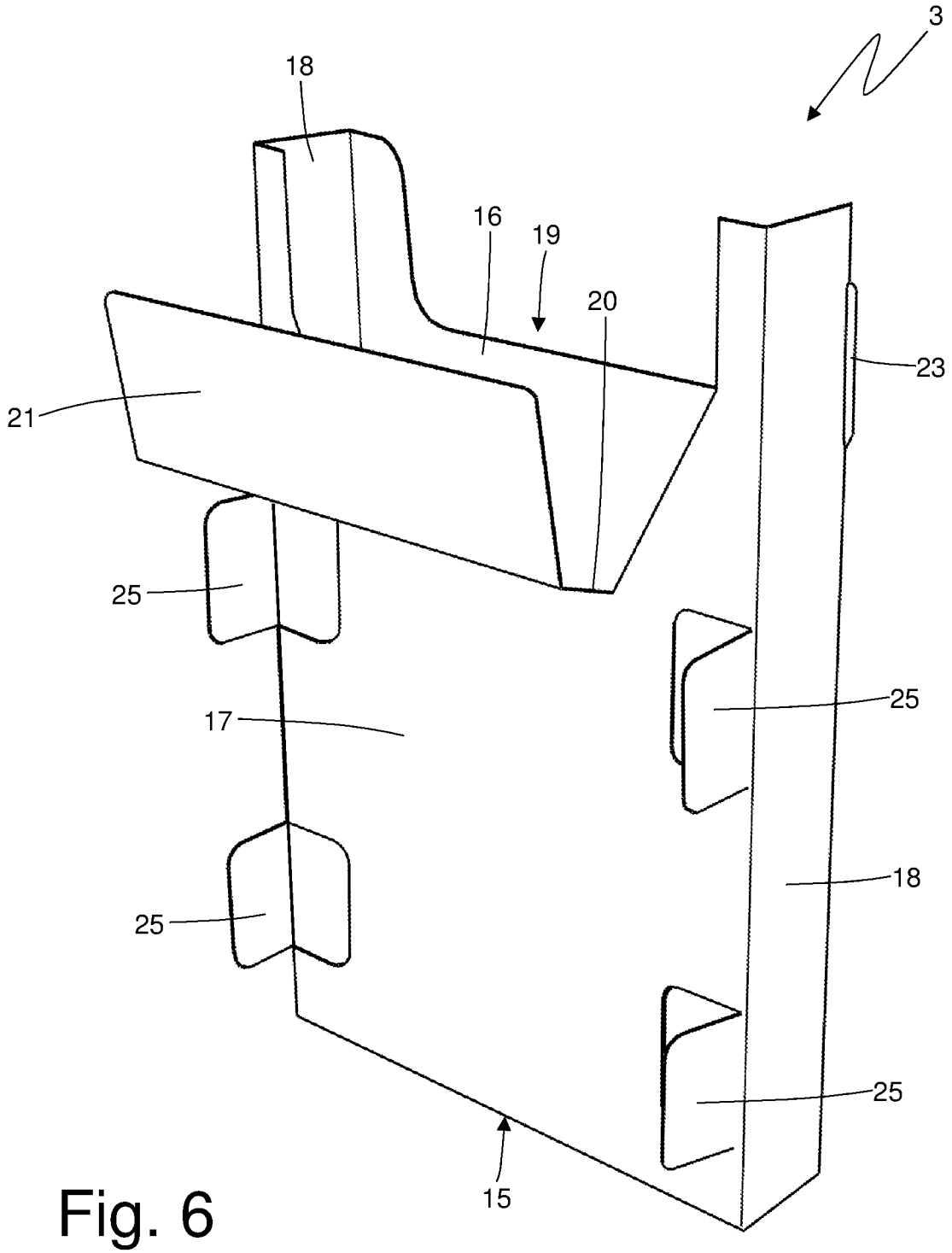
FIG. 6 is a rear perspective view of an inner container of the cigarette package of FIG. 1.
Figure 9:
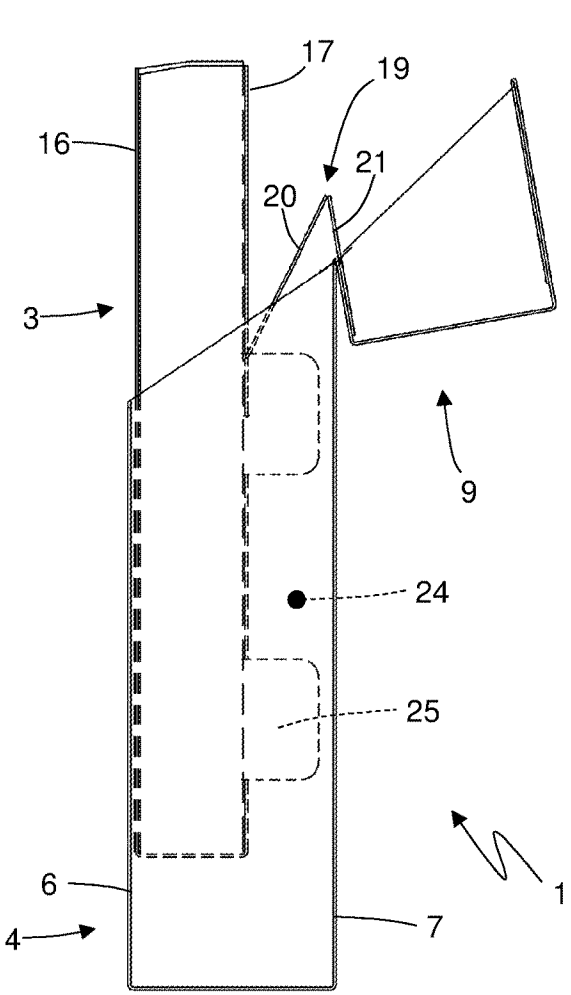
FIGS. 7, 8 and 9 are three different side views of the cigarette package of FIG. 1 with a closed configuration, in a partially open configuration, and in a fully open configuration, respectively.
Figure 8:
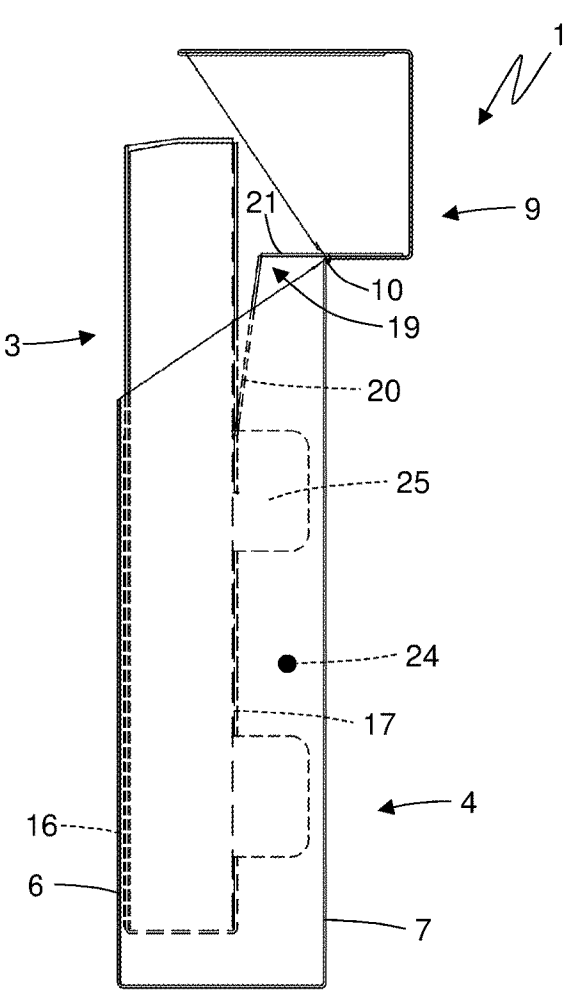

As illustrated in FIGS. 3, 4 and 5, the inner container 3 is parallelepiped-shaped with a rectangular cross section, it is cup-shaped and has an open upper end, a lower wall 15 opposite to the open upper end and parallel to the lower wall 5 of the outer container 4, a front wall 16 parallel to the front wall 6 of the outer container 4, a rear wall 17 parallel to the rear wall 7 of the outer container 4, and two side walls 18 parallel to the side walls 8 of the outer container 4. Between the walls 16 and 17 and the side walls 18 four longitudinal edges are defined whereas between the walls 16, 17 and 18 and the lower wall 15 four transverse edges are defined. According to a preferred embodiment illustrated in the attached figures, the front wall 16 of the inner container 3 has a "U"-shaped window at the top which has the function of facilitating the extraction of the cigarettes.

In the following description of the package 1 terms as "bottom" and "top" and "front" and "rear" will be used to designate the positions of portions of the cigarette package 1, assuming that the package 1 is located in such an arrangement, that the direction of its prevailing development coincides with the vertical direction; therefore, the lower and upper walls are arranged "at the bottom" and "at the top", respectively, and the front and rear walls define the "the front" and "the rear", respectively. The prevailing development direction also defines a longitudinal movement direction which is perpendicular to the transverse movement direction.

As previously mentioned, the inner container 3 slides relative to the outer container 4 with a linear translation movement parallel to the longitudinal edges between a lowered position (illustrated in FIGS. 1 and 2), wherein the inner container 3 is fully inserted inside the outer container 4 and the lower wall 15 of the inner container 3 is resting (i.e. in contact) with the lower wall 5 of the outer container 4, and an extracted position (illustrated in FIGS. 3, 4 and 5), wherein the inner container 3 is partially extracted from the outer container 4 and the lower wall 15 of the inner container 3 is spaced apart by a certain distance, different from zero, from the lower wall 5 of the outer container 4 (said distance corresponds to the lifting of the inner container 3 relative to the outer container 4).

As illustrated in FIGS. 3, 4 and 5, the rear wall 13 of the lid 9 is permanently and mechanically connected to the rear wall 17 of the inner container 3 by means of a connection tab 19 which makes up a mechanism for longitudinal movement of the inner container 3. It is important to note that the rear wall 13 of the lid 9 is connected to the rear wall 17 of the inner container 3 solely by means of the connection tab 19, i.e. outside of the connection tab 19 the rear wall 13 of the lid 9 is completely separate and independent from the rear wall 17 of the inner container 3.

The connection tab 19 makes up the mechanism of longitudinal movement of the inner container 3 and "automatically" controls (that is, without the user having to touch the inner container 3) and by using the rotation movement of the lid 9, the axial translation (i.e. the sliding) of the inner container 3 relative to the outer container 4 between the lowered position and the extracted position and vice versa; in other words, the connection tab 19 uses the rotational movement of the lid 9 to "automatically" actuate (that is, without the user having to touch the inner container 3) the axial translation (i.e. the sliding) of the inner container 3 relative to the outer container 4 between the lowered position and the extracted position and vice versa. Consequently, thanks to the connection tab 19 that mechanically binds the rear wall 13 of the lid 9 to the rear wall 17 of the inner container 3, when the lid 9 is rotated relative to the outer container 4 from the closed position to the open position the inner container 3 is pushed by the lid 9 from the lowered position to the extracted position in an "automatic" manner (that is, without the user having to touch the inner container 3); similarly, thanks to the connection tab 19 that mechanically binds the rear wall 13 of the lid 9 to the rear wall 17 of the inner container 3, when the lid 9 is rotated relative to the outer container 4 from the open position to the closed position the inner container 3 is pushed by the lid 9 from the extracted position to the lowered position in an "automatic" manner (that is, without the user having to touch the inner container 3). In this way, the user needs only to apply the necessary force to rotate the lid 9 relative to the outer container 4 without having to touch the inner container 3 which translation is "automatically" controlled.

The connection tab 19 (which makes up the mechanism for longitudinal movement of the inner container 3) is made up by three panels 20, 21 and 22 hinged to each other: the lower panel 20, on one side, is hinged to the rear wall 17 of the inner container 3 and, on the opposite side, is hinged to the upper panel 21, the upper panel 21, on one side, is hinged to the lower panel 20 and, on the opposite side is hinged to the reinforcement panel 22, and the reinforcement panel 22, is hinged to the upper panel 21 on one side. The upper panel 21 is integral to the rear wall 13 of the lid 9 (typically the upper panel 21 overlaps and is glued to the rear wall 13 of the lid 9), whereas the reinforcement panel 22 overlaps and is glued to the upper panel 21 to reinforce (strengthen, stiffen) the upper panel 21 itself. The reinforcement panel 22 is not strictly necessary, as it does not have any role in the functioning of the connection tab 19 (which would function in the same way even without the reinforcement panel 22); the only function of the reinforcement panel 22 is to reinforce (strengthen, stiffen) the upper panel 21 improving (but not changing in substance) the functioning of the connection tab 19.

According to a preferred embodiment, the inner container 3 also performs the function of "collar", i.e. keeping the lid 9 in the closed position with a certain force to prevent unwanted openings of the lid 9 itself. Said "locking" function of the lid 9 in the closed position is carried out due to the fact that when the lid 9 is in the closed position the inner container 3 partially protrudes from the open end of the outer container 4 and therefore engages a corresponding inner surface of lid 9: in this way, for opening the lid 9, it is necessary to elastically and slightly deform the lid 9 and/or the inner container 3, and therefore a certain force must be applied to the lid 9 to open the lid 9 itself. According to a preferred embodiment illustrated in the attached figures, the front wall 16 of the inner container 3 is provided with a pair of claws 23 which laterally project, so as to engage with interference the side walls 14 of the lid 9 when the lid 9 is in the closed position so as to keep, with greater force, the lid 9 in the closed position. According to a different embodiment not illustrated, the front wall 16 of the inner container 3 is devoid of claws 23.

The inner container 3 has a cross section smaller than the cross section of the outer container 4; accordingly, the inner volume of the outer container 4 is not completely occupied by the inner container 3, but a substantial portion of the inner volume (in the order of 30-50% of the inner volume) is free (i.e. not occupied by the inner container 3). In other words, the rear wall 17 of the inner container 3 is spaced apart from the rear wall 7 of the outer container 4 (by at least 2.5-3 mm), so as to define, inside the outer container 4 a chamber 24 which is arranged beside the inner container 3, and houses the connection tab 19. The chamber 24 is not occupied by the inner container 3 and is intended to house only the connection tab 19 which allows the lifting or the lowering of the group 2 of cigarettes when the lid 9 is opened or closed, respectively. The chamber 24 has a significant size and occupies at least 30% of the inner volume of the outer container 4; in the embodiments illustrated in the attached figures, the chamber 24 occupies approximately 40% of the inner volume of the outer container 4, but in other embodiments not illustrated the chamber 24 could also come to occupy 50-55% of the inner volume of the outer container 4. According to a preferred embodiment, the chamber 24 occupies at least 15-20% of the inner volume of the outer container 4. From another point of view, the chamber 24 transversely has a width of at least 2.5-3 mm.

The walls 16 and 17 of the inner container 3 have the same transverse size of the walls 6 and 7 of the outer container 4; accordingly, the side walls 18 of the inner container 3 are both substantially in contact 8 of the side walls of the outer container 4, and therefore the inner container 3 cannot perform any appreciable transverse movement in the direction perpendicular to the side walls 18 of the inner container 3 (i.e. perpendicular to the side walls 8 of the outer container 4). The side walls 18 of the inner container 3 have (by far) a smaller transverse size than the side walls 8 of the outer container 4; accordingly, the rear wall 17 of the inner container 3 is located at a certain distance D1 (illustrated in FIGS. 7 and 18) from the rear wall 7 of the outer container 4, and therefore the inner container 3 could theoretically perform transverse movements in a direction perpendicular to the walls 16 and 17 of the inner container 3 (i.e. perpendicular to the walls 6 and 7 of outer container 4).

As illustrated in FIGS. 6-9, to prevent these transverse movements of the inner container 3 inside the outer container 4 the side walls 18 of the inner container 3 have respective extensions 25, which are coplanar to the side walls 18 and extend outside the inner container 3 until touching the rear wall 7 of the outer container 4; overall, considering the extension of the side walls 18 and of the corresponding extensions 25, the inner container 3 has the same transverse size of the side walls 8 of the outer container 4 so that the inner container 3 cannot perform transverse movements inside the outer container 4. Therefore, the inner container 3 is free to longitudinally slide relative to the outer container 4, but cannot perform any transverse movement relative to (inside) the outer container 4. In other words, the extensions 25 of the side walls 18 of the inner container 3 have a guide function in that they prevent transverse movements of the inner container 3 relative to (inside) the outer container 4. According to a different embodiment not illustrated, the extensions 25 of the side walls 18 of the inner container 3 (having the function of guiding the longitudinal sliding of the inner container 3 relative to the outer container 4) are replaced by a guide shell which rises vertically projecting from the lower wall 6 of the outer container 4 and houses in its inside the inner container 3.

As previously mentioned, the rear wall 17 of the inner container 3 is spaced apart (i.e. arranged at a certain distance D1 different from zero) from the rear wall 7 of the outer container 4 leaving free (i.e. not occupied by the inner container 3) part of the inner volume of the outer container 4; the free inner volume (i.e. not occupied by the inner container 3) of the outer container 4 is comprised (delimited) between the rear wall 17 of the inner container 3 and the rear wall 7 of the outer container 4. The connection tab 19 connects, one to the other, the rear wall 17 of the inner container 3 and the rear wall 13 of the lid 9, and then extends between the rear wall 17 of the inner container 3 and the rear wall 13 of the lid 9; accordingly, the connection tab 19 corresponding entirely with the free inner volume (i.e. not occupied by the inner container 3) of the outer container 4 between the rear wall 17 of the inner container 3 and the rear wall 7 of the outer container 4 (i.e. the connection tab 19 is entirely arranged in the chamber 24). Said characteristic is particularly important, as the distance D1 between the rear wall 17 of the inner container 3 and the rear wall 7 of the outer container 4 allows the connection tab 19 to freely fold during rotation of the lid 9 without any constraint, without any elastic deformation, and without pressing on the inner container 3 and/or on the outer container 4.

Figure 18:
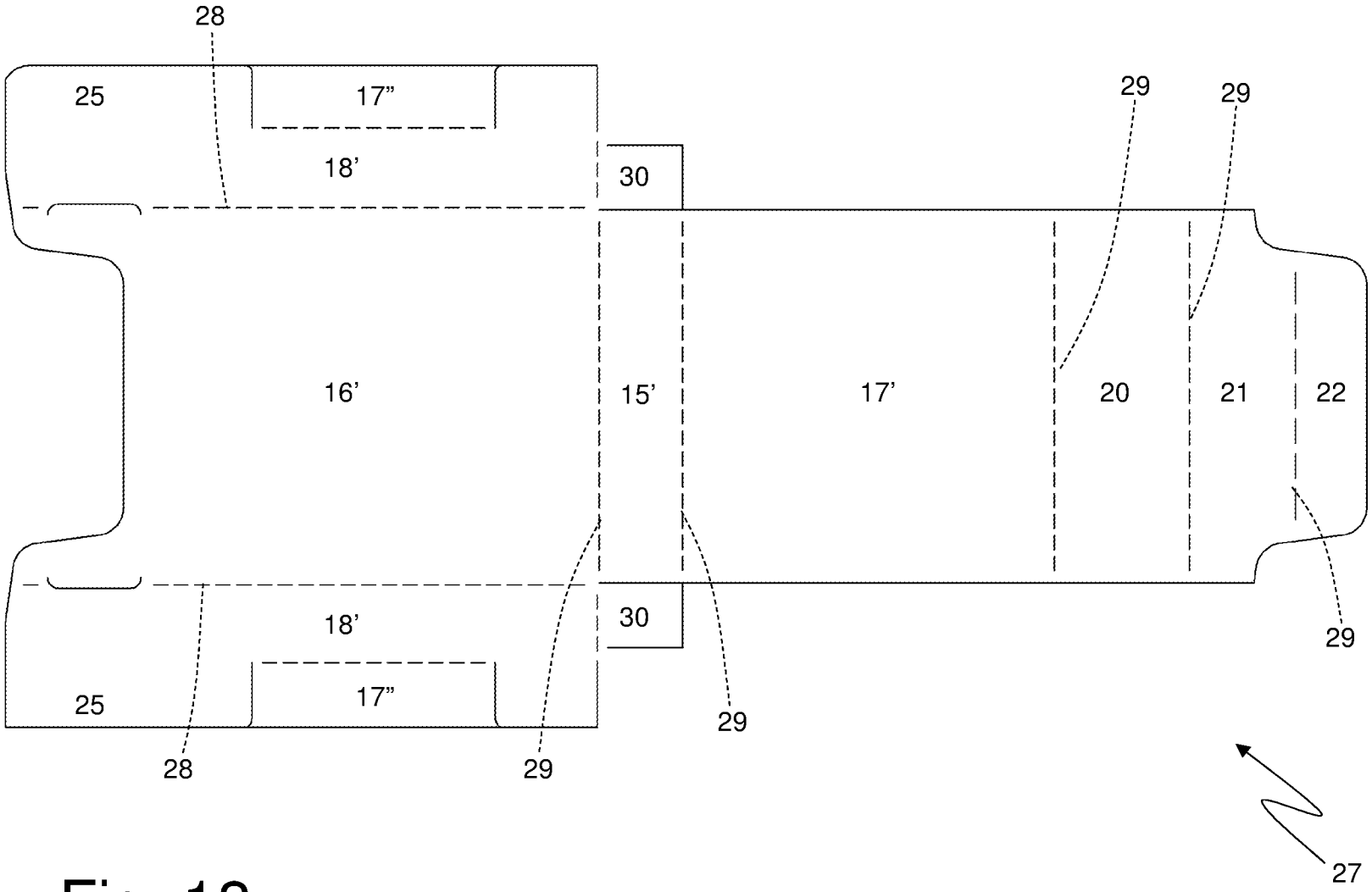
FIG. 18 is a plan view of an alternative of the blank of FIG. 17.

As more clearly illustrated in FIG. 18, the connection tab 19 (which makes up the mechanism for the longitudinal movement of the inner container 3) operates by means of a rod-crank mechanism (i.e. by means of a crankshaft) for transforming the rotary motion (the rotation of the lid 9 around the hinge 10) into a rectilinear movement (the lifting and lowering of the inner container 3 relative to the outer container 4). In the connection tab 19 the upper panel 21 (reinforced or not by the possible presence of the reinforcement panel 22) forms a crank while the lower panel 20 forms a connecting rod.

The connecting point of the connecting rod (lower panel 20) to the crank (upper panel 21) is made up by a hinge 30 and is fundamental to define the actuation sequence. In particular, in the embodiment illustrated in the attached figures, when the lid 9 is closed the connection point of the connecting rod (lower panel 20) to the crank (upper panel 21), i.e. the hinge 30 between the lower panel 20 and the upper panel 21, is arranged lower than the hinge 10 of the lid 9; furthermore, the connection point of the connecting rod (lower panel 20) to the crank (upper panel 21), i.e. the hinge 30 between the lower panel 20 and the upper panel 21, is arranged relative to the hinge 10 of the lid 9 at a distance D2 that it is shorter than the distance D1 between the rear wall 17 of the inner container 3 and the rear wall 7 of the outer container 4. In other words, when the lid 9 is closed, the hinge 30 between the lower panel 20 and the upper panel 21 is located lower than and at the distance D2 from the hinge 10 of the lid 9 and the distance D2 is shorter than the distance D1 that exists between the rear wall 17 of the inner container 3 and the rear wall 7 of the outer container 4.

According to a preferred embodiment, the distance D2 is comprised between 75% and 90% of the distance D1; the distance D2 must be as far as possible to increase the lifting stroke of the inner container 3 (in fact, the lifting stroke of the inner container 3 is slightly less than twice the distance D2), but at the same time the distance D2 must be adequately shorter than the distance D1 to avoid interference between the upper panel 21 (forming a crank) and the rear wall 17 of the inner container 3 which would impede the correct operation of the lifting mechanism.

Figure 7:
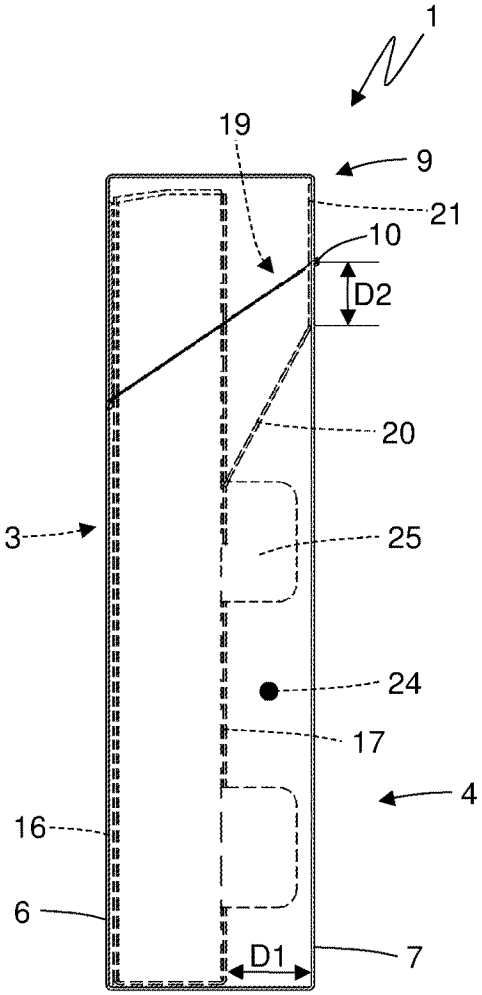

As illustrated in FIG. 7, when the lid 9 is closed on the lower panel 20 (forming a connecting rod) is inclined whereas the upper panel 21 (forming a crank) is perfectly vertical and rests against the rear wall 7 of the outer container 4. When the lid 9 starts to open (i.e. begins to rotate about the hinge 10 towards the open position), the upper panel 21 (forming a crank) rotates relative to the lower panel 20 (forming a connecting rod) until arriving in a horizontal position (illustrated in FIG. 8) wherein the upper panel 21 (forming a crank) is perpendicular to the rear wall 7 of the outer container 4; continuing the rotation of the lid 9 around the hinge 10 towards a fully open position of the lid 9 (illustrated in FIG. 9), the upper panel 21 (forming a crank) rotates relative to the lower panel 20 (forming a connecting rod) until being arranged almost parallel to the rear wall 7 of the outer container 4. When closing the lid 9 the movements described above are performed in the opposite way.

It is important to underline that during the initial part of the rotation of the lid 9 towards the open position, the lifting of the inner container 3 is moderate (i.e. initially the rotation of the lid 9 towards the open position determines a small lifting of the inner container 3); said characteristic allows the lid 9 to free the space over the inner container 3 before the inner container 3 itself starts to move upwards considerably.

According to a possible embodiment, it is possible to exploit the elasticity of the lower panel 20 (forming a connecting rod) of the connection tab 19 and/or of the rear wall 17 of the inner container 3 so as to generate a slight elastic preloading at the closed position, which helps to keep the lid 9 in the closed position; in this way a sort of snap at the closure and a kind of initial release at the opening is obtained. In other words, the panels 20 and 21 of the connection tab 19 can be dimensioned so that in the closed position the lower panel 20 of the connection tab 19 presses against the rear wall 17 of the inner container 3 determining an elastic deformation (mainly) of the rear wall 17 of the inner container 3 and (to a lesser extent) of the lower panel of the connection tab 19; said elastic deformation generates a slight elastic preloading in the closed position which helps to keep the lid 9 in the closed position.

Figure 10:
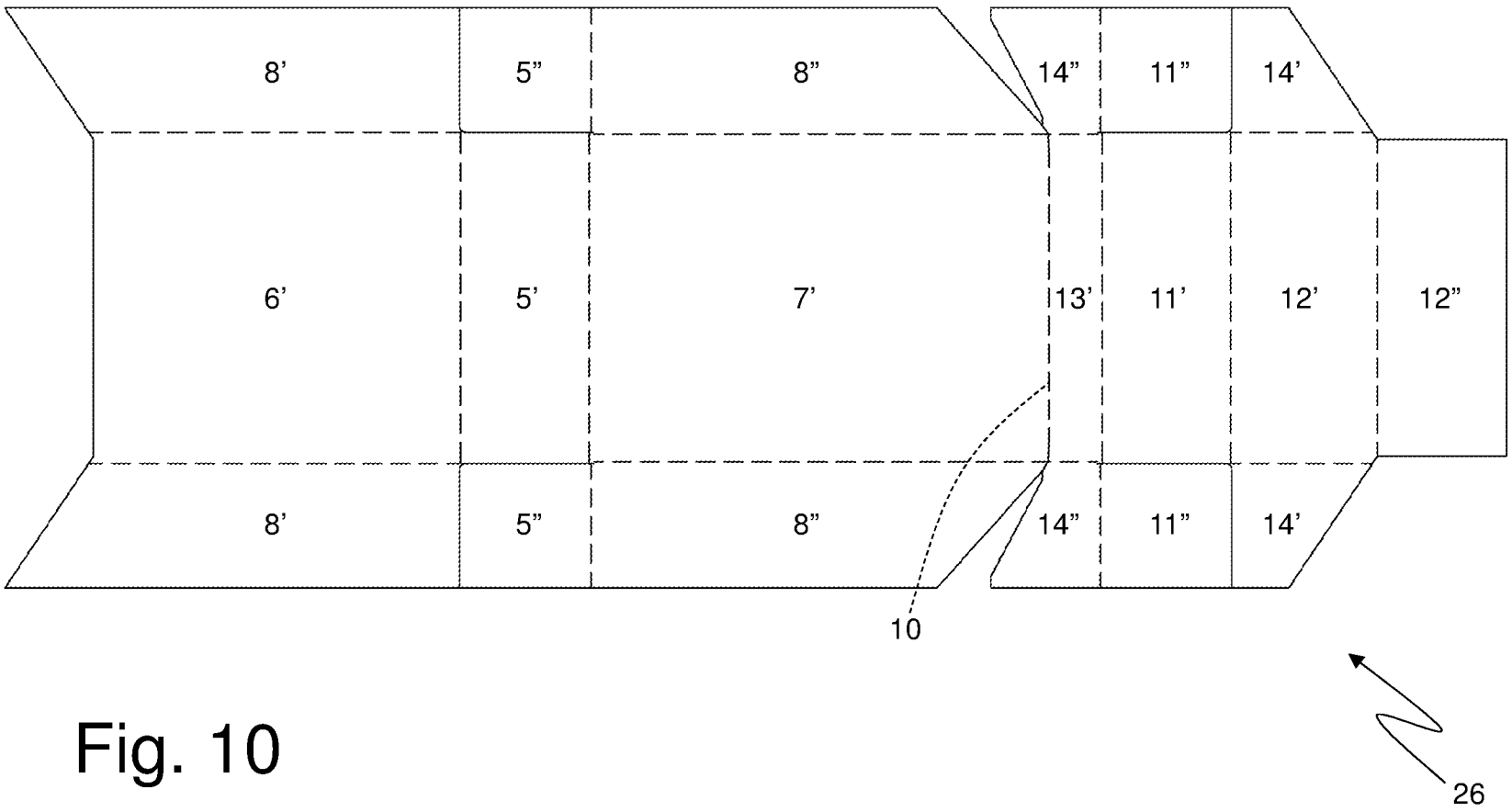
FIG. 10 is a developed flat view of a blank used to make an outer container of the cigarette package of FIG. 1.

As illustrated in FIG. 10, the outer container 4 and the lid 9 is obtained starting from a flat blank 26 having a substantially elongated rectangular shape and being of a known type (i.e. of the type commonly used to make a rigid cigarette package with a hinged lid). In FIG. 10, the various parts of the blank 26 have been marked, where possible, with accented reference numbers equal to the reference numbers distinguishing the corresponding walls of the outer container 4.

Figure 11:
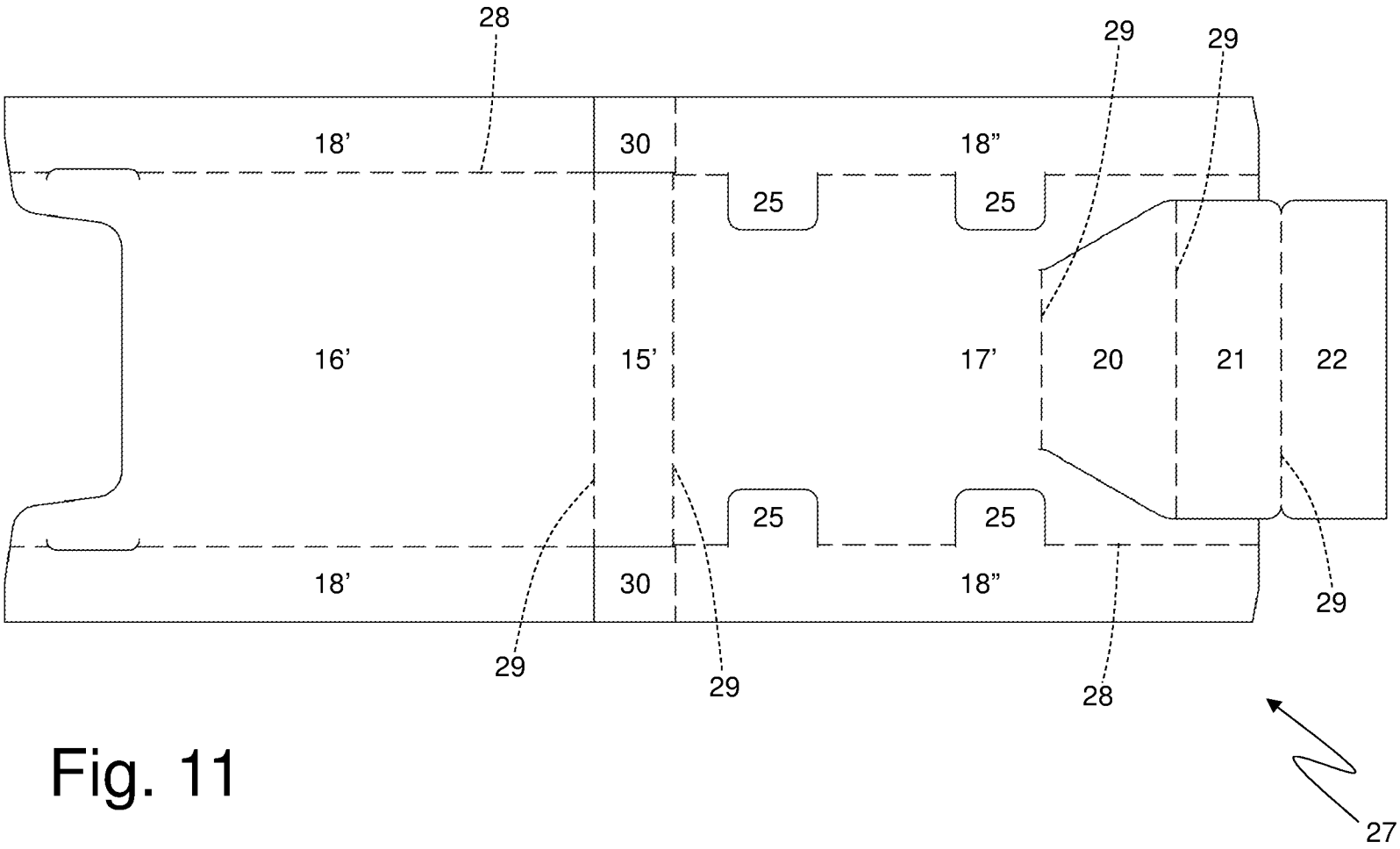
FIG. 11 is a developed flat view of a blank used to make an inner container of the cigarette package of FIG. 1.
Figure 12:
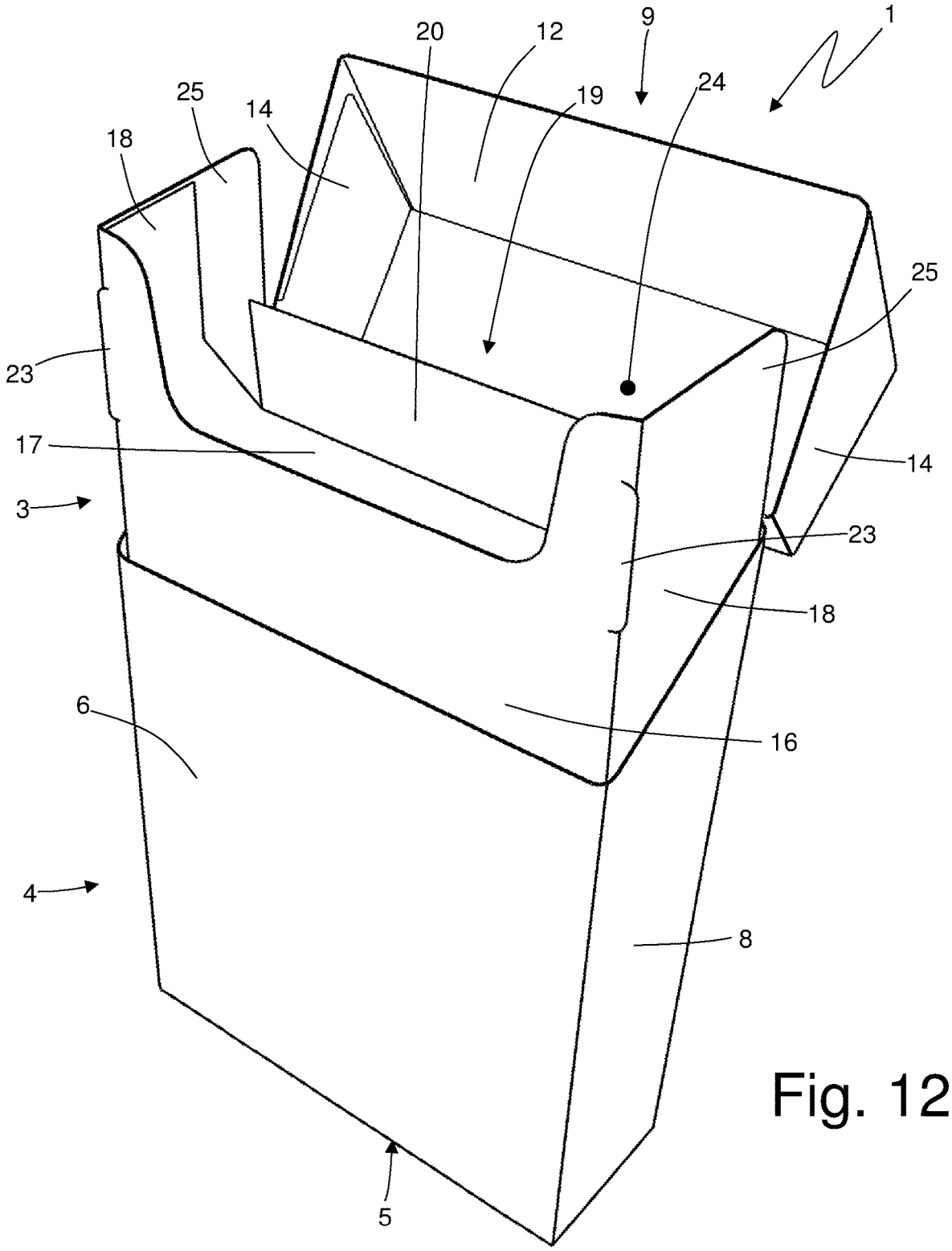
FIG. 12 is a front perspective view of an alternative of the cigarette package of FIG. 1 in an open configuration and with the removal of the group of cigarettes.
Figure 13:
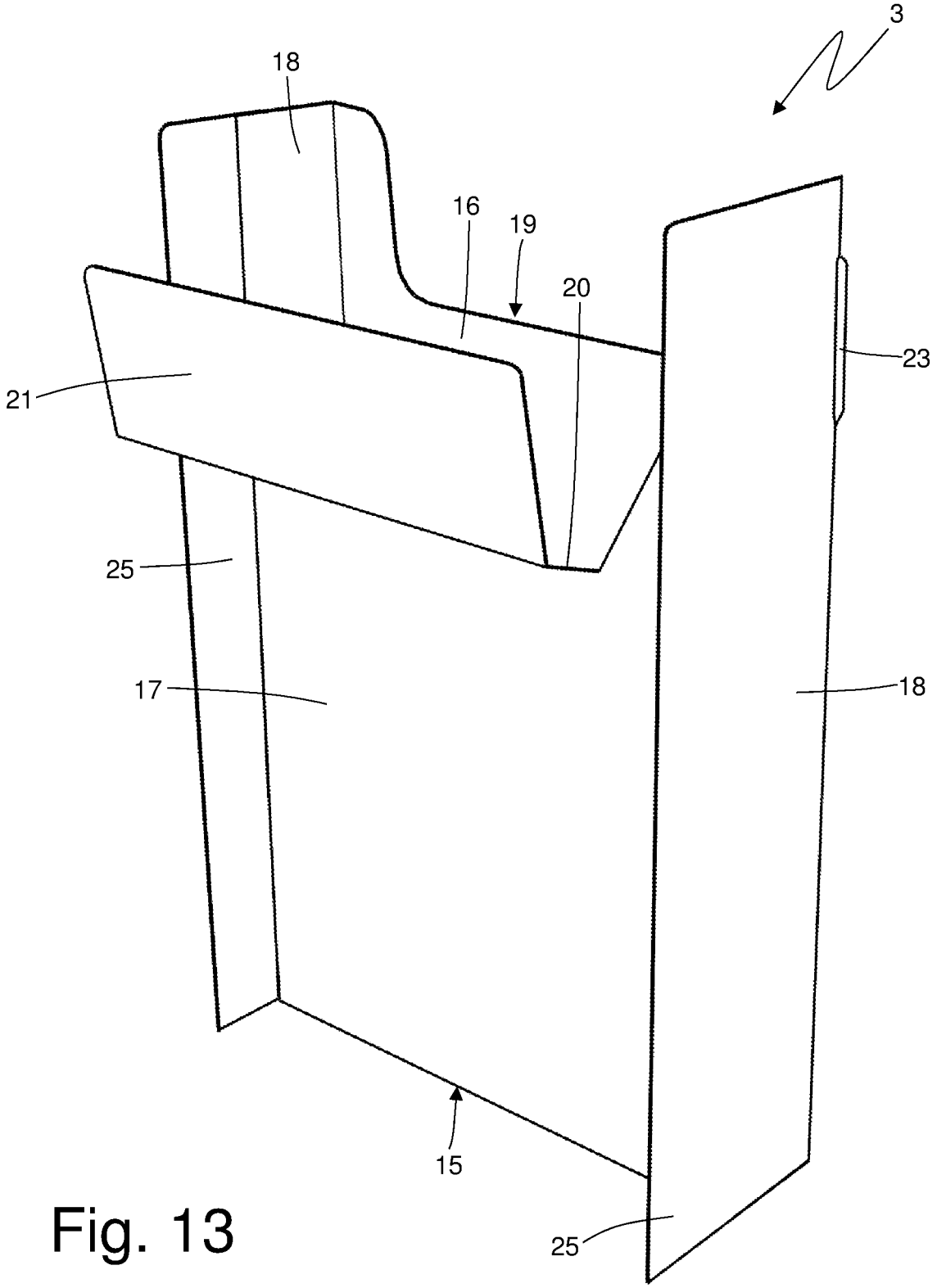
FIG. 13 is a rear perspective view of an inner container of the cigarette package of FIG. 12.
Figures 14, 15, 16:
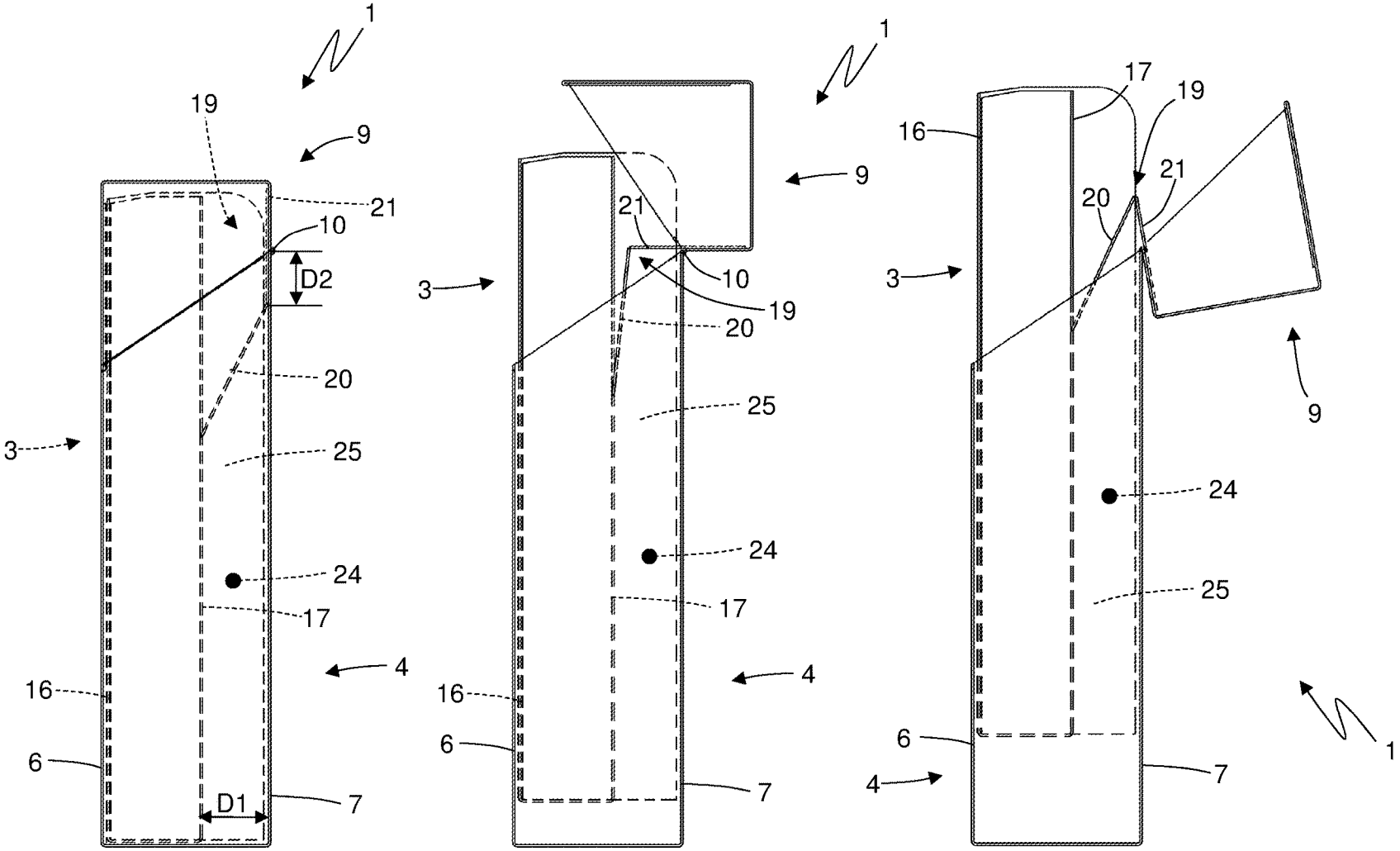
FIGS. 14, 15 and 16 are three different side views of the cigarette package of FIG. 12 in a closed configuration, with a partially open configuration, and with a fully open configuration, respectively.

As illustrated in FIG. 11, the inner container 3 is obtained starting from a flat blank 27 having a substantially elongated rectangular shape. In FIG. 11, the various parts of the blank 27 have been marked, where possible, with accented reference numbers equal to the reference numbers distinguishing the corresponding walls of the inner container 3.

The blank 27 has two longitudinal folding lines 28 (which define the longitudinal edges of the inner container 3) and a plurality of transverse folding lines 29 (which define the transverse edges of the inner container 3) defining, between the two longitudinal folding lines 28, a panel 16' which makes up the front wall 16 of the inner container 3, a panel 15' which makes up the lower wall 15 of the inner container 3 and is directly connected to the panel 16' along a transverse folding line 29, and a panel 17' which makes up the rear wall of the inner container 3, is directly connected to the panel 15' along a transverse folding line 29, and is connected to the connection tab 19.

The blank 27 comprises two flaps 18', which are arranged on opposite sides of the panel 16', which are connected to the panel 16' along the two longitudinal folding lines 28, and make up part of the side walls 18 of the inner container 3. The blank 27 comprises two flaps 18", which are arranged on opposite sides of panel 17', which are connected to the 17' panel along the two longitudinal folding lines 28, which make up part of the side walls 18 of the inner container 3, and overlap, and are glued to the corresponding flaps 18'. Each flap 18" comprises a tab 15" which rests against and is glued to the panel 15'.

In the embodiment illustrated in FIGS. 1-11, the extensions 25 make up a local lengthening of the flaps 18" and are formed by making corresponding "U"-shaped cuts in the panel 17' (which makes up the rear wall 17 of the inner container 3); in other words, the extensions 25 have a limited longitudinal size relative to the longitudinal size of the flaps 18" and affect a limited part of the flaps 18" (therefore the side walls 18 of the inner container 3), i.e. the extensions are shaped as relatively small "teeth" that project from the flaps 18" with a certain distance from one to the other (therefore the side walls 18 of the inner container 3). In this embodiment, the lengthening of the flaps 18" to make up/form the extensions 25 takes place towards the inside (that is, towards the panel 17'), and therefore the extensions 25 use part of the material of the panel 17' (accordingly, the rear wall 17 of the inner container 3 has "holes" at the extensions 25).

In the embodiment illustrated in FIGS. 1-11, the connection tab 19 transversely has a shorter extension relative to the extension of the rear wall 17 of the inner container 3 and therefore does not completely close the chamber 24; therefore the inside of the chamber 24 is partially visible both from above (through the spaces left free by the connection tab 19), and laterally (through the spaces left free by the extensions 25 of the side walls 18 of the inner container 3.

In FIGS. 12-17 an alternative of the cigarette package 1 illustrated in FIGS. 1-11 is illustrated, differing in the size of the extensions 25 of the side walls 18 of the inner container 3 and for the transverse sizes of the connection tab 19. The outer container 4 and the lid 9 (thus the corresponding blank 26) of the cigarette package 1 illustrated in FIGS. 12-17 are fully identical to the outer container 4 and to the lid 9 (therefore to the corresponding blank 26) of the cigarette package 1 illustrated in FIGS. 1-11.

Figure 17:
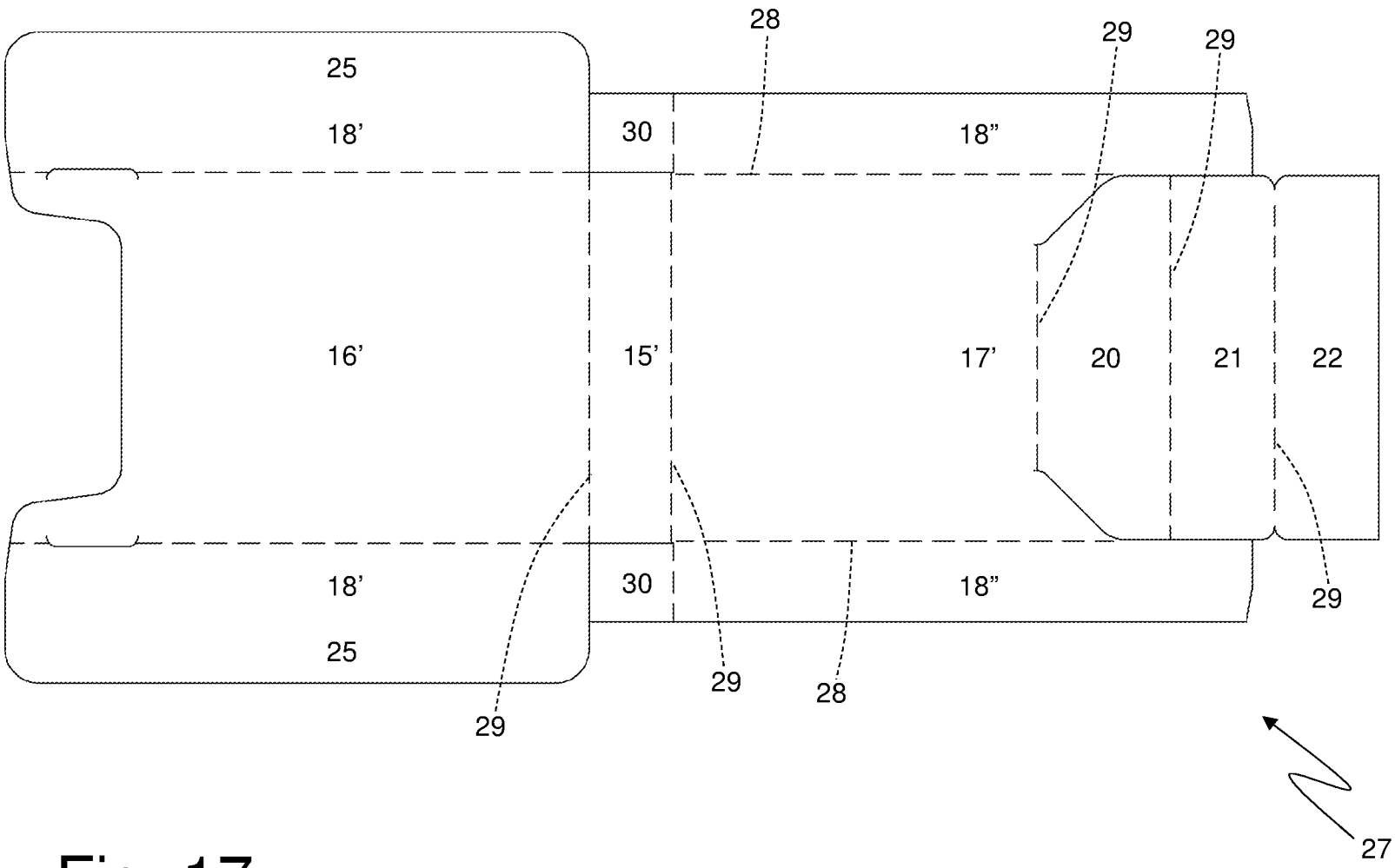
FIG. 17 is a developed flat view of a blank used to make an inner container of the cigarette package of FIG. 12.

In the embodiment illustrated in FIGS. 12-17, and in particular in the blank 27 of FIG. 17, the extensions 25 make up a continuous transverse lightening of the flaps 18' and seamlessly extend along the entire longitudinal extent of the flaps 18'; in other words, the extensions 25 have a longitudinal size identical to the flaps 18' (therefore to the side walls 18 of the inner container 3), i.e. the extensions resemble a continuous side extension of the flaps 18' (therefore the side walls 18 of the inner container 3), from the opposite side of the panel 16'. In this embodiment, the extension of the flaps 18' for forming the extensions 25 takes place towards the outside (that is, from the opposite side of the panel 17'), and therefore the extensions 25 do not use the material of the panel 17' (accordingly, the rear wall 17 of the inner container 3 is completely intact, that is, without "holes"). In this embodiment, the sides of the inner container 3 are completely covered and closed and the connection tab 19 is visible only from above (that is, it is not laterally visible).

In the embodiment illustrated in FIGS. 12-17, the connection tab 19 transversely has the same size of the rear wall 17 of the inner container 3 and therefore completely closes the chamber 24 (that is, the inside of the chamber 24 is not visible, as it is completely closed laterally by the extensions 25 of the side walls 18 of the inner container 3 and the top by the connection tab 19).

Figure 19:
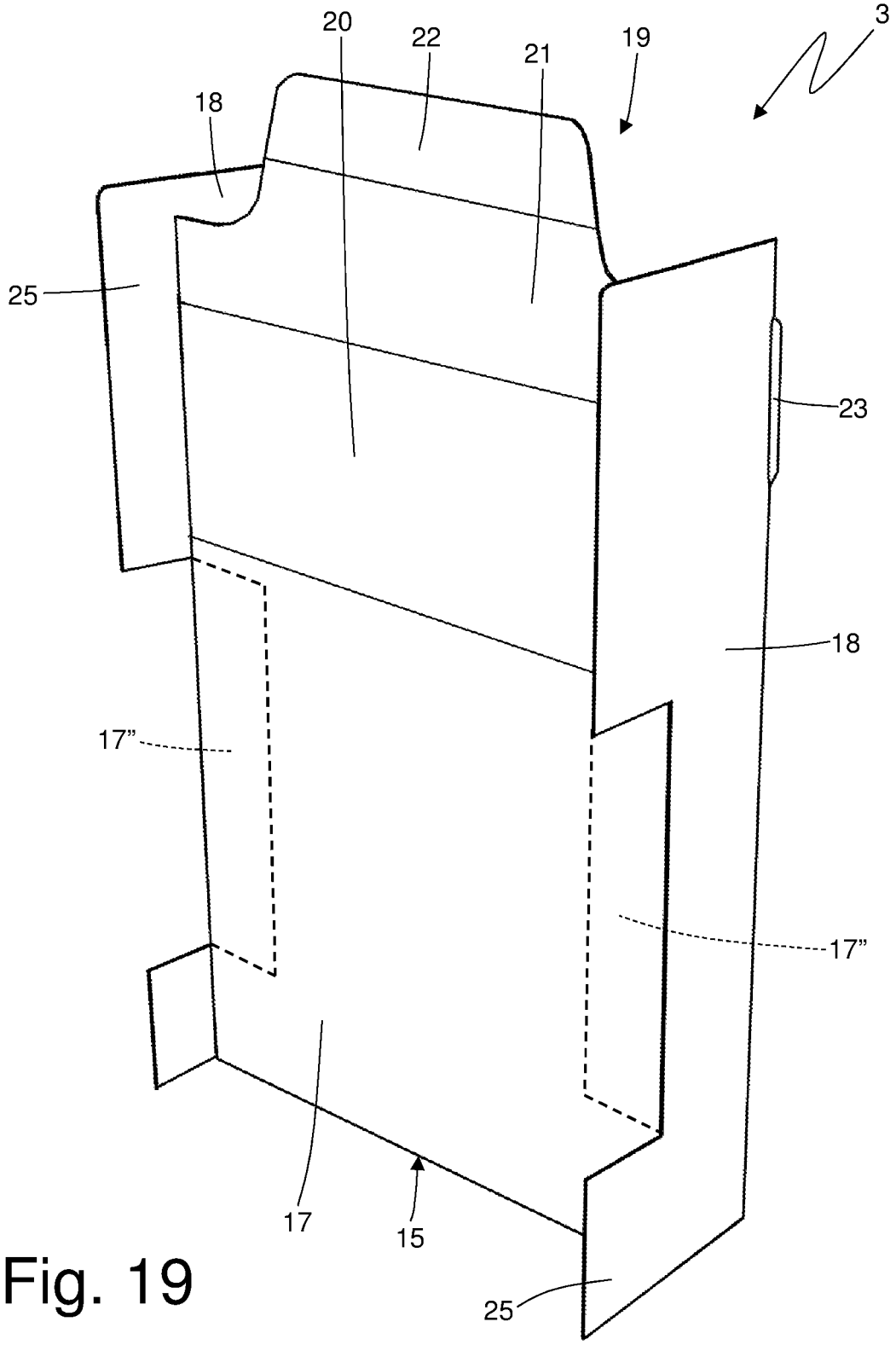
FIG. 19 is a rear perspective view of an inner container of the cigarette package of FIG. 12 made by using the blank of FIG. 18.

In FIG. 18 an alternative of the blank 27 illustrated in FIG. 17 is illustrated, wherein the flaps 18" have been eliminated and flaps 17" have been added which are formed inside of the extensions 25 and have the function of establishing a connection between the extensions 25 (i.e. the side walls 18) and the rear wall 17 of the inner container 3. In FIG. 19 the inner container 3 is illustrated, which is made, starting from the blank 27 illustrated in FIG. 18. As illustrated in FIG. 19, the flaps 17" are folded by 90° relative to the extensions 25 (i.e. to the side walls 18) and rest against the inside of the side wall 17; preferably, between the flaps 17" and the side wall 17 glue is interposed to establish a stable and inseparable connection between the flaps 17" and the side wall 17.

Figure 20:
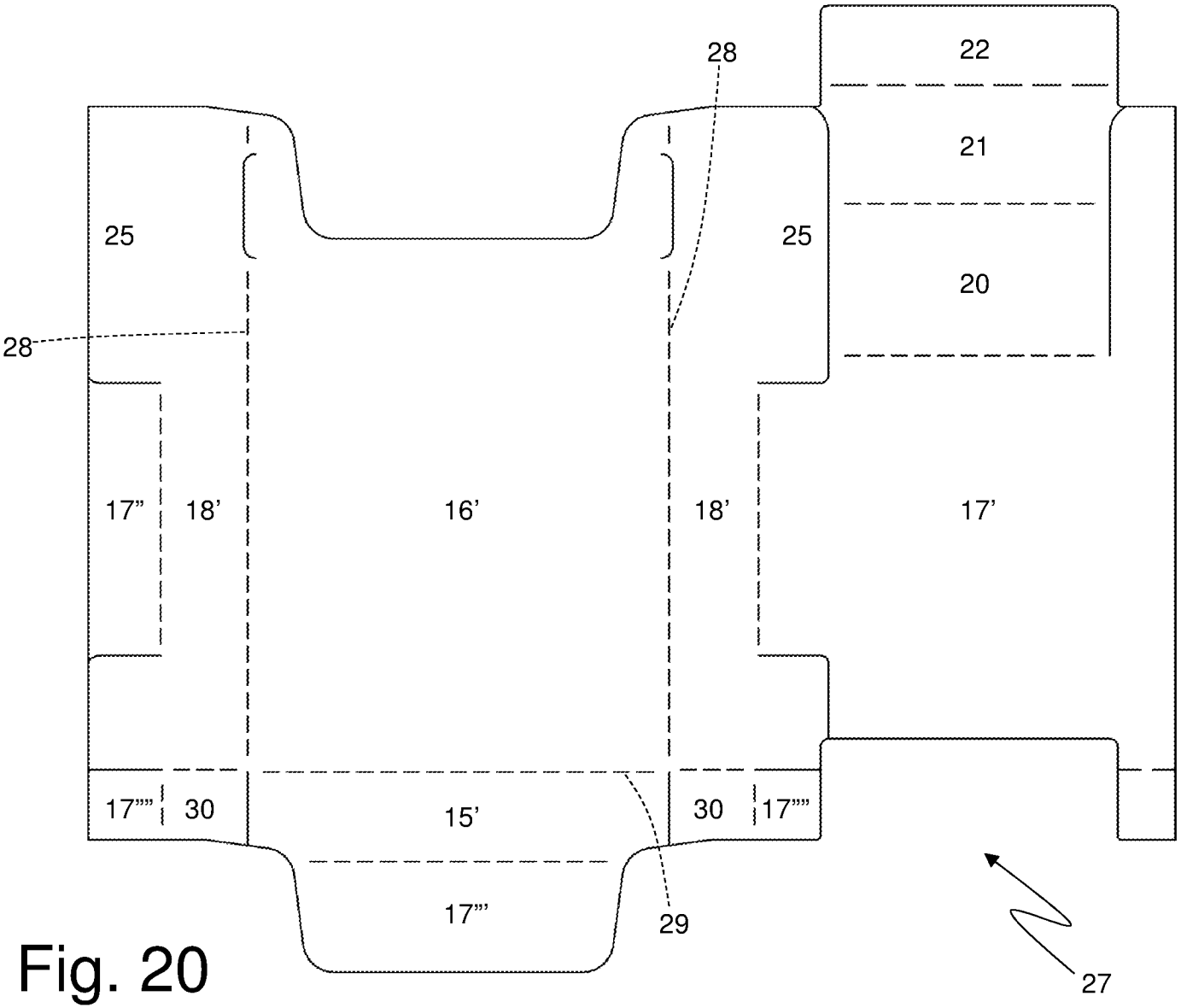
FIG. 20 is a plan view of a further alternative of the blank of FIG. 17.
Figure 21:
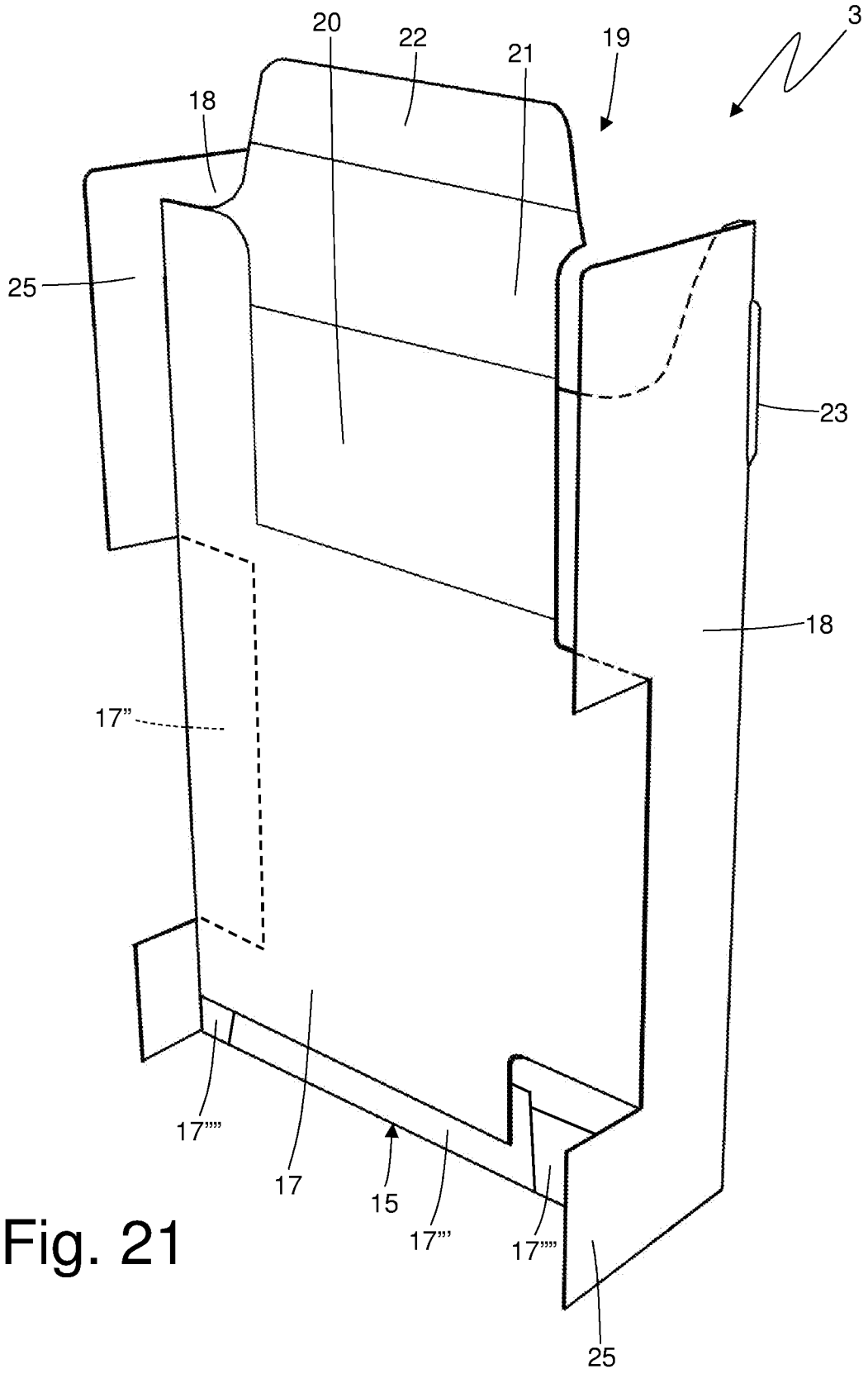
FIG. 21 is a rear perspective view of an inner container of the cigarette package of FIG. 12 made by using the blank of FIG. 20.

In FIG. 20 a further alternative of the blank 27 illustrated in FIG. 17 is illustrated, wherein the blank 27 has a transversal development (wherein the panel 16' is connected to panel 17' by means of the interposition of a flap 18') instead of a longitudinal development (wherein the panel 16' is connected to panel 17' by means of the interposition of the panel 15'). The blank 27 illustrated in FIG. 20 comprises a tab 17'" which is connected to the panel 15' along a transverse folding line 29, and is folded by 90° relative to the panel 15' and rests against the inside of the panel 17' (similarly to the flap 17") preferably with the interposition of glue. The blank 27 illustrated in FIG. 20 comprises two tabs 30, each connected to a flap 18' along a transverse folding line 29, it is folded by 90° relative to the flap 18' and rests against the inside of the panel 15' preferably with the interposition of glue. The blank 27 illustrated in FIG. 20 comprises two tabs 17"", each connected to a tab 30 along a longitudinal folding line 28, it is folded by 90° relative to the tab 30 and rests against the inside of the panel 17' (similarly to the flap 17' and to the tab 17"") preferably with the interposition of glue. Illustrated in FIG. 21 is the inner container 3 made, starting from the blank 27 illustrated in FIG. 20.

Figure 22:
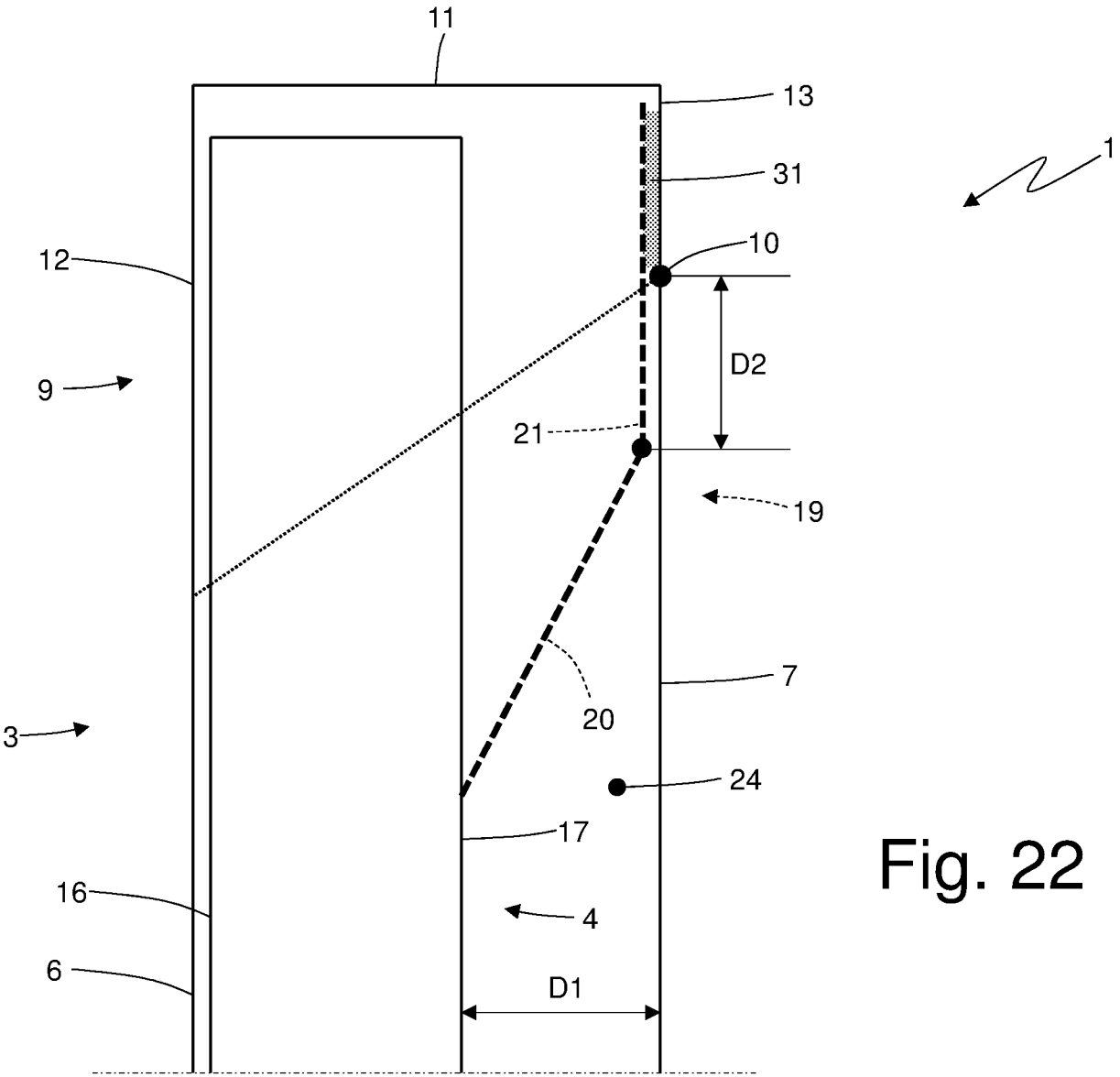
FIG. 22 is a schematic side view of the cigarette package of FIGS. 1 and 12 in a closed configuration.

The arrangement of the connection tab 19 of the embodiments illustrated in FIGS. 1-21 is illustrated schematically in FIG. 22: it should be noted how the lower panel 20 of the connection tab 19 is arranged from the bottom towards the top and originates from the rear wall 17 of the inner container 3, whereas the upper panel 21 of the connection tab 19 is glued to the rear wall 13 of the lid 9 by means of the glue 31; it is evident the distance D2 between the hinge 30 that connects the lower panel 20 to the upper panel 21, and the hinge 10 of the lid 9. When the lid 9 is in the closed position (illustrated in FIG. 22), the two panels 20 and 21 of the connection tab 19 form, one with the other, an obtuse angle. The panel 20 of the connection tab 19 (i.e. the connecting rod) pulls upwards the inner container 3 during the opening of the lid 9 (thus acting as a tie rod) and pushes downwards the inner container 3 during the closing of the lid 9 (thus acting as a strut). The reinforcement panel 22 of the connection tab (not illustrated in FIG. 22 for simplicity), if present, overlaps and is glued to the upper panel 21 to reinforce and stiffen the upper panel 21 itself. Alternatively, the reinforcement panel 22 of the connection tab 19 can be glued to the upper wall 11 of the lid 9.

Figure 23:
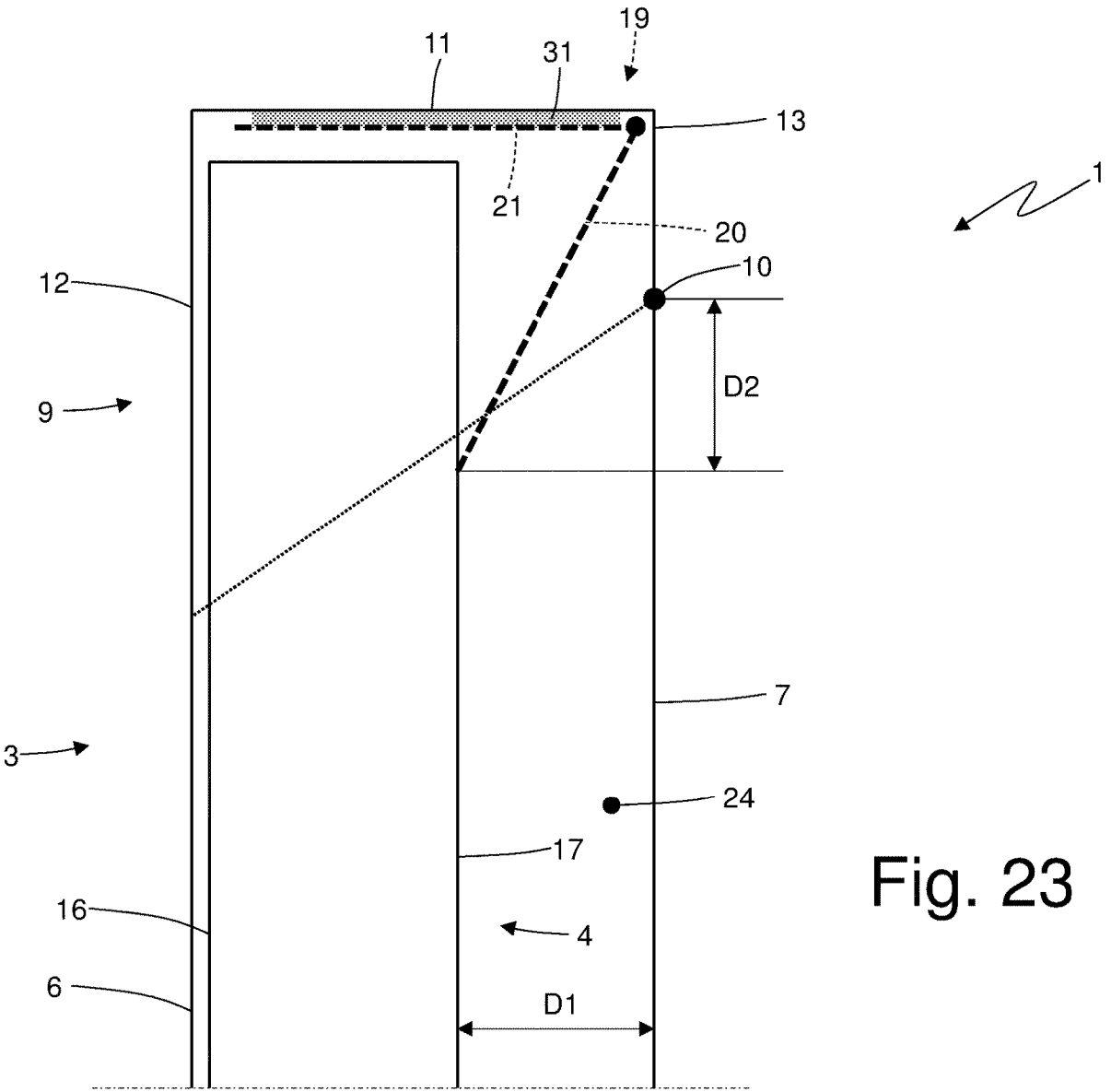
FIG. 23 is a schematic side view for an alternative of the cigarette package of FIGS. 1 and 12 in a closed configuration.

In FIG. 23 an alternative arrangement of the connection tab (which does not change the movement of the inner container 3) is illustrated; in this embodiment, the lower panel 20 of the connection tab 19 is arranged from the bottom towards the top and originates from the rear wall 17 of the inner container 3, whereas the upper panel 21 of the connection tab 19 is glued to the upper wall 11 of the lid 9 by means of glue 31. When the lid 9 is in the closed position (illustrated in FIG. 23), the two panels 20 and 21 of the connection tab 19 form between each other an acute angle. The panel 20 of the connection tab 19 (i.e. the connecting rod) pulls the inner container 3 upwards during the opening of the lid 9 (thus acting as a tie rod) and pushes the inner container 3 downwards during the closing of the lid 9 (thus acting as a strut). Also in this embodiment, the inner container 3 slides longitudinally relative to the outer container 4 to lift relative to the outer container 4 when the lid 9 is opened.

Note that in this embodiment, the distance D2 (which, as previously mentioned, must be shorter than the distance D1, and determines the maximum lifting of the inner container 3) is the distance between the projection on the rear wall 7 of the outer container 4 of the fixing point of the lower panel 20 of the connection tab 19, to the rear wall 17 of the inner container 3 and the hinge 10 of the lid 9.

Figure 24:
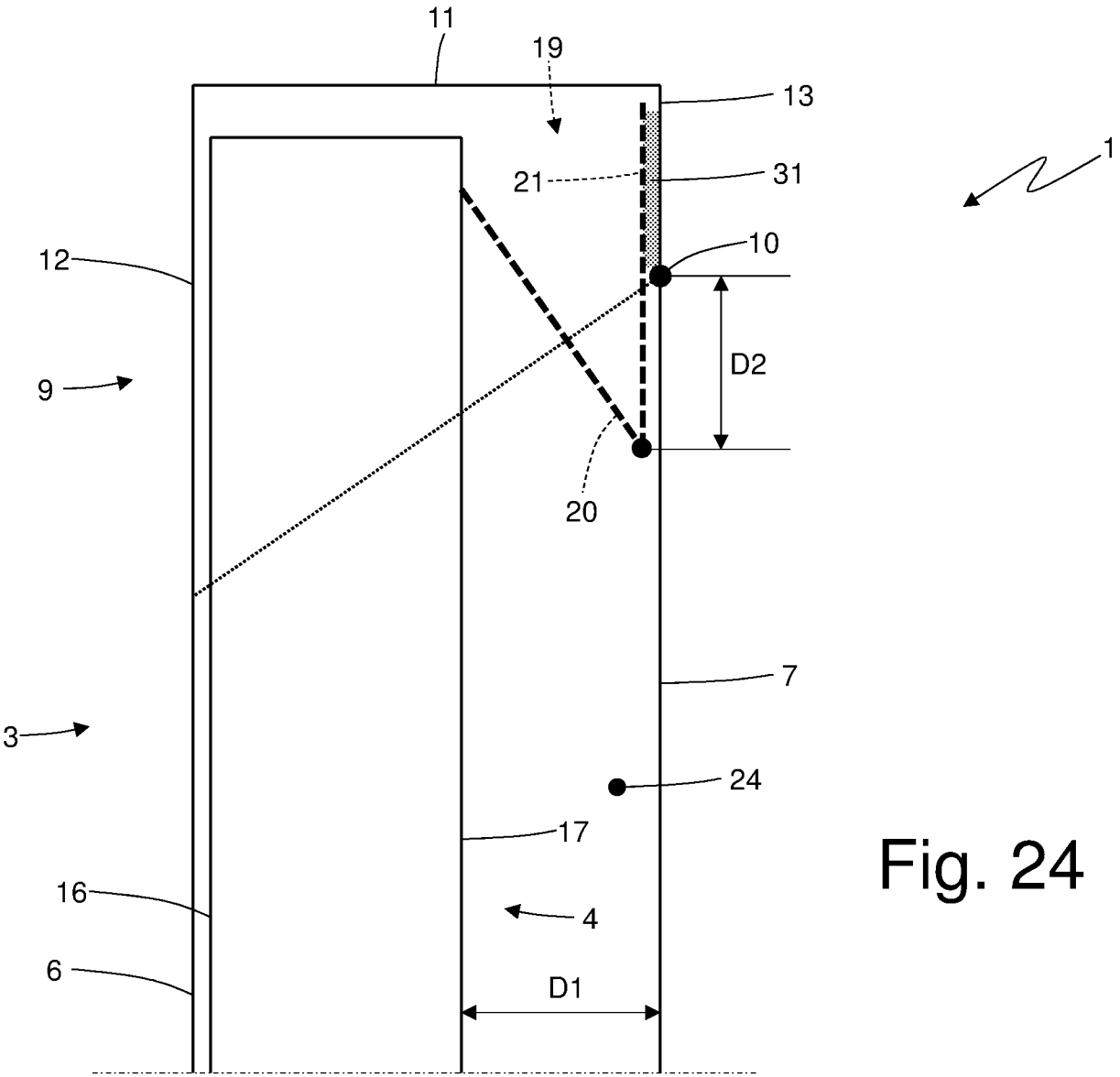
FIG. 24 is a schematic side view of another alternative of the cigarette package of FIGS. 1 and 12 in a closed configuration.

In FIG. 24 a further alternative of the arrangement of the connection tab 19 (which does not change the movement of the inner container 3) is illustrated; in this embodiment, the lower panel 20 of the connection tab 19 is arranged from the top towards the bottom and originates from the rear wall 17 of the inner container 3, whereas the upper panel 21 of the connection tab 19 is glued to the rear wall 13 of the lid 9 by means of the glue 31. When the lid 9 is in the closed position (illustrated in FIG. 24), the two panels 20 and 21 of the connection tab 19 form between them an acute angle. The panel 20 of the connection tab 19 (i.e. the connecting rod) pushes upwards the inner container 3 during the opening of the lid 9 (thus acting as a strut) and pulls downwards the inner container 3 during the closing of the lid 9 (thus acting as a tie rod). Also in this embodiment, the inner container 3 slides longitudinally relative to the outer container 4 to lift relative to the outer container 4 itself when the lid 9 is opened. Note that in this embodiment the distance D2 (which, as previously mentioned, must be shorter than the distance D1, and determines the maximum lifting of the inner container 3) is still the distance between the hinge 30 which connects the lower panel 20 to the upper panel 21 and the hinge 10 of the lid 9.

According to a different embodiment not illustrated, the outer container 4 can be provided with a collar which is glued to the inside of the outer container 4, and projects from the open upper end of the outer container 4, and it embraces (i.e. contains) the inner container 3 to guide the sliding of the inner container 3 itself; in this embodiment, the inner container 3 is devoid of the extensions 25 of the side walls as the function of the extensions 25 themselves is performed by the collar.

According to a further embodiment not illustrated, the cigarette package 1 comprises a stop device, which makes up an end-of-stroke for the upward movement of the inner container 3 and therefore locks the upward movement of the inner container (consequently also locking the rotation movement of the lid 9). For example, the stopping device comprises a first tab integral to the inner container 3 and protruding upwards and a second tab which is integral to the outer container 4, and is protruding downwards as it is coupled with the first tab during the rising movement of the inner container 3 until stopping the upward movement itself.

Figure 26:
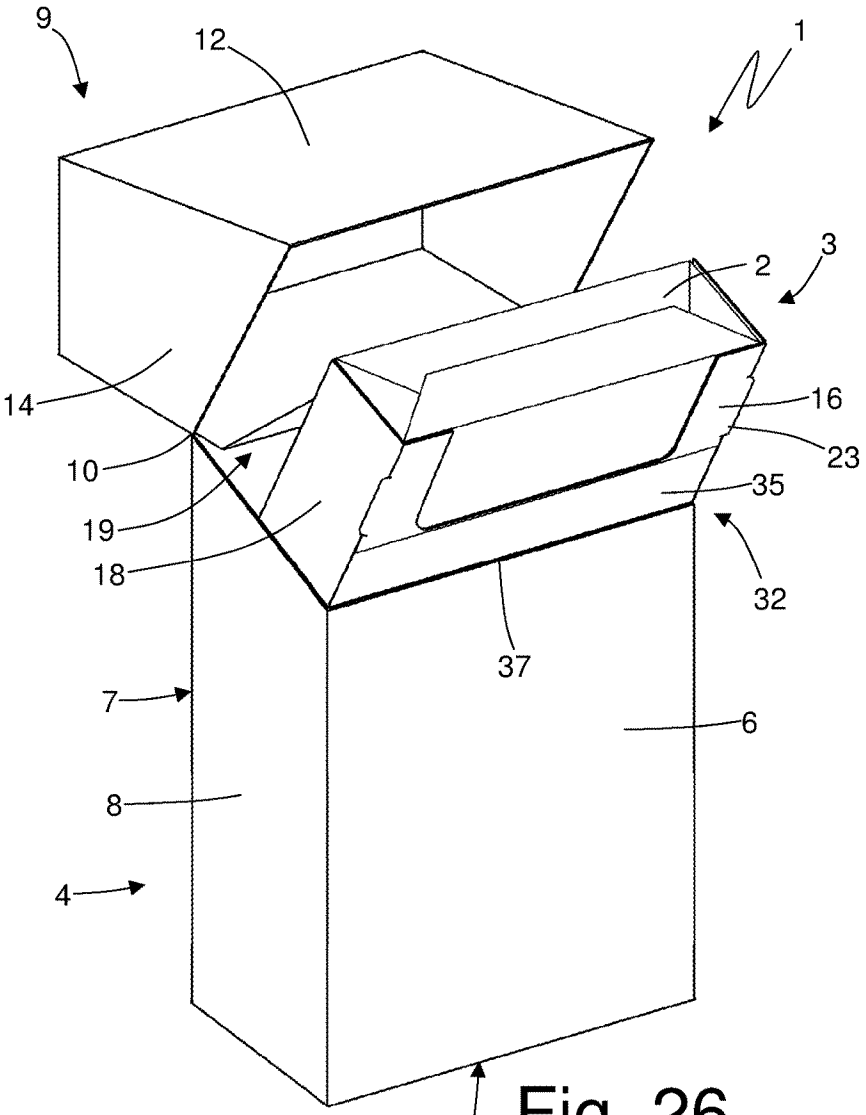
FIG. 26 is a front perspective view of the cigarette package of FIG. 25 in an open configuration.
Figure 25:
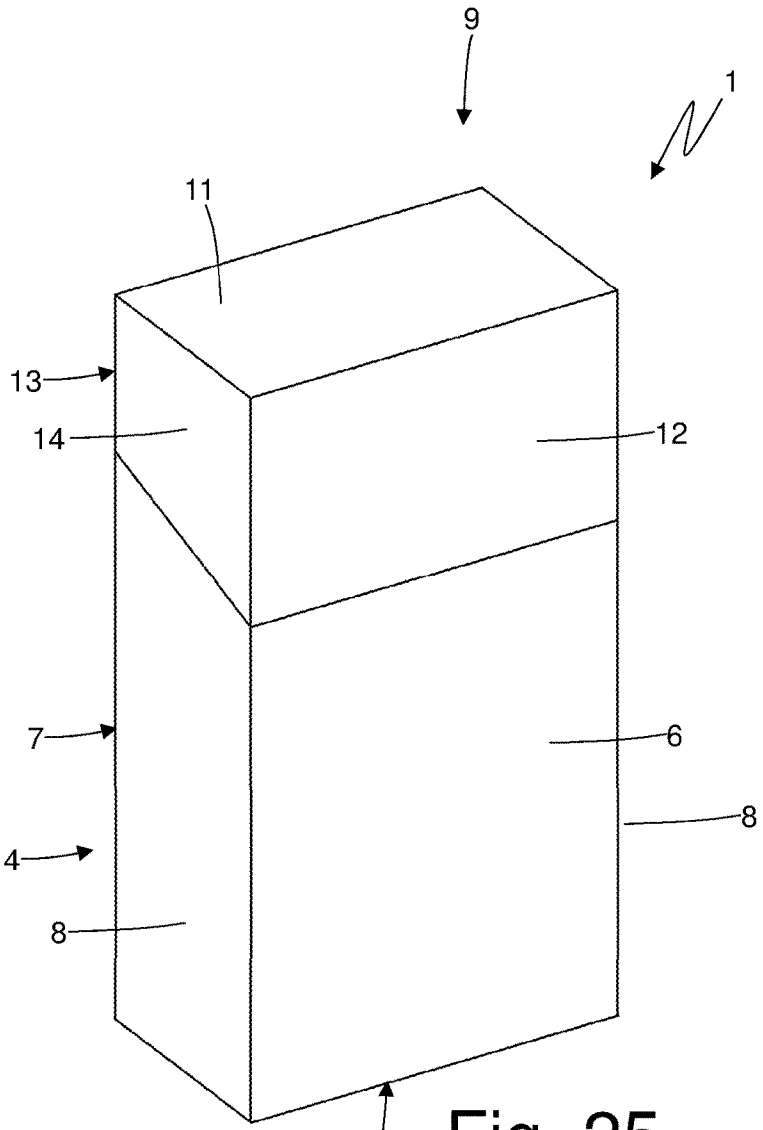
FIG. 25 is a front perspective view of a further rigid cigarette package in a closed configuration made according to the present invention.

In FIGS. 25-29 a different embodiment of the cigarette package 1 is illustrated wherein the inner container 3 moves with a rotation movement relative to the outer container 4 when the lid 9 is opened/closed. In other words, in the embodiments illustrated in FIGS. 1-24, the inner container 3 moves with a pure translational movement relative to the outer container 4 whereas according to the embodiments illustrated in FIGS. 25-29, the inner container 3 moves with a rotation movement (FIGS. 25-28) or with a roto-translational movement (FIG. 29) relative to the outer container 4 when the lid 9 is opened/closed. As illustrated in FIGS. 25 and 26, it is evident that the opening of the lid 9 determines a forward rotation of the inner container 3.

Figure 27:
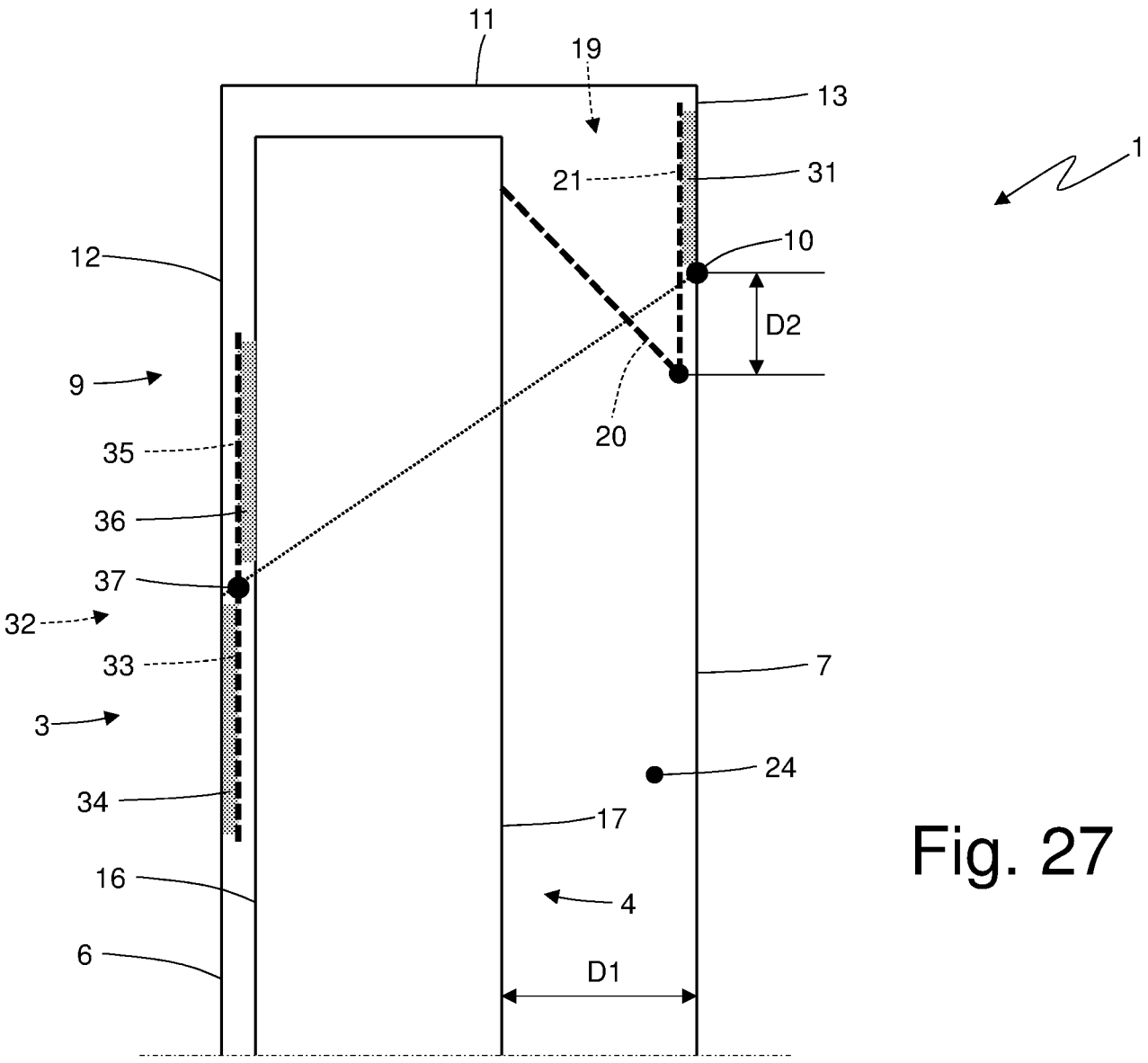
FIG. 27 is a schematic side view of the cigarette package of FIG. 25 in a closed configuration.
Figure 28:
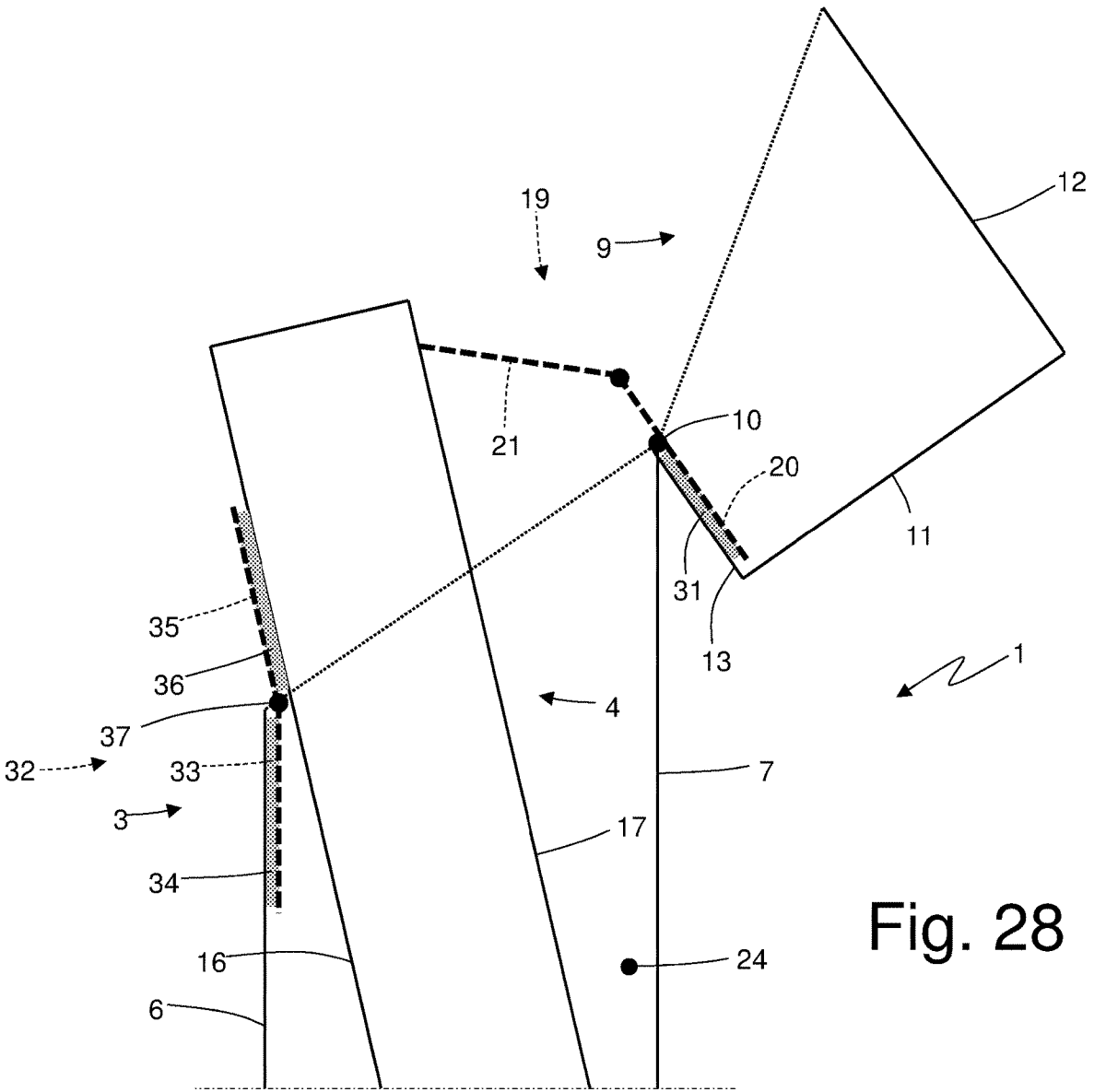
FIG. 28 is a schematic side view of the cigarette package of FIG. 25 in an open configuration.

As illustrated in FIGS. 27 and 28, the connection tab 19 is totally similar to the connection tab 19 illustrated in FIG. 24 (obviously with different dimensional ratios); also in this embodiment, the distance D2 between the hinge 30 that connects the lower panel 20 the upper panel 21 and the hinge 10 of the lid 9 must be shorter than the distance D1 between the rear wall 17 of the inner container 3 and the rear wall 7 of the outer container 4. Furthermore, a collar 32 is provided, which is glued to the inside of the outer container 4, projects from the open upper end of the outer container 4, and has only a front wall (i.e. is devoid of the side walls). As illustrated in FIGS. 27 and 28, the collar 32 has a lower panel 33 that is glued to the inside of the front wall 6 of the outer container 4 by means of the glue 34, and an upper panel 35 that is glued to the inside of the front wall 16 of the inner container 3 by means of the glue 36. The two panels 33 and 35 of the collar 32 are hinged to each other by means of a hinge 37 which is arranged at the upper edge of the front wall 6 of the outer container 4. In this embodiment, the function of the collar 32 is solely to guide the rotation of the inner container 3 relative to the outer container 4 when the lid 9 is opened/closed.

Figure 29:
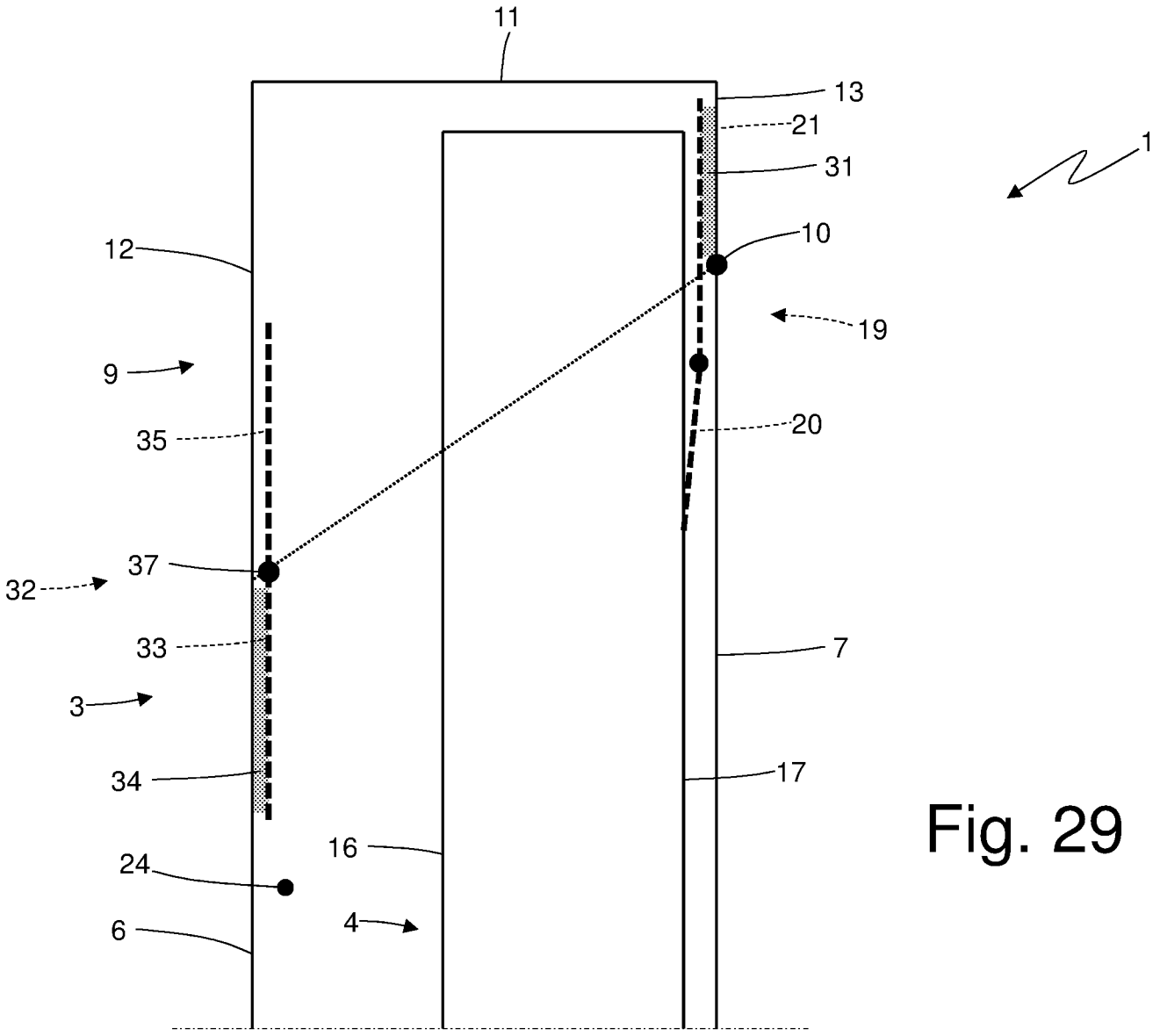
FIG. 29 is a schematic side view of an alternative of the cigarette package of FIG. 25 in a closed configuration.
Figure 30:
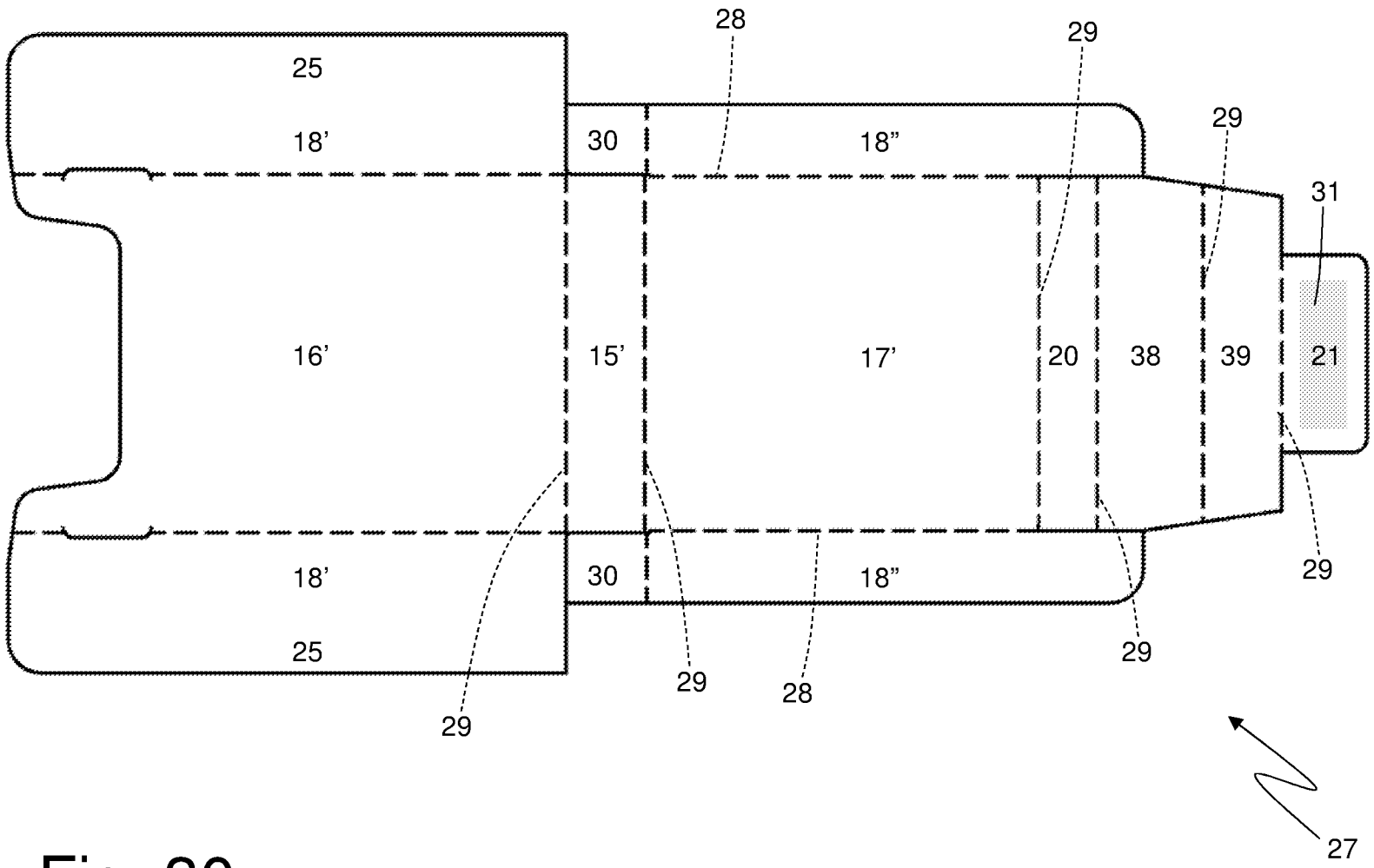
FIG. 30 is a developed flat view of a blank used for an alternative of an inner container of a further cigarette package made according to the present invention.
Figure 33:
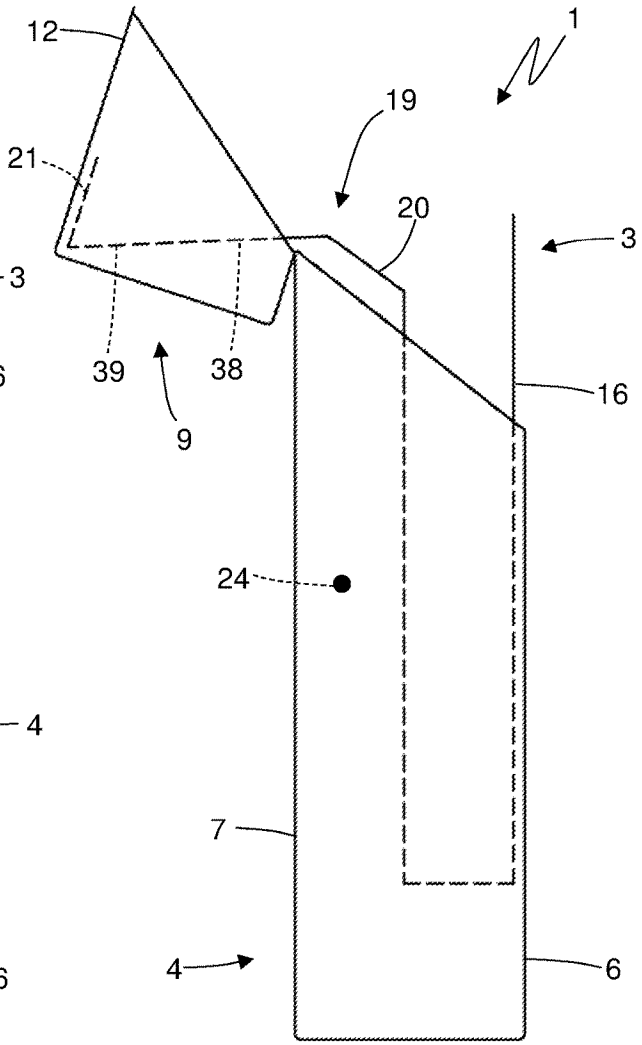
FIGS. 31, 32 and 33 are three different side views, with a closed configuration, a partially open configuration, and a fully open configuration, respectively, of a cigarette package provided with an inner container made by using the blank of FIG. 30.
Figure 32:
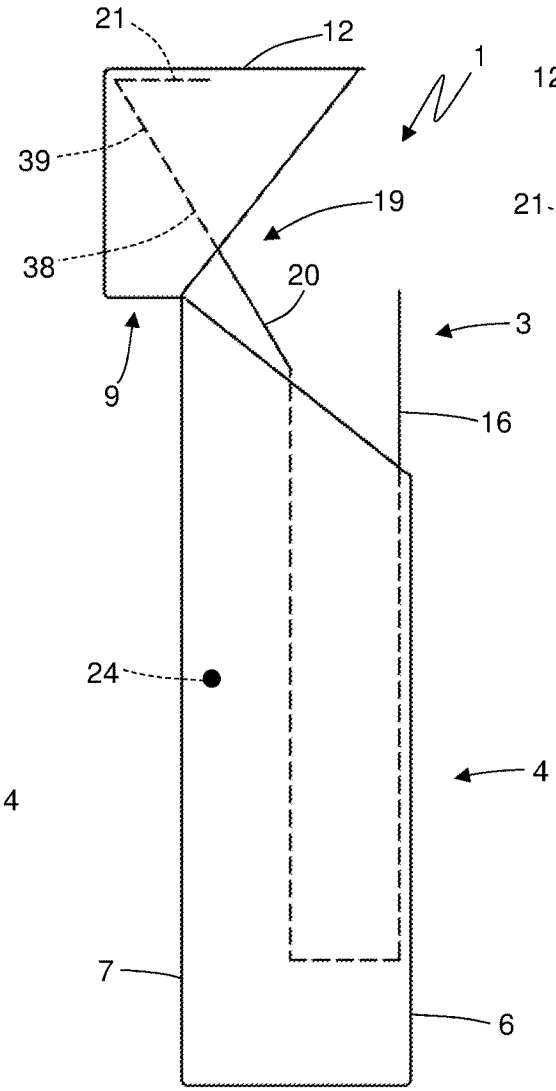

In FIG. 29 an alternative of the cigarette package 1 is illustrated showing the rotation of the inner container 3 relative to the outer container 4: in this embodiment, the inner container 3 performs a roto-translation movement relative to the outer container 4 when the lid 9 is opened/closed, i.e. when the lid 9 is opened, the inner container 3 rotates forwards and lifts relative to the outer container 4 (the movement is reversed when the lid 9 is closed). The connection tab 19 is totally similar to the connection tab 19 illustrated in FIG. 22 (obviously with different dimensional ratios), whereas the upper panel 35 of the collar 32 is not glued to the front wall 16 of the inner container 3. In this embodiment, the function of the collar 32 is both to guide the rotation of the inner container 3 relative to the outer container 4 when the lid 9 is opened/closed, and to keep the lid 9 in the closed position.

In the embodiments illustrated in FIGS. 1-28, the chamber 24 houses the connection tab 19 and is arranged at the rear, i.e. it is arranged behind the inner container 3 and is delimited by two side walls 8 of the outer container 4, by the rear wall 7 of the outer container 4 and by the rear wall 17 of the inner container 3; instead, in the embodiment illustrated in FIG. 29, the chamber 24 does not house the connection tab 19 and is arranged at the front, i.e. it is arranged in front of the inner container 3 and is delimited by the two side walls 8 of the outer container 4, by the front wall 6 of the outer container 4 and by the front wall 16 of inner container 3. In other words, in the embodiments illustrated in FIGS. 1-24 the chamber 24 has the solely function of housing the tab 19 allowing the connection tab 19 to have the necessary space to change its configuration during movement of the lid 9; in the embodiment illustrated in FIGS. 25-28, the chamber 24 has both the function of housing the connection tab 19 allowing the connection tab 19 to have the necessary space to change its configuration during movement of the lid 9 and the function of allowing the inner container 3 to tilt (rotate) relative to the outer container 4 and inside the outer container 4 itself; and finally in the embodiment illustrated in FIG. 29, the chamber 24 has only the function of allowing the inner container 3 to tilt (rotate) relative to the outer container 4 and inside the outer container 4 itself. Namely, in the embodiments illustrated in FIGS. 24-29, the chamber has the function of allowing the inner container 3 to rotate (and thus to tilt) relative to the outer container 4 (a function that is instead entirely absent in the embodiments illustrated in FIGS. 1-24).

According to a further embodiment not illustrated, the connection tab 19 instead of being rigid (that is, instead of being formed by rigid panels 20, 21 and 22 hinged to each other) is flexible and therefore entirely free to deform without constraints; for example, the connection tab 19 could present a certain (high) number of transverse weakening lines close to each other giving a high flexibility to the connection tab 19 itself. This embodiment has the advantage of requiring a smaller chamber 24 due to the (large) deformation capacity of the connection tab 19, but on the contrary has the drawback of controlling only in an automatic way the lifting of the inner container 3 (i.e. by opening the lid 9 the inner container 3 it is lifted automatically by using the movement of the lid 9, whereas by closing the lid 9 the inner container 3 is not lowered automatically by using the movement of the lid 9 but must be pushed down manually independently of the movement of the lid 9). Said limit is due to the fact that a flexible connection tab 19 is able to pull (i.e. to act as tie rod), but is not able to push (i.e. to act as a strut).

According to a possible embodiment not illustrated, a locking device is provided, which has the double function of helping to keep the lid 9 in the closed position and to generate a sound when the lid 9 comes to the closed position (and possibly also when the lid 9 leaves the closed position to move toward the open position). Said sound is presented as a "click" and is generally appreciated by users since it is perceived as they had achieved a particularly effective and stable closed position. By way of example, this locking device may comprise a locking tab that protrudes outwardly from the front wall 16 of the inner container 3 (and folded by about 180° onto the same front wall 16) and a locking pocket that is formed on the inside of the front wall 12 of the lid 9 and is suited to receive the locking tab on the inside thereof: the locking tab when entering and exiting from the locking pocket must be elastically deformed with elastic return snapping movements, which determine the generation of a sound.

In the embodiments illustrated in FIGS. 1-28, the chamber 24 houses the connection tab 19 and is arranged at the rear, i.e. arranged behind the inner container 3 and is delimited by the two side walls 8 of the outer container 4, by the rear wall 7 of the outer container 4 and by the rear wall 17 of the inner container 3; in the embodiment illustrated in FIG. 29, the chamber 24 does not house the connection tab 19 and is arranged at the front, i.e. it is arranged in front of the inner container 3 and is delimited by the two side walls 8 of the outer container 4, by the front wall 6 of the outer container 4 and by the front wall 16 of the inner container 3. According to a different embodiment not illustrated, the chamber 24 houses the connection tab 19 and is arranged laterally, i.e. it is arranged next to the inner container 3 and is delimited by a side wall 8 of the outer container 4, by a side wall 18 of the inner container 3, by the front wall 6 of the outer container 4 and by the rear wall 7 of the outer container 4.

Figure 31:
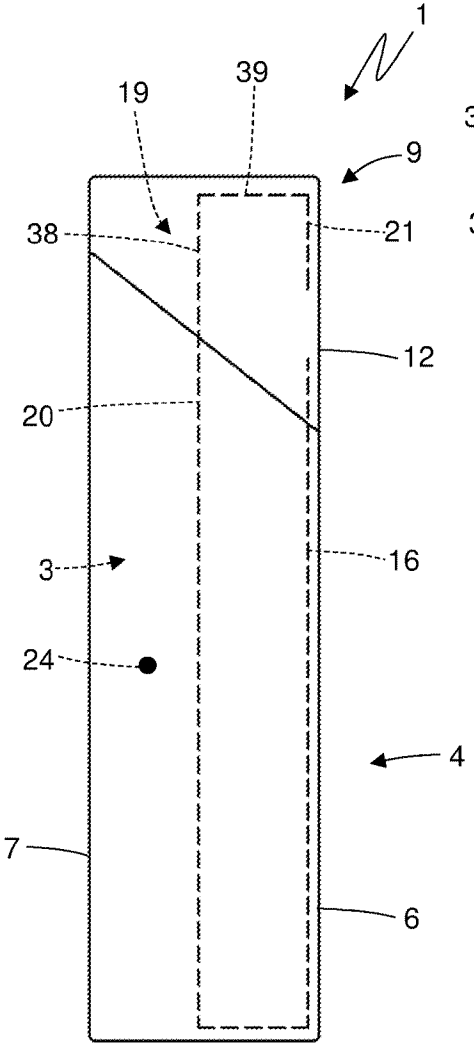
Figure 34:
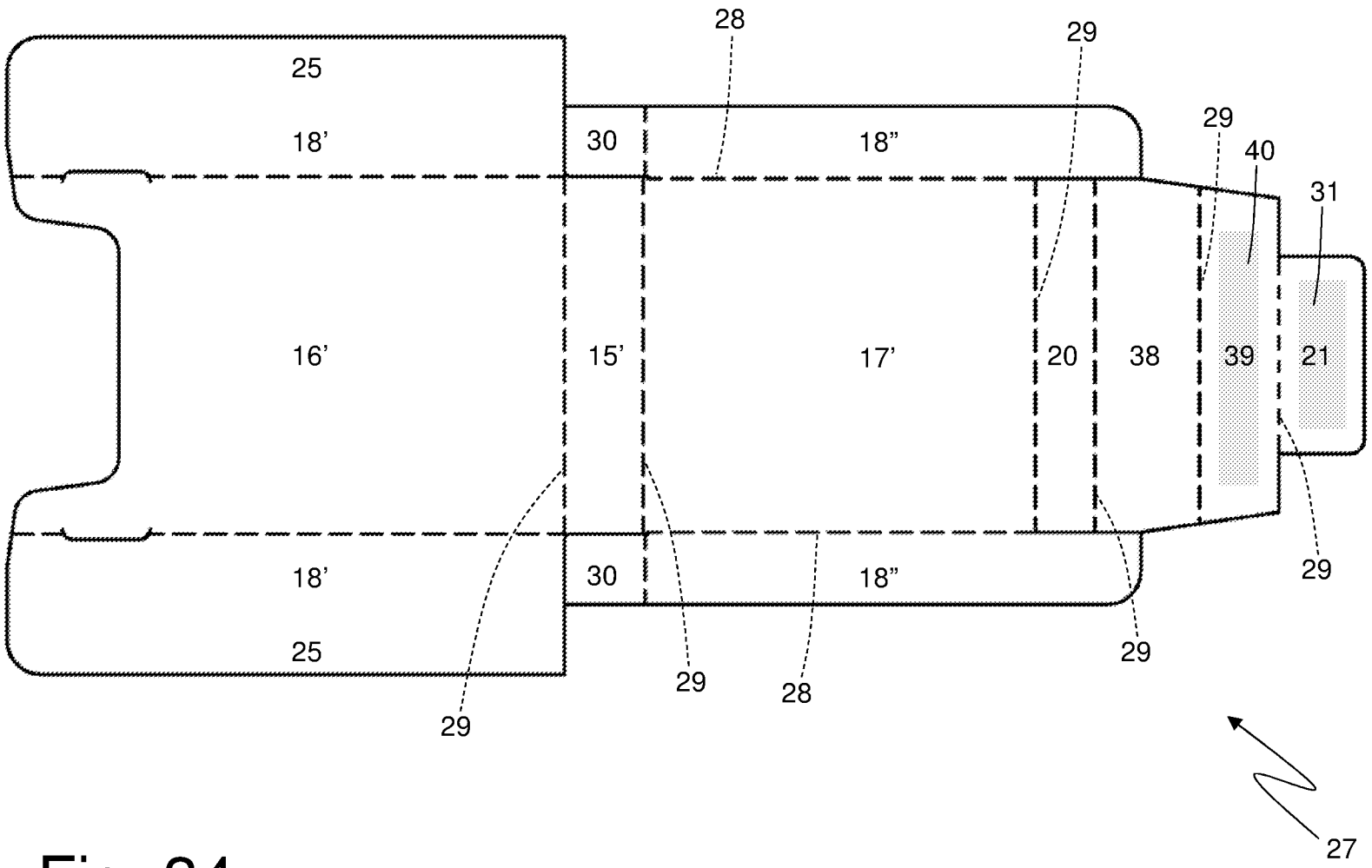
FIG. 34 is a developed flat view of an alternative of the blank of FIG. 30.
Figure 37:
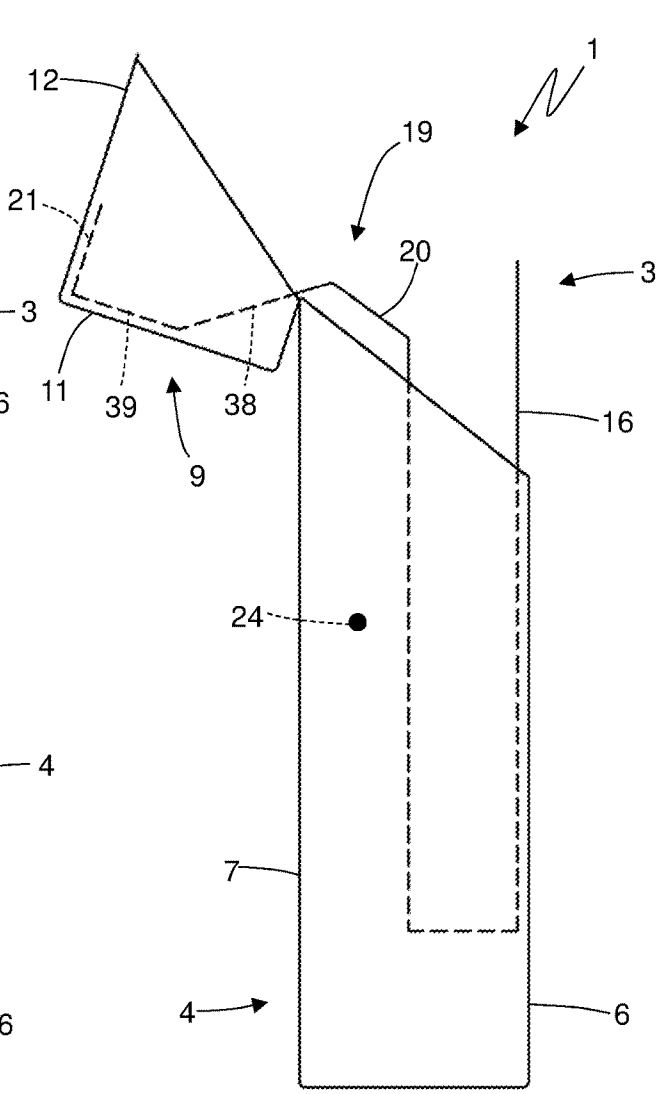
FIGS. 35, 36 and 37 are three different respective side views, with a closed configuration, a partially open configuration, and a fully open configuration, of a cigarette package provided with an inner container made by using the blank of FIG. 34.
Figure 36:
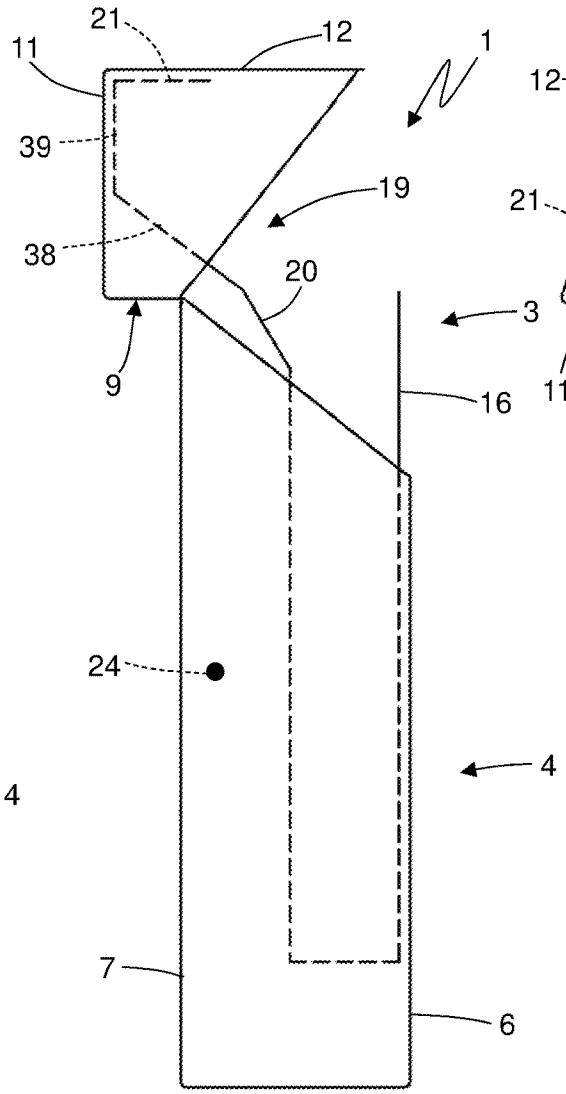
Figure 35:
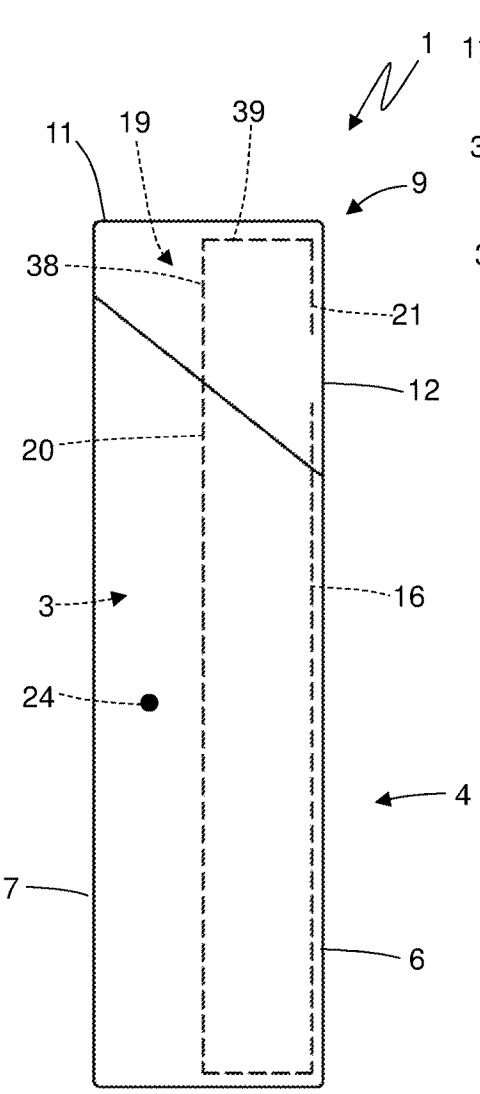

In the embodiments illustrated in FIGS. 30-33, the upper panel 21 of the connection tab 19 is glued to the front wall 12 of the lid 9 by means of the glue 31 (illustrated in FIG. 30), the reinforcement panel 22 is not present, and between the lower panel 20 and the upper panel 21 two intermediate panels 38 and 39 are interposed; the intermediate panel 38 is hinged along respective transverse folding lines 29 to the lower panel 20 and to the intermediate panel 39, whereas the intermediate panel 39 is hinged along respective transverse folding lines 29 to the intermediate panel 38 and to the upper panel 21. As illustrated in FIG. 31, when the lid 9 is closed, the connection tab 19 assumes a "U" shape by folding around the group 2 of cigarettes; instead, when the lid 9 is opened by rotating around the hinge 10, the connection tab 19 is deformed thus pulling upwards the inner container 3.

One of the main advantages of gluing the upper panel 21 of the connection tab 19 to the front wall 12 of the lid 9 by means of the glue 31 is that, during the folding of the blank 26 (illustrated in FIG. 10) with which the outer container 4 and the lid 9 are made, the front wall 12 of the lid 9 (i.e. the panel 12' of the blank 26) can be effectively pressed against the underlying group 2 of cigarettes (which is in close contact with the front wall 12 of the lid 9) with the interposition of the upper panel 21 thus allowing an optimum adhesion to be obtained (that is, strong and safe and substantially always without adhesion imperfections) between the upper panel 21 of the connection tab 19 and the front wall of the lid 9. In other words, during the folding of the blank 26, the upper panel 21 of the connection tab 19 is located between the underlying group 2 of cigarettes and the front wall 12 of the lid 9, and therefore it is possible to obtain adequate contact pressure between the upper panel 21 and the front wall 12 thanks to the effective contrasting action of the group 2 of cigarettes.

In FIGS. 34-37 an alternative of the cigarette package 1 illustrated in FIGS. 30-33 is illustrated with the only difference that the intermediate panel 39 of the connection tab 19 is glued to the upper wall 11 of the lid 9; therefore, in this embodiment, the upper panel 21 of the connection tab 19 is glued to the front wall 12 of the lid 9 and, at the same time, also the intermediate panel 39 of the connection tab 19 is glued to the upper wall 11 of the lid 9.

Figure 38:
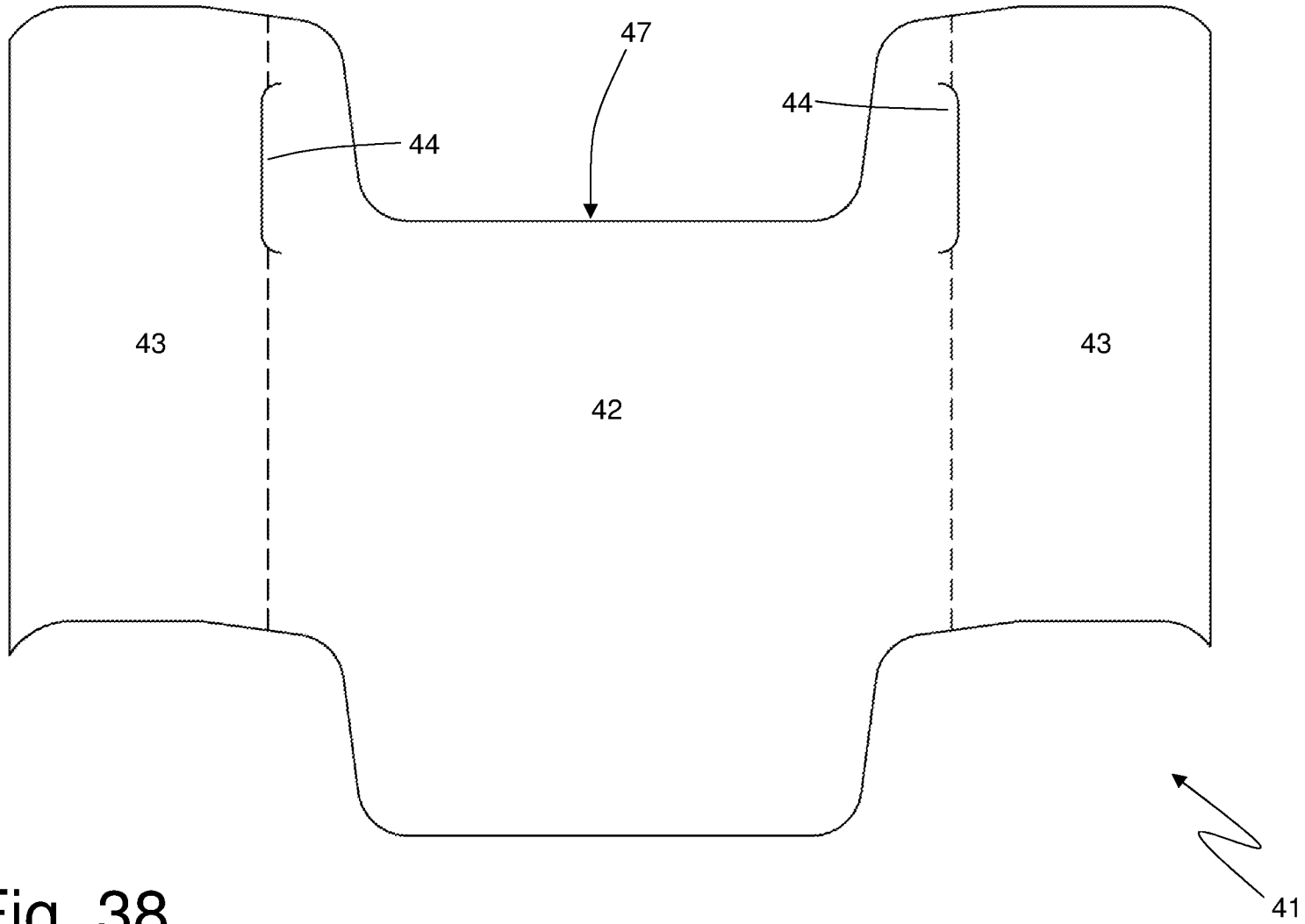
FIG. 38 is a developed flat view of a collar used for a further cigarette package made according to the present invention.

In the embodiments illustrated in FIGS. 1-37, the inner container 3 also performs a "collar" type function i.e. keeps the lid 9 in the closed position with a sufficient force to prevent unwanted openings of the lid 9 itself (to make the "collar" type function more efficient, the front wall 16 of the inner container 3 can be provided with a pair of claws 23). In the alternative embodiments illustrated in FIGS. 38-49, the inner container 3 does not also perform a "collar" type function and the cigarette package 1 comprises a collar 41 (illustrated in FIG. 38), which is normally connected (by gluing) to the outer container 4 to project partly outside the open upper end of the outer container 4 and engage a corresponding inner surface of the lid 9 when the lid 9 itself is arranged in the closed position.

The collar 41 has, in cross section, a "U" shape and comprises a front wall 42 which is supported and glued to the front wall of the outer container 4 and two side walls 43, each of which rests against and is glued to, a corresponding side wall 8 of the outer container 4. The front wall 42 of the collar 41 has, at the top, a recess 47 which is arranged outside of the open upper end of the outer container 4 (i.e. is located completely in the part of the front wall 42 which juts out from the open upper end of the outer container 4) and is "U"-shaped. According to a preferred embodiment illustrated in FIG. 38, the front wall 42 of the collar 41 is provided with a pair of claws 44 which laterally project, so as to engage with interference the lid 5, when lid 5 is in the closed position, so as to keep the lid 5 in the closed position with greater force. According to a different embodiment not illustrated, the front wall 42 of the collar 41 is devoid of the claws 44.

Figure 39:
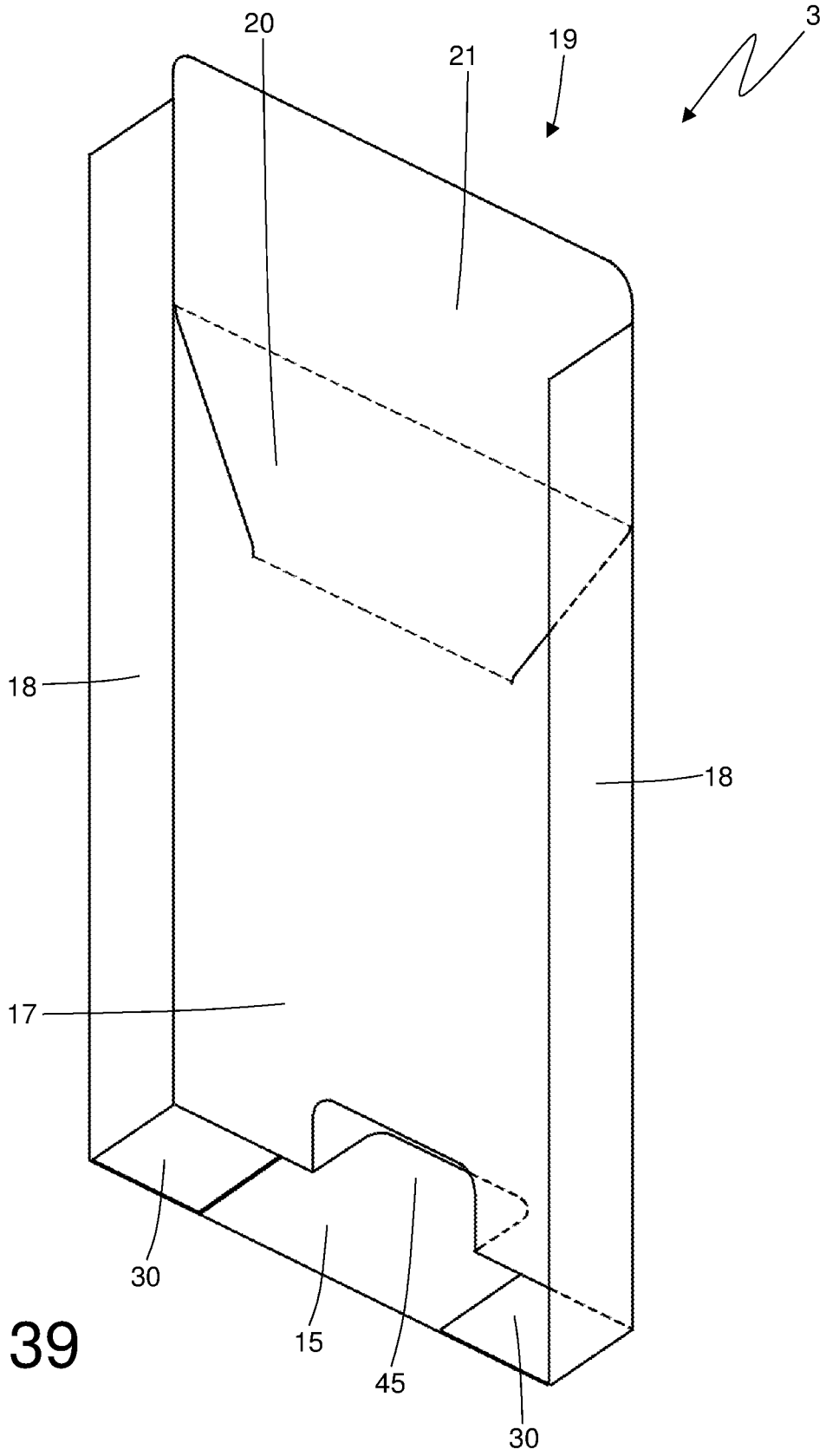
FIG. 39 is a front perspective view of an inner container of a cigarette package made by using the collar of FIG. 38.
Figure 40:
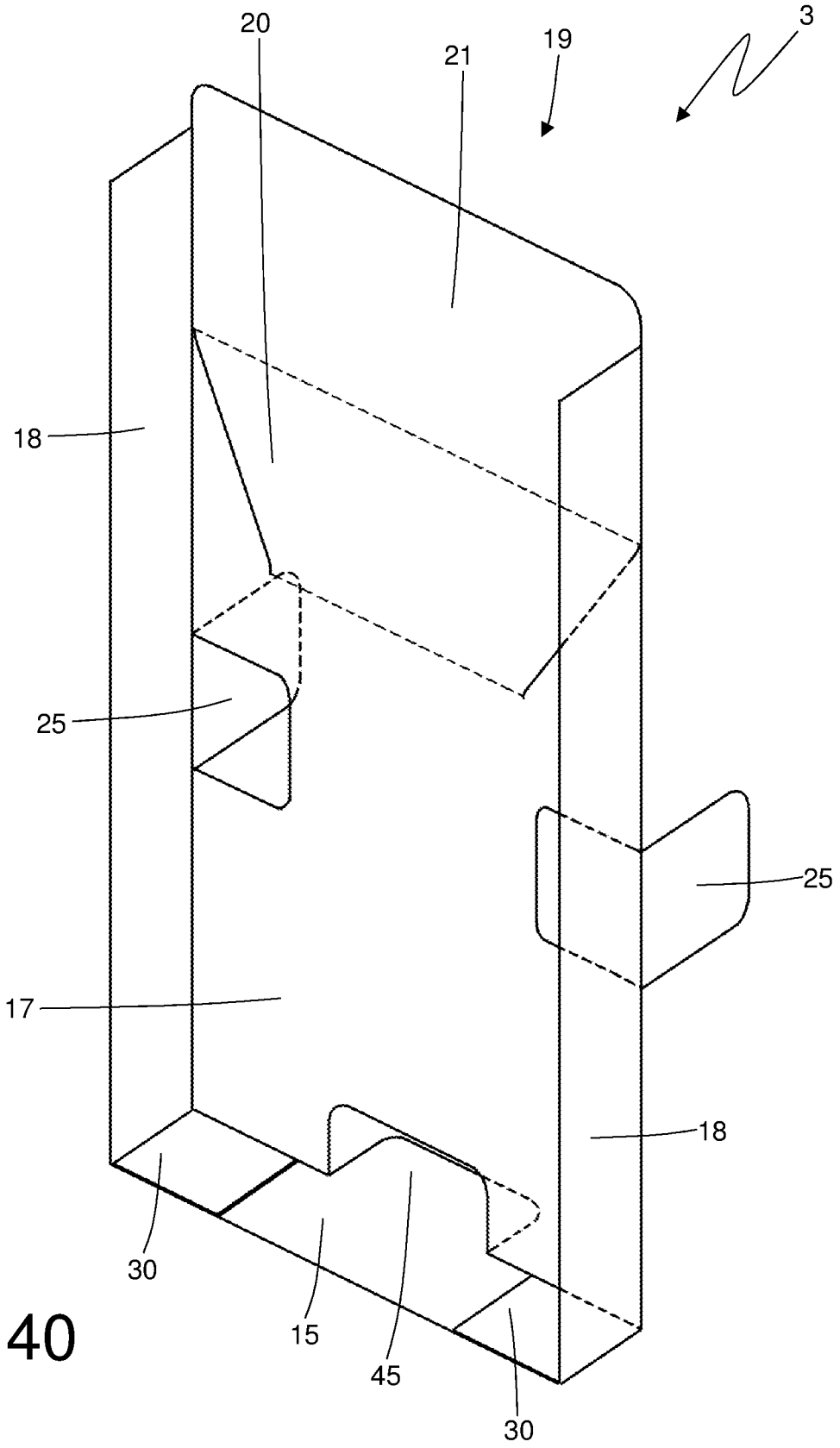
FIG. 40 is a front perspective view of an alternative of the inner container of FIG. 39.

In the embodiments illustrated in FIGS. 39 and 40, the inner container 3 is devoid of the front wall 16, i.e. it comprises only the rear wall 17 (from which the connection tab 19 originates), the lower wall 15 and the two side walls 18. In the embodiment illustrated in FIG. 39, the lower wall 15 of the inner container 3 has an extension 45 (equal to the extensions 25 previously described), which is coplanar to the lower wall 15 and extends outside of the inner container 3 until touching the rear wall 7 of the outer container 4; as a whole, considering the extension of the lower wall 15 and of the corresponding extension 45, the inner container 3 has the same transverse size of the side walls 8 of the outer container 4 so that the inner container 3 cannot perform transverse movements inside the outer container 4. The extension 45 makes up a local lengthening of the lower wall 15 and is formed with a corresponding "U"-shaped cut on the panel 17' (which makes up the rear wall 17 of the inner container 3).

Figure 41:
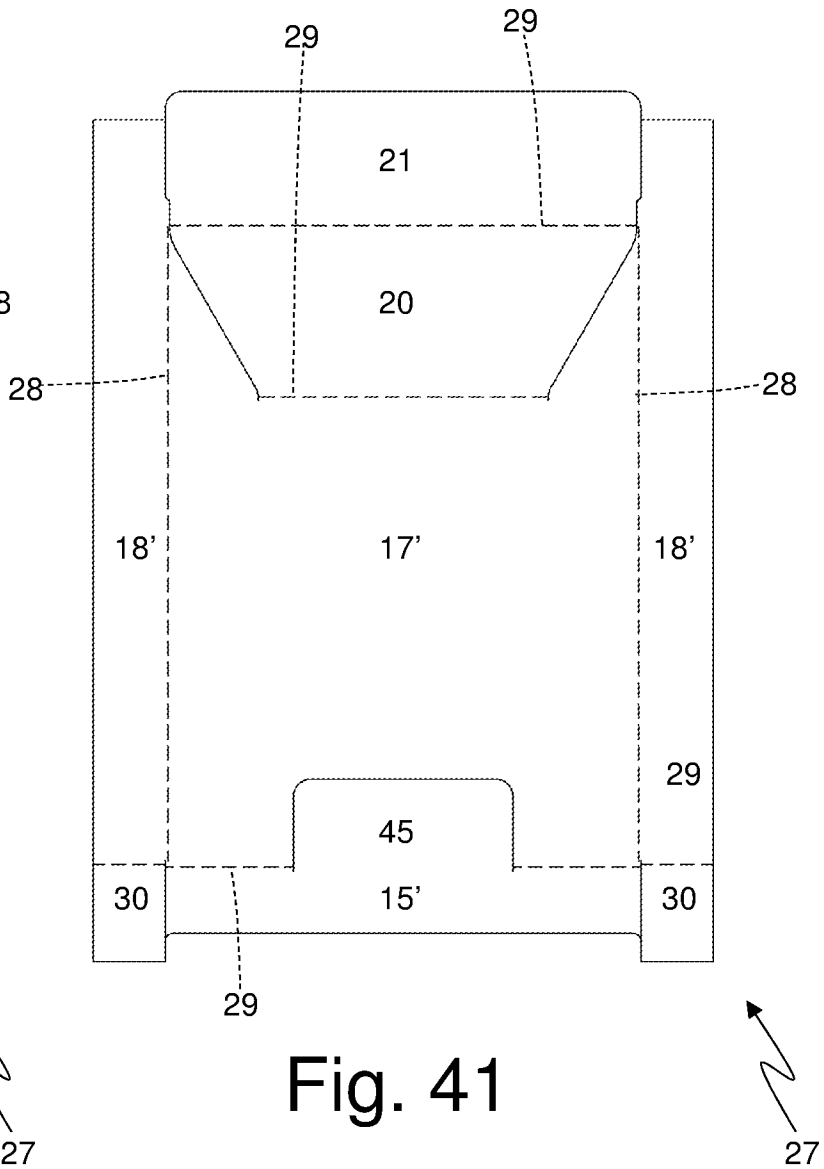
FIG. 41 is a developed flat view of a blank used to make the inner container of FIG. 39.
Figure 42:
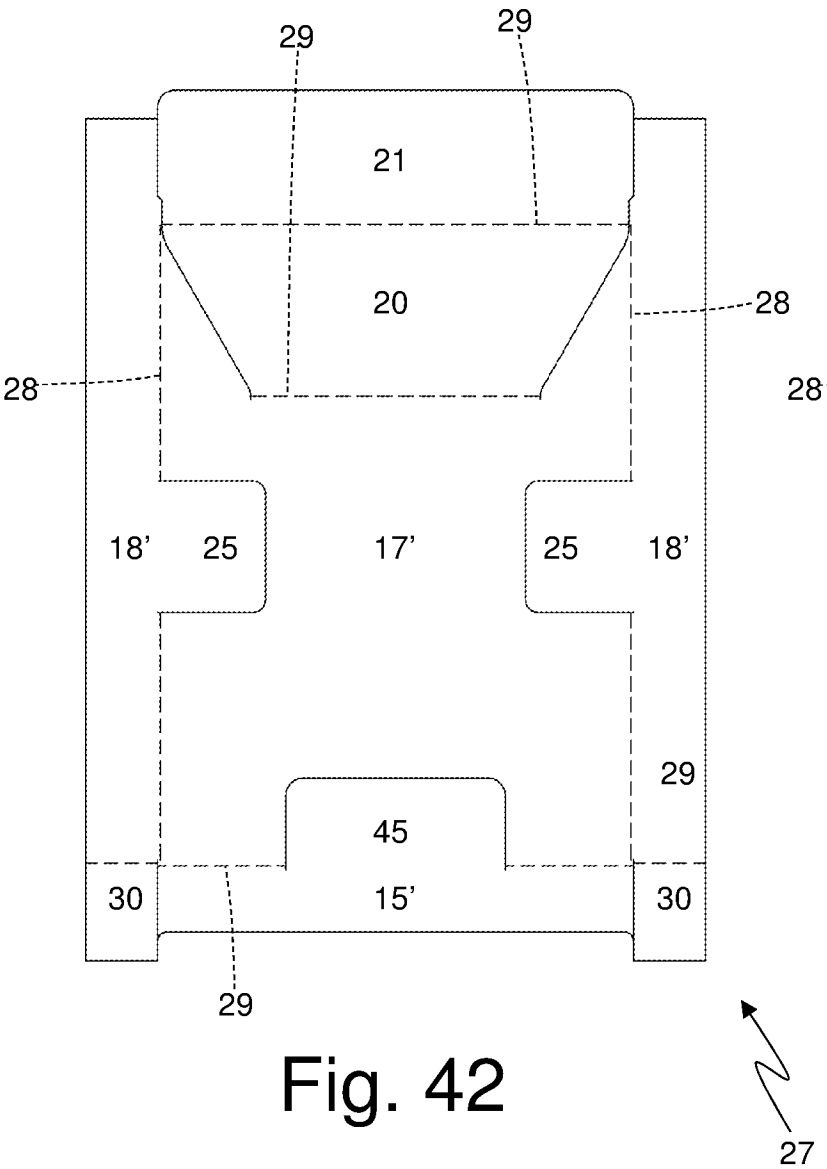
FIG. 42 is a developed flat view of a blank used to make the inner container of FIG. 40.

Therefore, the inner container 3 is free to longitudinally slide relative to the outer container 4, but cannot perform any transverse movement relative to (inside) the outer container 4. In other words, the extension 45 of the lower wall 15 of the inner container 3 has the guiding function as it prevents transverse movements of the inner container 3 relative to (inside) the outer container 4. In the embodiment illustrated in FIG. 40, to the extension 45 of the lower wall 15 the two extensions 25, 18 of the side walls (completely identical to the extensions 25 previously described) are added. In FIG. 41 the blank 27 used to make the inner container 3 illustrated in FIG. 39 is illustrated, whereas in FIG. 42 the blank 27 used to make the inner container 3 illustrated in FIG. 40 is illustrated. Note the extreme compactness of the blanks 27 illustrated in FIGS. 41 and 42 which allows said blanks to be folded inside a single standard packing machine (obviously with some modifications) that subsequently also folds the collar 41 and the blank 26.

Figure 43:
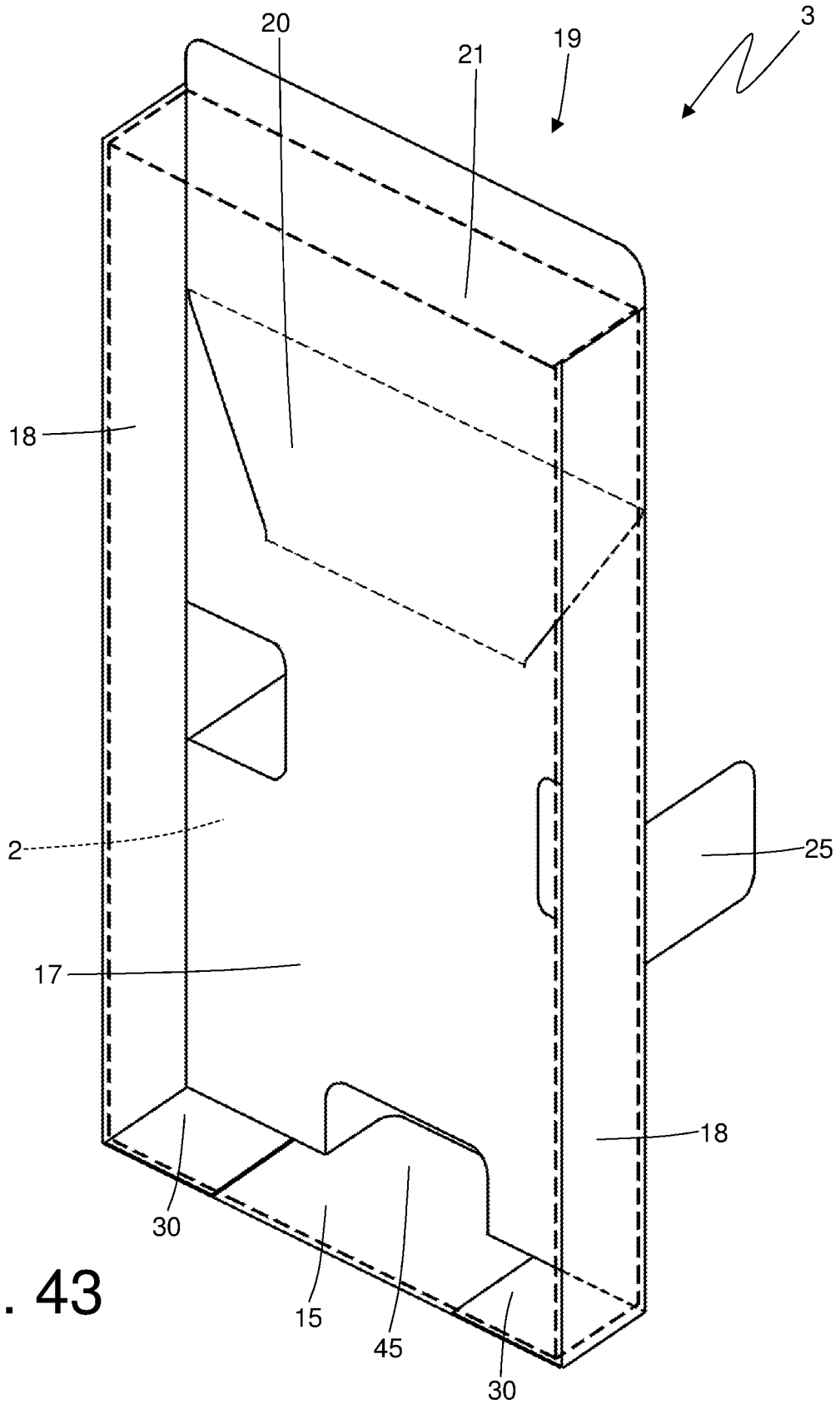
FIGS. 43 and 44 are respective perspective views of the inner container of FIG. 39 coupled in different ways to a group of cigarettes.
Figure 44:
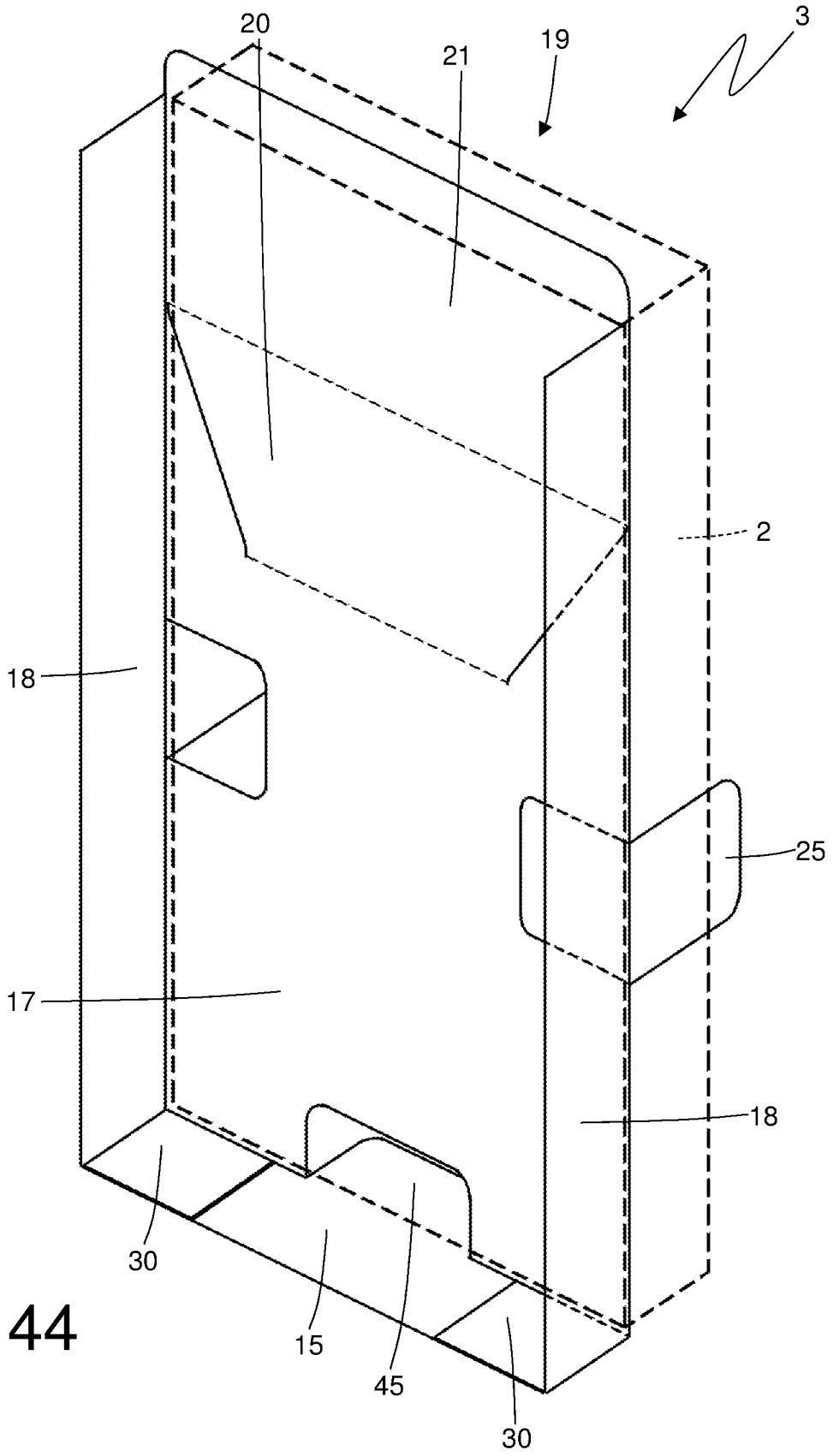

It is important to note that the inner container 3 illustrated in FIGS. 39 and 40 can be coupled to the group 2 of cigarettes in two different ways, i.e. by placing the group 2 of cigarettes "at the front" i.e. by resting the group 2 of cigarettes against the lower wall 15 of the inner container 3 (as illustrated in FIG. 43), or by placing the group 2 of cigarettes "at the rear" i.e. by resting the group 2 of cigarettes against the extension 45 of the lower wall 15 of the inner container 3 (as illustrated in FIG. 44). In other words, the group 2 of cigarettes can be arranged "at the front" to be in contact with the lower wall 15 of the inner container 3 and laterally with the side walls 18 of the inner container 3 (as illustrated in FIG. 43), or the group 2 of cigarettes can be arranged "at the rear" to be in contact, at the bottom, with the extension 45 of the lower wall 15 of the inner container 3 and, if present, to be laterally in contact with the extensions 25 of the side walls 18 of the inner container 3 (as illustrated in FIG. 44). From the functional point of view the two ways for coupling the group 2 of cigarettes to the inner container 3 are equivalent.

Figure 45:
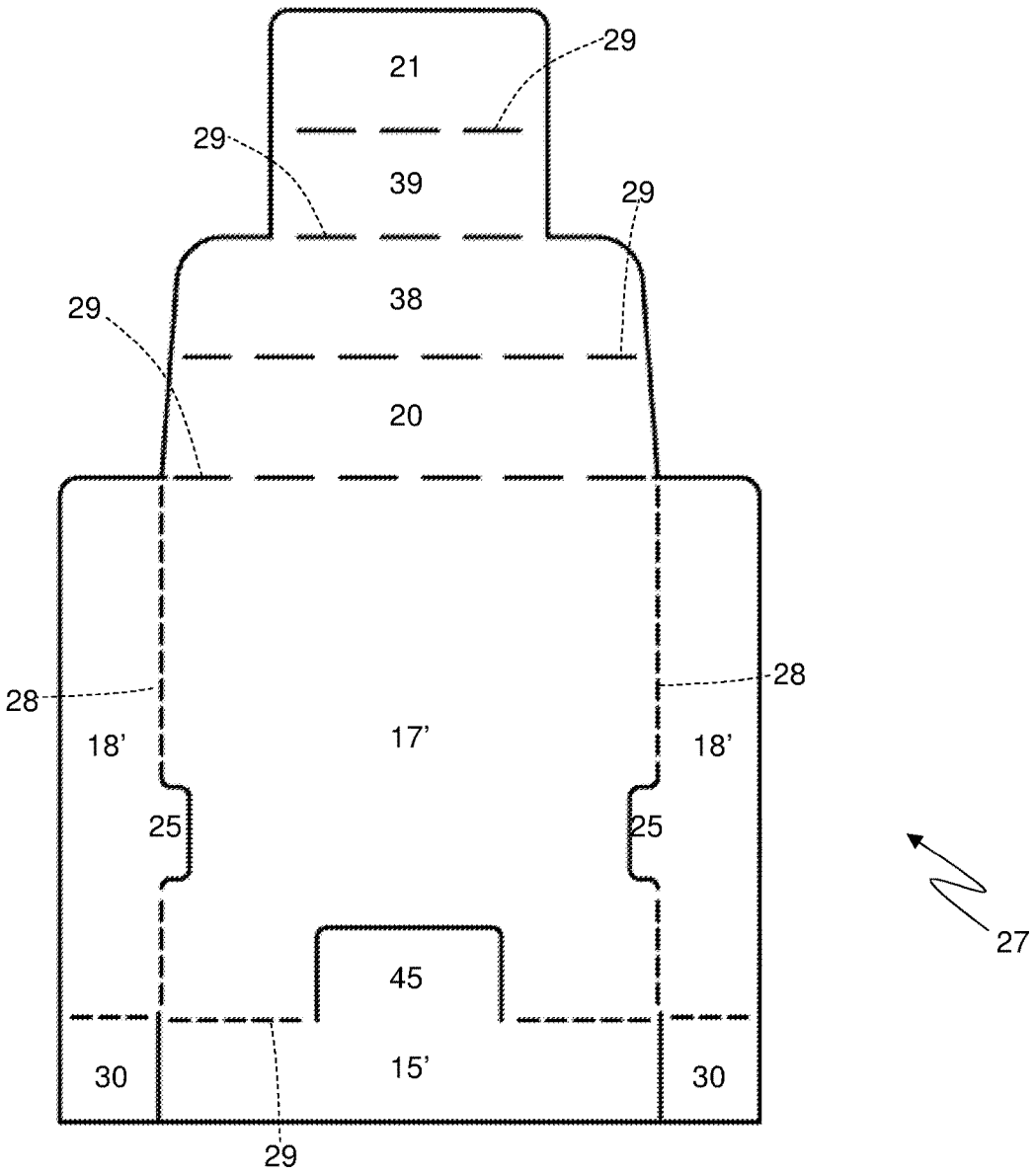
FIG. 45 is a developed flat view of a blank used to make an alternative inner container of FIG. 40.
Figure 47:
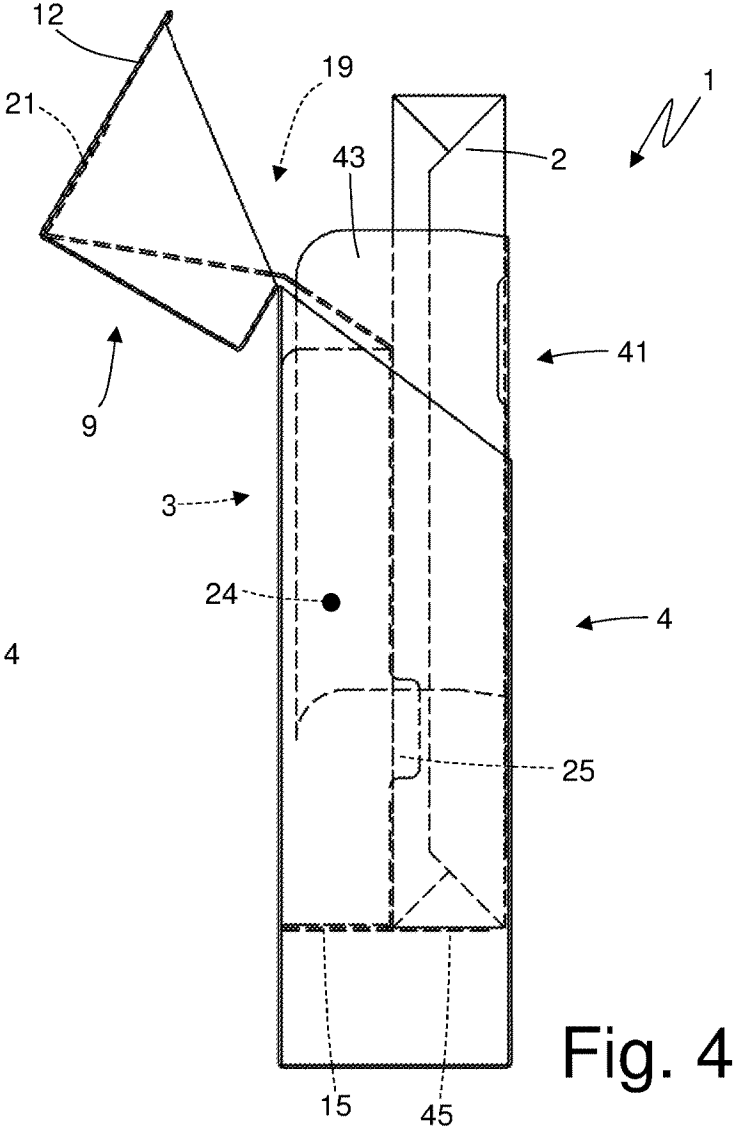
FIGS. 46 and 47 are two different respective side views, with a closed configuration and in a fully open configuration, of a cigarette package provided with an inner container made by using the blank of FIG. 45.
Figure 46:
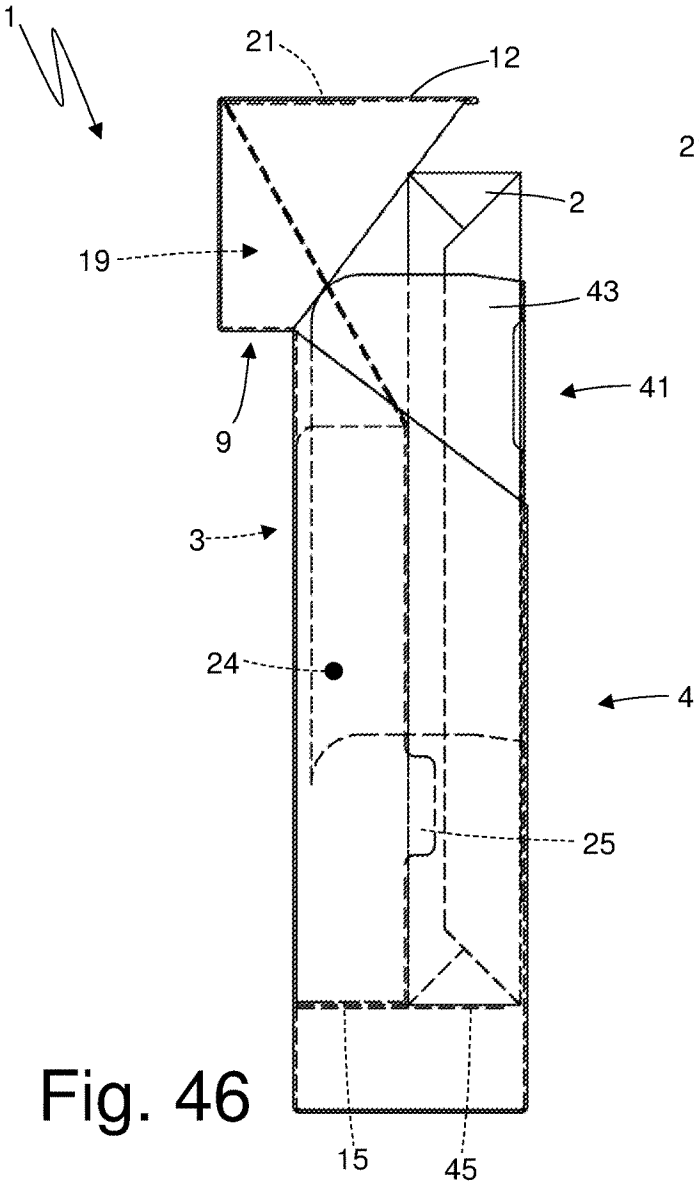
Figure 49:
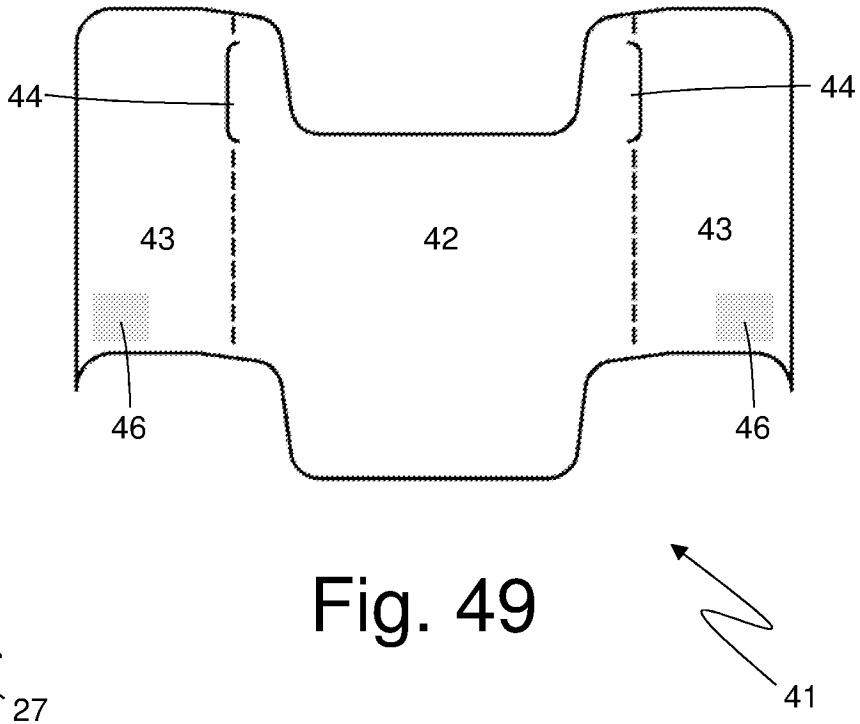
FIG. 49 is a developed flat view of a collar coupled to the blank of FIG. 48.
Figure 48:
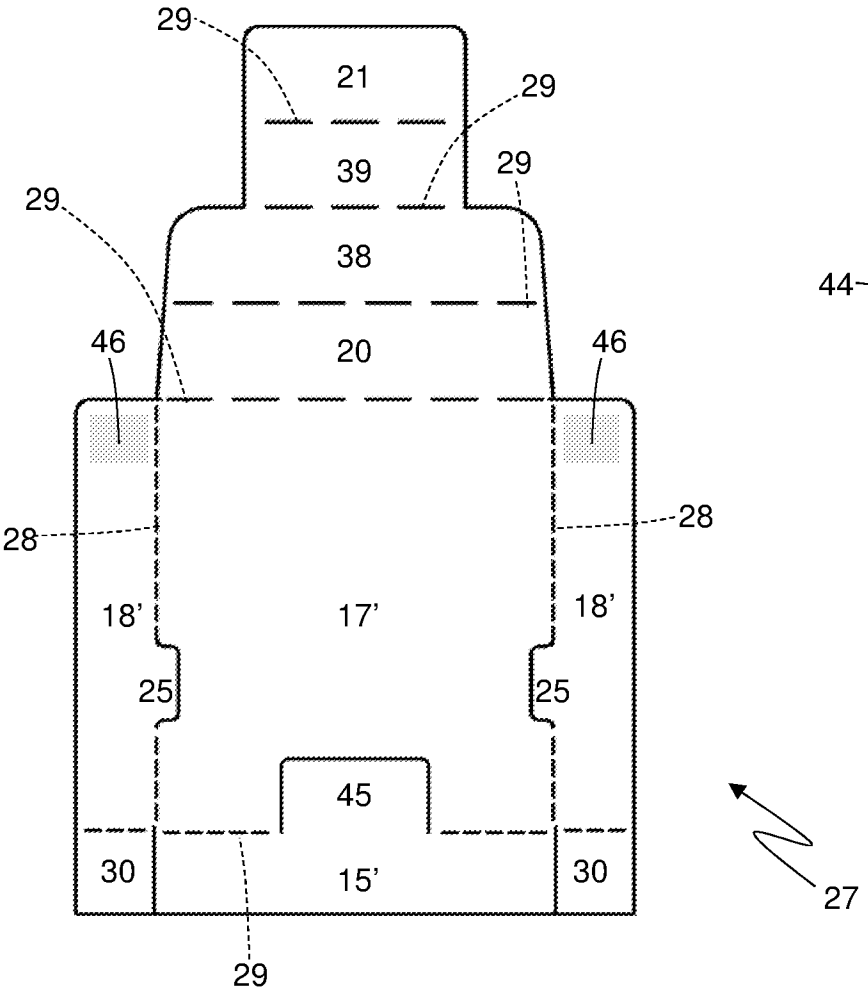
FIG. 48 is a developed flat view of a blank used to make an alternative of the inner container of FIG. 40.
Figure 51:
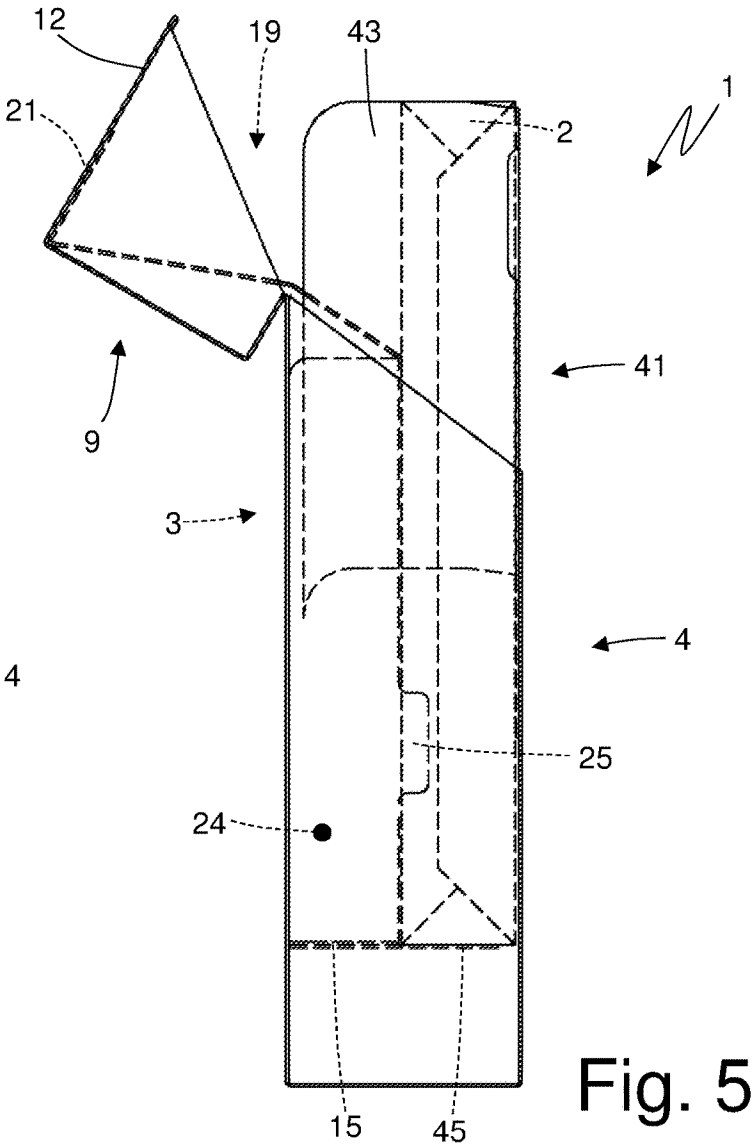
FIGS. 50 and 51 are two different respective side views, with a closed configuration and a fully open configuration, of a cigarette package provided with an inner container made by using the blank of FIG. 48 and the collar of FIG. 49.
Figure 50:
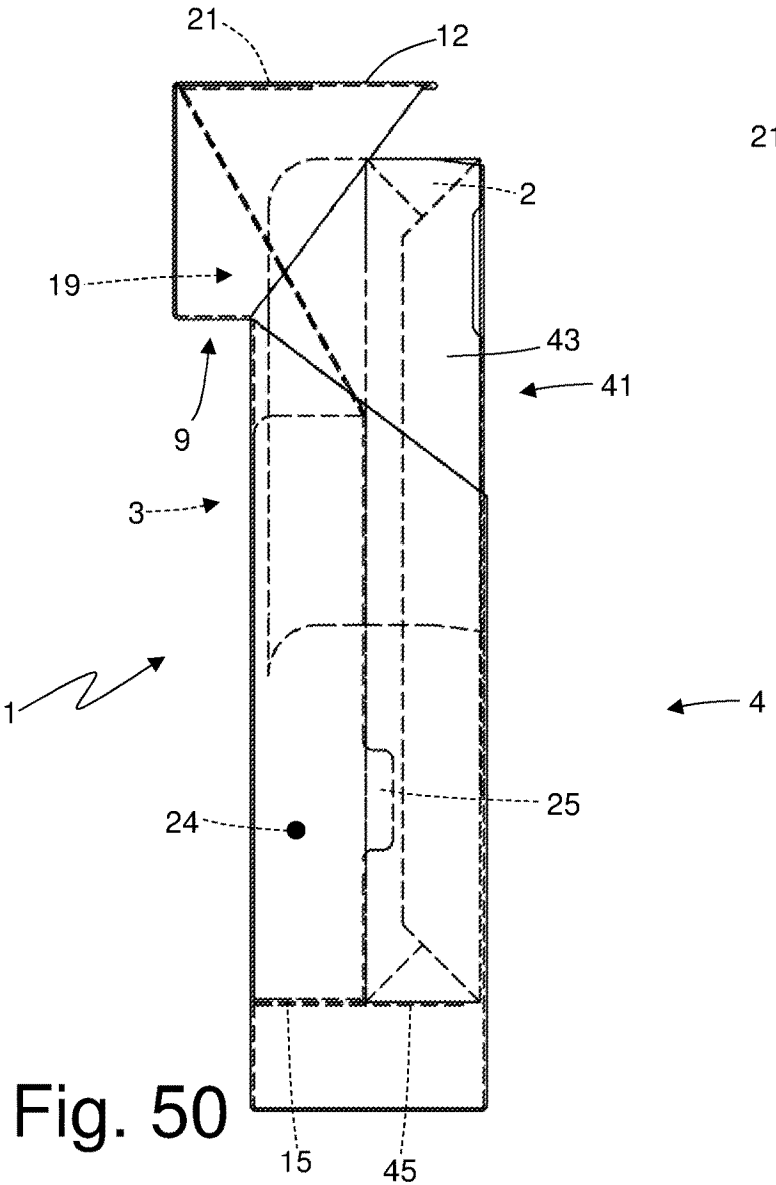

In FIGS. 45, 46 and 47 a different embodiment is illustrated which combines the inner container 3 illustrated in FIGS. 39-44 (i.e. devoid of the front wall 16) with the connection tab 19 illustrated in FIGS. 30-37 (i.e. provided with the intermediate panels 38 and 39, devoid of the reinforcement panel 22, and with the upper panel 21 glued to the front wall 12 of the lid 9). In the embodiment illustrated in FIGS. 45, 46 and 47 only the upper panel 21 of the connection tab 19 is glued to the front wall 12 of the lid 9; also according to an alternative the intermediate panel 39 of the connection tab 19 is glued to the upper wall 11 of the lid 9 (according to the embodiment illustrated in FIGS. 34-37).

In the embodiments illustrated in FIGS. 39-47, the collar 41 is glued to the outer container 4 (therefore is integral to the outer container 4) and, following the opening of the lid 9, the inner container 3 is lifted by sliding vertically relative to the outer container 4 and relative to the collar 41. In the embodiment illustrated in FIGS. 48-51, the collar 41 is not glued to the outer container 4 (i.e. it is completely independent and separate from the outer container 4) and is instead glued by means of the glue 46 (illustrated in FIGS. 48 and 49) to the inner container 3 to slide together vertically with the inner container 3 itself; in other words, when the inner container 3 is lifted, following the opening of the lid 9, the collar 41 moves as one piece with the inner container 3 itself. From another point of view, in this embodiment, the collar 41 becomes an integral part of the inner container 3 being glued to the inner container 3. Preferably, the glue 46 is interposed between the side walls of the inner container 3 and the side walls 43 of the collar 41.

According to a possible embodiment, when the collar 41 is integral (glued) to the outer container 4, and therefore, when the inner container 3 slides relative to the collar 41, a wall of the inner container 3 could show a print (which for example represents a graphic design, a logo and/or drawing) that is covered by the collar 41 when the lid 9 is in the closed position (i.e. when the inner container 3 is in the lowered position wherein the inner container 3 is fully inserted inside the outer container 4) and is visible when the lid 9 is in the open position (i.e. when the inner container 3 is in the extracted position wherein the inner container 3 is partially extracted from the outer container 4). As the lid 9 is being opened (i.e. as the inner container 3 is being moved from the lowered position to the extracted position), the print becomes progressively visible and vice versa. According to a possible embodiment, the print juts out from an upper edge of the collar 41 when the lid 9 is in the open position (i.e. when the inner container 3 is in the extracted position); alternatively, a wall of the collar 41 has a through-window through which the print is visible when the lid 9 is in the open position (i.e. when the inner container 3 is in the extracted position).

Preferably, the print is placed on the front wall 16 of the inner container 3 (obviously the inner container 3 must comprise the front wall 16), and therefore the print becomes visible as it passes the upper edge of the front wall 42 of the collar 41 or through a through-window formed through the front wall 42 of the collar 41; alternatively or in addition, the print can be placed on at least one side wall 18 of the inner container 3, and then the print becomes visible as it passes the upper edge of a corresponding side wall 43 of the collar 41, or through a through-window formed through the corresponding side wall 43 of the collar 41. In the embodiments illustrated in the attached figures, all the edges (longitudinal and transverse) are right angles; according to alternative and completely equivalent embodiments not illustrated part of the edges may be bevelled or rounded (for example, the front longitudinal edges of the two containers 3 and 4 may be bevelled or rounded).

In the attached figures numerous alternatives of the inner container 3 are described (with different conformations of the connection tab 19, with or without the front wall 16, with or without collar functions, and with or without an integral collar 41 . . . ); for possible obvious needs of brevity, all possible combinations to make the inner container 3 have not been explicitly described but, it is clear that each of the possible alternatives of the inner container 3 can be combined with all the other possible alternatives of the inner container 3. For example, the presence of the independent collar 41 (either glued to the outer container 4 or to the inner container 3) may be combined with each of the inner containers 3 illustrated in FIG. 1-24 or 30-37 (obviously when the collar 41 is provided the inner wrap 3 is devoid of the claws 23).

The cigarette package 1 described above has numerous advantages.

In the first place, the cigarette package 1 described above allows the group 2 of cigarettes to be lifted (and/or tilted) when the lid 9 is opened (facilitating the ease of extracting the cigarettes) with an extremely simple, effective and efficient mechanism (made up by the connection tab 19); in particular, during the rotation of the lid 9 the connection tab 19 is not subjected to any elastic deformation and therefore there is no negative interference with the rotation of the lid 9 itself. Namely in the cigarette package 1 described above the force that must be applied to achieve the rotation of the lid 9 is uniform and constant without the "peaks" of force that in other known cigarette packages are required to obtain an elastic deformation of a portion of the lifting mechanism of the group of cigarettes; therefore, in the cigarette package 1 described above, the handling of the lid 9 is extremely easy. Furthermore, in the cigarette package 1 described above, the handling of the lid 9 (i.e. the lifting of the group 2 of cigarettes) does not generate any type of mechanical stress on the group 2 of cigarettes and therefore does not cause any type of crushing or deformation of the cigarettes.

The cigarette package 1 described above is simple to produce even in an existing packing machine (that must be subjected to a few, but not too invasive, modifications). In fact, the outer container 4 and the lid 9 (therefore the corresponding flat blank 26) are completely identical to the outer container and the lid (therefore to the corresponding blank) of a standard type, rigid cigarette package with a hinged lid and the inner container 3 can be obtained by folding the blank 27 around the group 2 of cigarettes in the wrapping unit normally used for producing the collar with simple changes to the wrapping unit itself.

Finally, in the cigarette package 1 described above, the increase of wrapping material for producing the inner wrap 3 is lesser (when compared to the wrapping material required to produce the collar) resulting in a low impact on the expenses and environmental costs of production and waste (after the use) of the cigarette package 1.

As a result of the many advantages presented by the cigarette package 1 described above, the shape of such a cigarette package 1 may be integrally used also for producing a packet of other types of smoking articles (such as, for example, cigars, electronic cigarettes, charging cartridges for electronic cigarettes, pieces of tobacco for electronic cigarettes).

The invention claimed is:

1. A rigid package (1) for tobacco articles with a hinged lid comprising:

a group (2) of tobacco articles;

an inner container (3) which houses the group (2) of tobacco articles and comprises two side walls (18);

an outer container (4), which comprises an open upper end, a lower wall (5), a front wall (6), a rear wall (7), and two side walls (8), and houses the inner container (3) in a movable manner, so as to allow the inner container (3) to move relative to the outer container (4);

a lid (9), which has an upper wall (11), a front wall (12), two side walls (14), and a rear wall (13), which is hinged to the rear wall (7) of the outer container (4), so as to allow the lid (9) to rotate relative to the outer container (4); and a moving mechanism, which moves the inner container (3) relative to the outer container (4) using the rotation movement of the lid (9) and comprises a connection tab (19), which connects a wall (17) of the inner container (3) to the front wall (12) of the lid (9);

the cigarette package (1) is characterized in that:

the rigid connection tab (19) is attached to the front wall (12) of the lid (9);

the inner container (3) is smaller than the outer container (4), so as to define, on the inside of the outer container (4), a chamber (24) that borders the inner container (3); and the two side walls (18) of the inner container (3) having respective extensions (25), which are coplanar to the side walls (18) thereof and extend on the outside of the inner container (3) until they touch the rear wall (7) or the front wall (6) of the outer container (4).

2. The package (1) for tobacco articles according to claim 1, wherein the connection tab (19) comprises:

an upper panel (21), which is integral to the front wall (12) of the lid (9); and a lower panel (20) which it is hinged to a rear wall (17) of the inner container (3).

3. The package (1) for tobacco articles according to claim 2, wherein the connection tab (19) comprises:

the upper panel (21), which is integral to the front wall (12) of the lid (9);

a first intermediate panel (39), which is hinged to the upper panel (21);

a second intermediate panel (38), which is hinged to the first intermediate panel (39); and a lower panel (20) which, on one side, is hinged to the rear wall (17) of the inner container (3) and on the opposite side is hinged to the second intermediate panel (38).

4. The package (1) for tobacco articles according to claim 3, wherein the first intermediate panel (39) is glued to an upper wall (11) of the lid (9).

5. The package (1) for tobacco articles according to claim 2, wherein the connection tab (19) comprises a reinforcement panel (22), which overlaps and is glued to the upper panel (21).

6. The package (1) for tobacco articles according to claim 1, wherein the chamber (24) is arranged behind the inner container (3) and is delimited by two side walls (8) of the outer container (4), by the rear wall (7) of the outer container (4) and by a rear wall (17) of the inner container (3), which is spaced apart from the rear wall (7) of the outer container (4).

7. The package (1) for tobacco articles according to claim 1, wherein:

each side wall (18) of the inner container (3) is obtained by overlapping a first flap (18') and a second flap (18"); and in each side wall (18) of the inner container (3), the extensions (25) make up a local lengthening of the second flaps (18") beyond a panel (17') making up the rear wall (17) of the inner container (3) and are obtained by making corresponding "U"-shaped cuts in the panel (17').

8. The package (1) for tobacco articles according to claim 1, wherein:

each side wall (18) of the inner container (3) is obtained by overlapping a first flap (18') and a second flap (18"); and in each side wall (18) of the inner container (3), the extensions (25) make up a continuous lengthening of the first flaps (18') beyond a panel (17') making up the rear wall (17) of the inner container (3).

9. The package (1) for tobacco articles according to claim 1 and comprising a collar (41), which is integral to the outer container (4), partially projects from an open upper end of the outer container (4), so as to engage a corresponding inner surface of the lid (9) when the lid (9) is arranged in the closed position, has a "U"-shaped cross section, and comprises a front wall (42) and two side walls (43).

10. The package (1) for tobacco articles according to claim 1, wherein the inner container (3) only comprises four walls: a rear wall (17) from which the connection tab (19) originates, a lower wall (15), and two side walls (18), each connected to the lower wall (15) by means of a corresponding tab (30).

11. The package (1) for tobacco articles according to claim 10, wherein the lower wall (15) of the inner container (3) and/or the side walls (18) of the inner container (3) have respective extensions (45, 25), which are coplanar to the corresponding walls (15, 18) of the inner container (3) and extend on the opposite side of the rear wall (17) of the inner container (3) relative to the corresponding walls (15, 18).

12. The package (1) for tobacco articles according to claim 11, wherein:

the group (2) of tobacco articles, at the bottom, rests against the lower wall (15) of the inner container (3) or, at the bottom, rests against an extension (45) of the lower wall (15) of the inner container (3); and the group (2) of tobacco articles laterally rests against the side walls (18) of the inner container (3) or laterally rests against extensions (25) of the side walls (18) of the inner container (3).

13. The package (1) for tobacco articles according to claim 1, wherein:

a front wall (16) of the inner container (3) is provided with a pair of claws (23), which laterally project so as to engage, by interference, corresponding side walls (14) of the lid (9) when the lid (9) is in the closed position; and the front wall (16) of the inner container (3) has, at the top, a "U"-shaped recess (47).

* * * * *